United States Patent [19]

Kulbida et al.

[11] 4,149,487

[45] Apr. 17, 1979

[54] XEROGRAPHIC MACHINE WITH INFINITELY VARIABLE DEVELOPER BIAS

[75] Inventors: Ihor Kulbida; Robert A. Burkett, both of Fairport; Thomas Meagher, Webster, all of N.Y.

[73] Assignee: Xerox Corporation, Stamford, Conn.

[21] Appl. No.: 829,023

[22] Filed: Aug. 30, 1977

[51] Int. Cl.[2] ..... G03G 15/09

[52] U.S. Cl. ..... 118/657; 118/647

[58] Field of Search ..... 118/657, 658, 647, 651, 118/7

[56] References Cited

U.S. PATENT DOCUMENTS

| | | | |
|---|---|---|---|
| 2,956,487 | 10/1960 | Gialmo, Jr. | 118/647 X |
| 3,262,806 | 7/1966 | Gourge | 118/657 X |
| 3,674,532 | 7/1972 | Morse | 118/647 X |
| 3,805,739 | 4/1974 | Feldeisen et al. | 118/657 |
| 3,850,662 | 11/1974 | Jahn | 118/647 X |
| 3,866,564 | 2/1975 | Wilson | 118/657 X |
| 3,893,415 | 7/1975 | Ashton et al. | 118/651 |
| 3,950,089 | 4/1976 | Fraser et al. | 118/658 X |
| 3,990,394 | 11/1976 | Katakura | 118/658 |
| 4,003,650 | 1/1977 | Courtney et al. | 118/647 X |
| 4,045,217 | 8/1977 | Fujimura et al. | 118/647 |

OTHER PUBLICATIONS

IBM Technical Disclosure Bulletin, Schaffert "Development of Electrostatic Images", vol. 1, No. 3, Oct. 1958, p. 6.

*Primary Examiner*—Werner H. Schroeder
*Assistant Examiner*—Andrew M. Falik

[57] ABSTRACT

A reproduction machine for producing copies incorporating a control for varying, infinitely over a given range copy shading. The control operates to change the fixed bias potential applied to the magnetic brush type developing rolls by providing through a variable voltage circuit, varying biasing potentials.

3 Claims, 49 Drawing Figures

FROM CLOCK 552
Ø1
Ø2
542
507
510
TO: MEMORY 545,546
ADDRESS
A0
A15
(HOLD A)
(HOLD)
(DBIN)
EN
TO: MEMORY
TO: MEMORY 545,546
508
DATA
D0
D7
511
TO: MEMORY READY 548
(MEMR)
(OUT)
(WO)
(INP)
(MI)
(HALTA)
(STACK)
(INTA)
LATCH REGISTER
Ø1-1
FROM: 552
(SYNC)
(READY)
FROM: MEMORY READY 548
(INT)
(RESET)
(WAIT)
FROM: 550
(INTE)
(WR)
TO: MEMORY 546,545

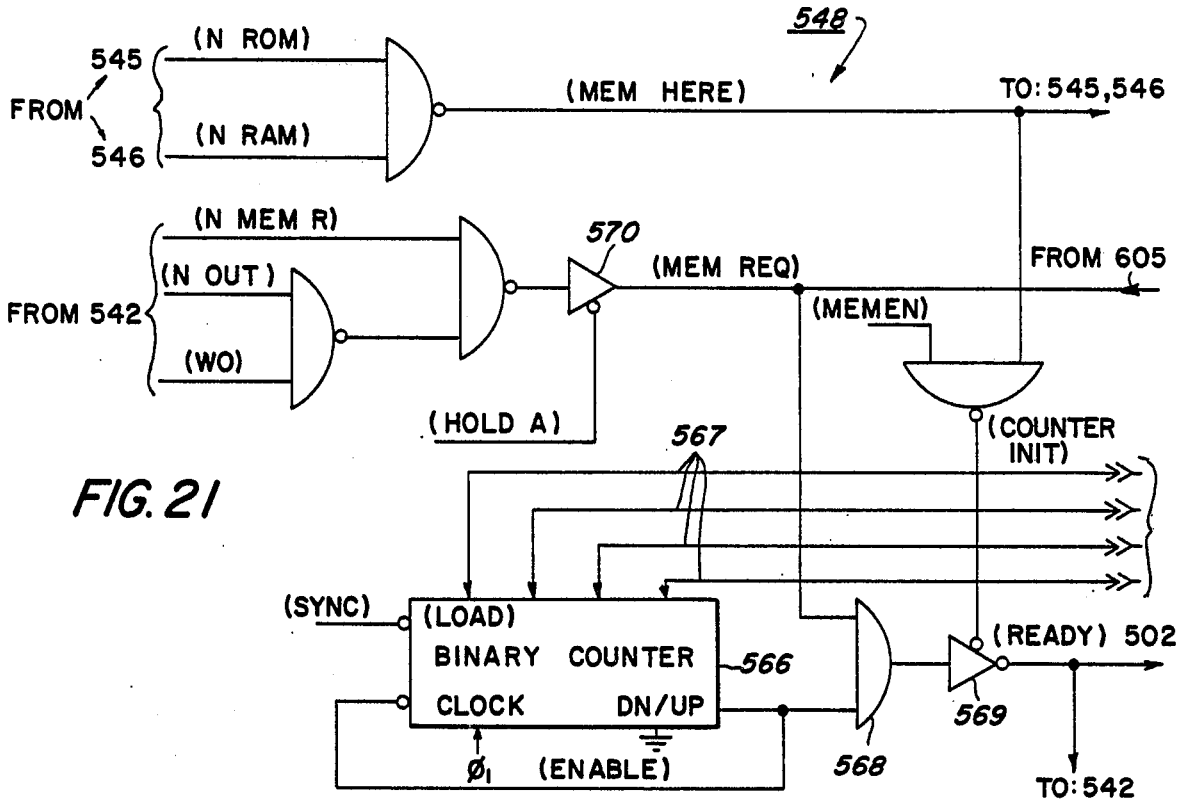
FIG. 21
MEMORY READY
FIG. 24
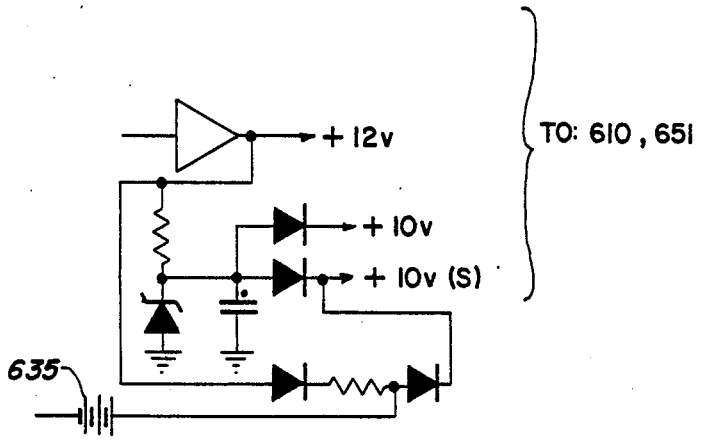

PITCH RESET INTERRUPT ROUTINE

LEGEND:

SR-SHIFT REGISTER
SR@PTR-SHIFT REGISTER POINTER
EV-EVENT
EV@PTR-EVENT POINTER
CNTR-COUNTER
INCRM-INCREMENT

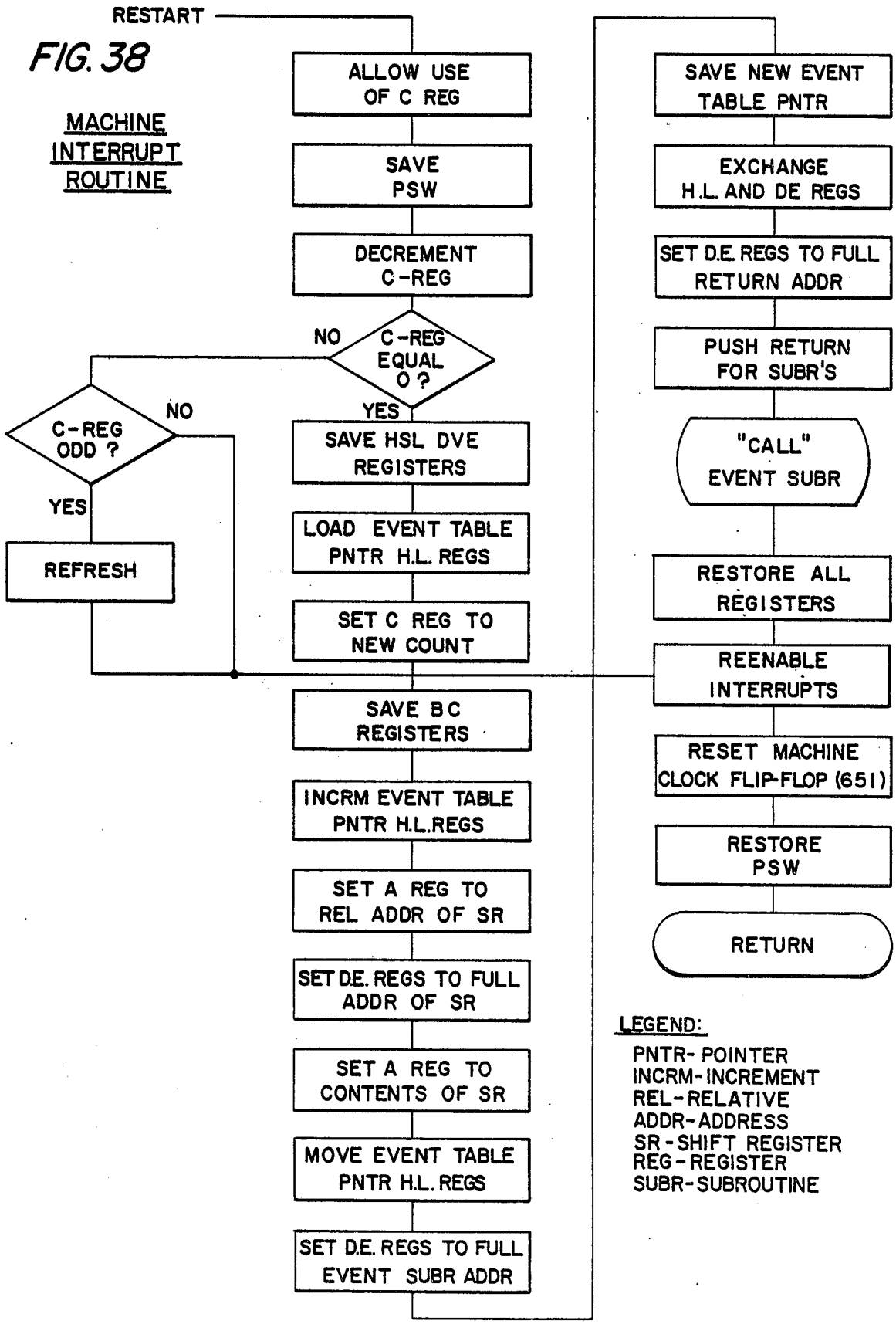
RESTART
FIG. 38
MACHINE INTERRUPT ROUTINE
ALLOW USE OF C REG
SAVE PSW
DECREMENT C-REG
C-REG EQUAL 0 ?
NO
YES
C-REG ODD ?
NO
YES
REFRESH
SAVE HSL DVE REGISTERS
LOAD EVENT TABLE PNTR H.L. REGS
SET C REG TO NEW COUNT
SAVE BC REGISTERS
INCRM EVENT TABLE PNTR H.L.REGS
SET A REG TO REL ADDR OF SR
SET D.E. REGS TO FULL ADDR OF SR
SET A REG TO CONTENTS OF SR
MOVE EVENT TABLE PNTR H.L. REGS
SET D.E. REGS TO FULL EVENT SUBR ADDR
SAVE NEW EVENT TABLE PNTR
EXCHANGE H.L. AND DE REGS
SET D.E. REGS TO FULL RETURN ADDR
PUSH RETURN FOR SUBR'S
"CALL" EVENT SUBR
RESTORE ALL REGISTERS
REENABLE INTERRUPTS
RESET MACHINE CLOCK FLIP-FLOP (651)
RESTORE PSW
RETURN
LEGEND:
PNTR- POINTER
INCRM- INCREMENT
REL- RELATIVE
ADDR- ADDRESS
SR - SHIFT REGISTER
REG - REGISTER
SUBR- SUBROUTINE

REAL TIME INTERRUPT

LEGEND:

PNTR - POINTER
RTC - REAL TIME COUNTER
CNTR - COUNTER
REG - REGISTER

XEROGRAPHIC MACHINE WITH INFINITELY VARIABLE DEVELOPER BIAS

BACKGROUND OF THE INVENTION

This invention relates to electrostatographic xerographic type reproduction machines, and more particularly, to an improved developing system for such machines.

In electrostatic type copying or reproducing machines, development of the electrostatic images being processed is today generally effected through the use of one or more magnetic brush rolls. To enhance development, the magnetic brush roll or rolls may have a voltage potential applied thereto to facilitate pickup of developing material by the roll or rolls and to aid in controlling the flow of toner from the magnetic brush roll or rolls to the electrostatic latent image.

In this connection, U.S. Pat. No. 3,805,739 to Ronald F. Feldeisen et al provides for selection of a voltage potential for biasing purposes above or below the normal biasing potential in response to whether the original being copies is dark or light. However, the aforedescribed makes no provision permitting the voltage selection to be infinitely varied by the operator when making copies thus giving the operator extremely fine control over the density of the copies produced.

It is therefore a principal object of the present invention to provide a new and improved electrostatic reproduction machine.

It is a further object of the present invention to provide an improved developing system for electrostatic type copiers.

It is an object of the present invention to provide an improved electrostatic developing system having control means to permit the image density to be infinitely varied.

It is an object of the present invention to provide a development control allowing voltage bias levels on the magnetic brush developing roll or rolls to be infinitely varied.

It is an object of the present invention to provide a magnetic brush developer having a biasing control effective to allow either a preselected biasing voltage or infinitely variable biasing voltages to be applied by the operator.

This invention relates to a reproduction machine for producing copies having at least one magnetic brush developing roll for developing electrostatic latent images processed by the reproduction machine together with voltage means for applying a biasing voltage to the developing roll to enhance development, in which the improvement comprises, control means for varying the biasing voltage over an infinitely variable range.

BRIEF DESCRIPTION OF THE DRAWINGS

Other objects and advantages will be apparent from the ensuing description and drawings in which:

FIG. 21 is a logic schematic of the CPU memory ready;

FIG. 24 is a logic schematic of the nonvolatile memory power supply;

FIG. 38 is a flow chart of the machine clock interrupt routine;

DETAILED DESCRIPTION OF THE PREFERRED EMBODIMENT OF THE INVENTION

Figure 1:
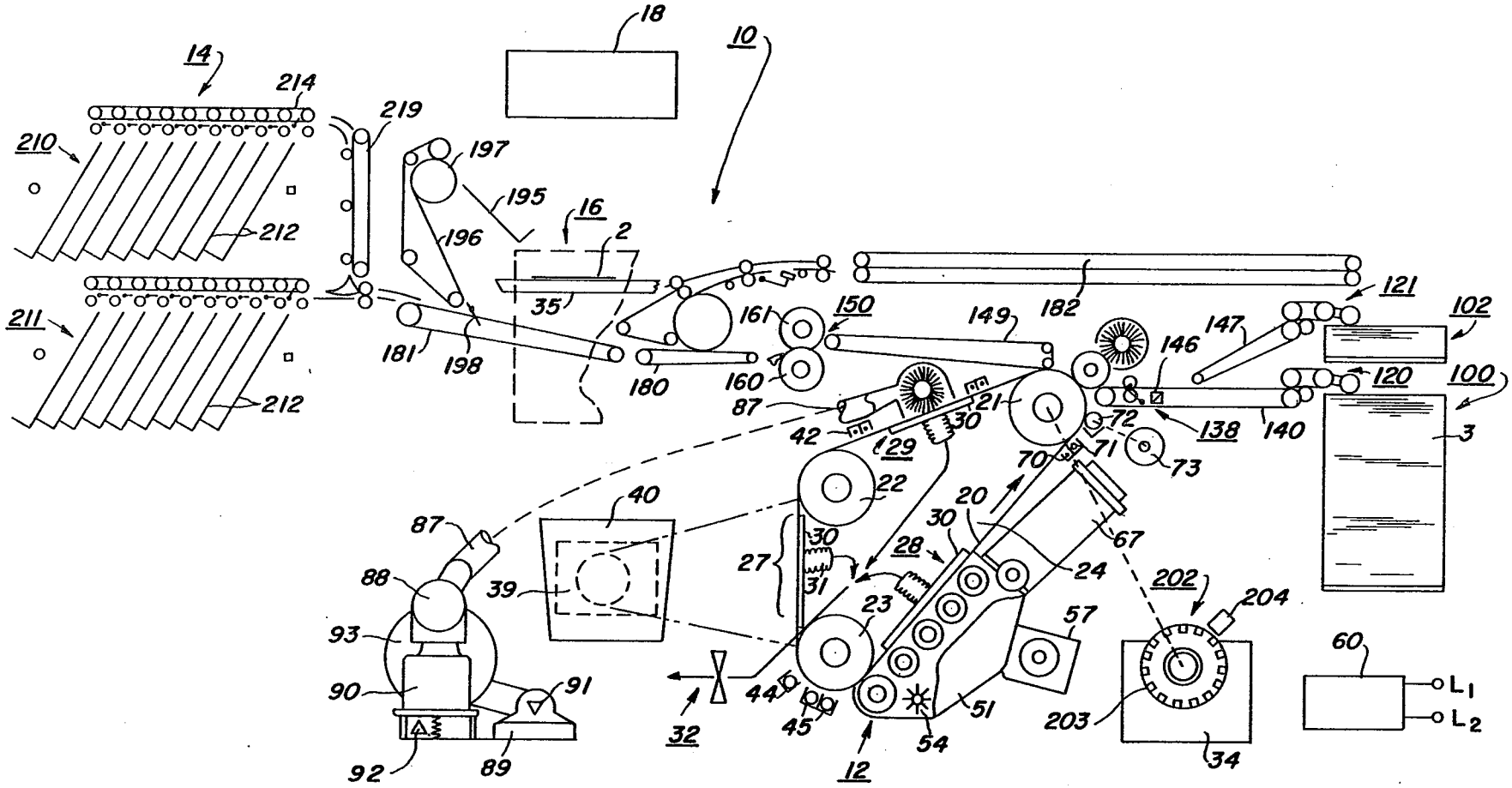
FIG. 1 is a schematic representation of an exemplary reproduction apparatus incorporating the control system of the present invention.
Figure 2:
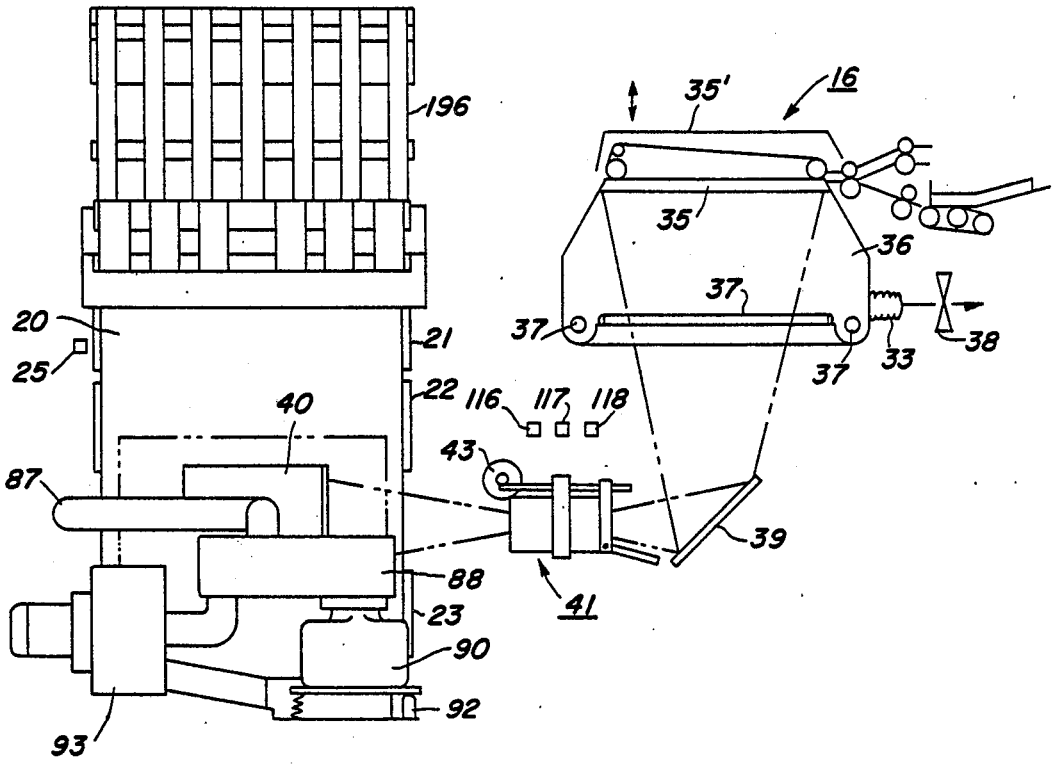
FIG. 2 is a vertical sectional view of the apparatus shown in FIG. 1 along the image plane.
Figure 3:
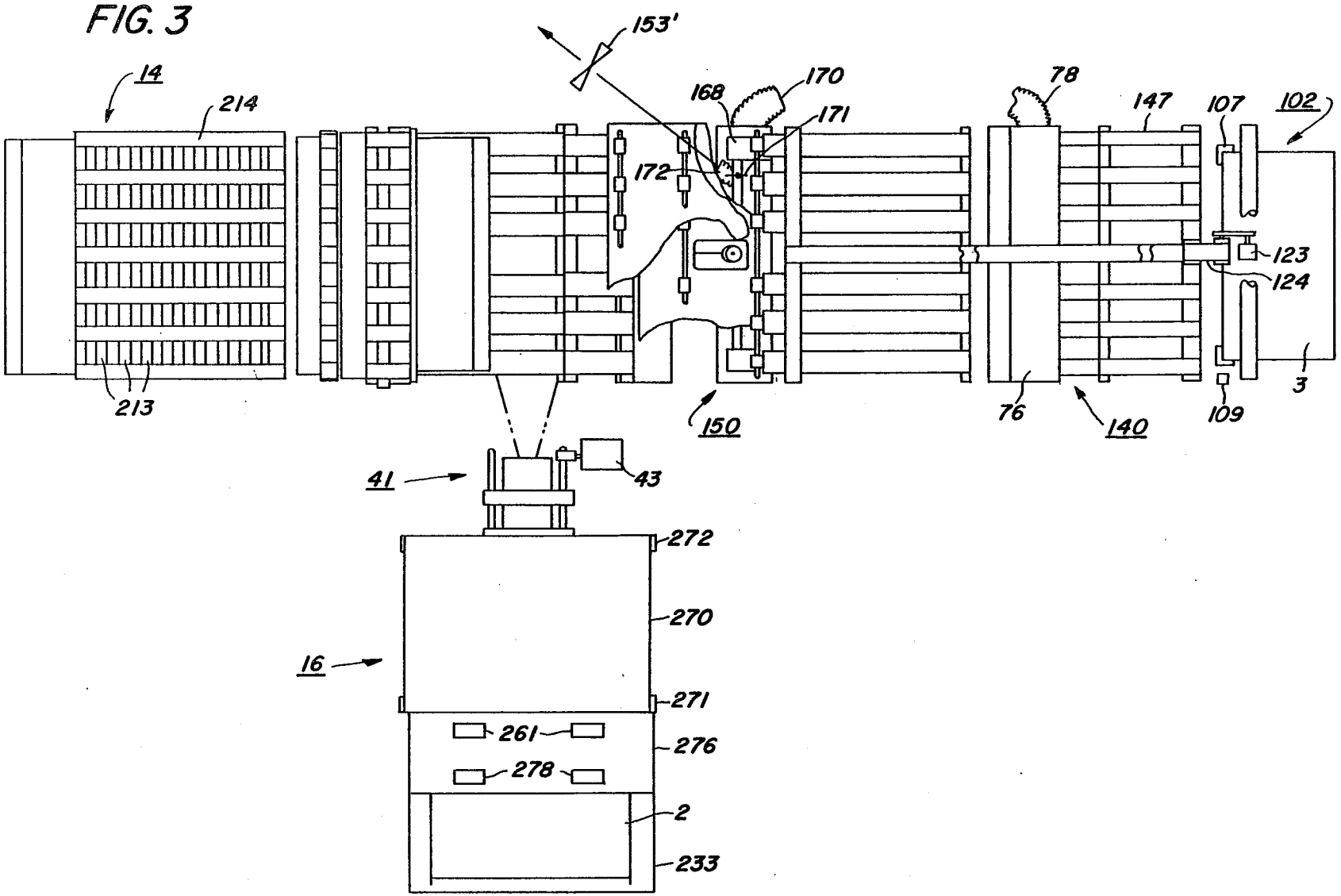
FIG. 3 is a top plane view of the apparatus shown in FIG. 1.

Referring particularly to FIGS. 1–3 of the drawings, there is shown, in schematic outline, an electrostatic reproduction system or host machine, identified by numeral 10, incorporating the control arrangement of the present invention. To facilitate description, the reproduction system 10 is divided into a main electrostatic xerographic processor 12, sorter 14, document handler 16, and controller 18. Other processor, sorter and/or document handler types and constructions, and different combinations thereof may instead by envisioned.

PROCESSOR

Processor 12 utilizes a photoreceptor in the form of an endless photoconductive belt 20 supported in generally triangular configuration by rolls 21, 22, 23. Belt supporting rolls 21, 22, 23 are in turn rotatably journaled on subframe 24.

In the exemplary processor illustrated, belt 20 comprises a photoconductive layer of selenium, which is the light receiving surface and imaging medium, on a conductive substrate. Other photoreceptor types and forms, such as comprising organic materials or of multilayers or a drum may instead be envisioned. Still other forms may comprise scroll type of arrangements wherein webs of photoconductive material may be plated in and out of the interior of supporting cylinders.

Figure 4:
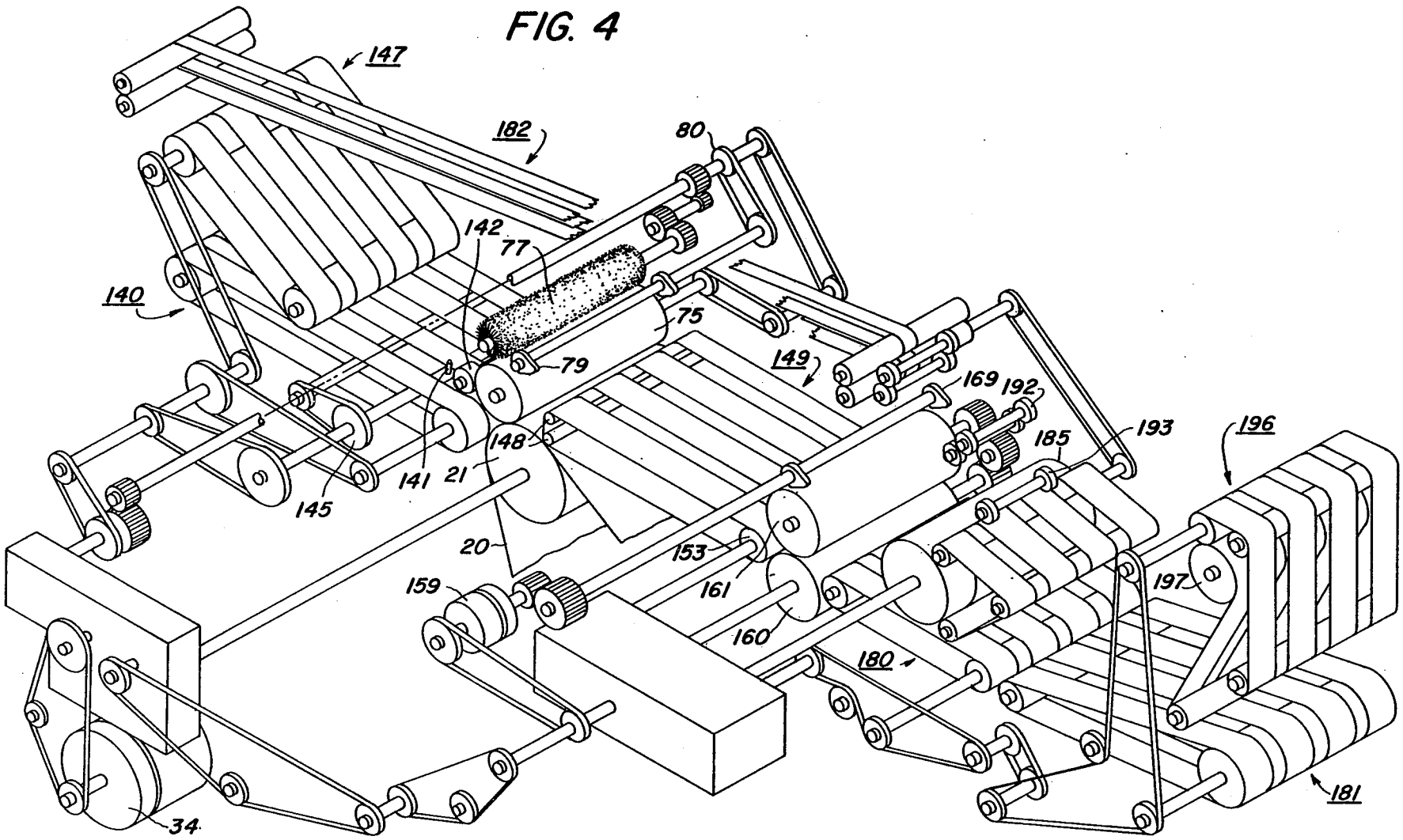
FIG. 4 is an isometric view showing the drive train for the apparatus shown in FIG. 1.

Suitable biasing means (not shown) are provided on subframe 24 to tension the photoreceptor belt 20 and insure movement of belt 20 along a prescribed operating path. Belt tracking switch 25 (shown in FIG. 2) monitors movement of belt 20 from side to side. Belt 20 is supported so as to provide a trio of substantially flat belt runs opposite exposure, developing, and cleaning stations, 27, 28, 29 respectfully. To enhance belt flatness at these stations, vacuum platens 30 are provided under belt 20 at each belt run. Conduits 31 communicate vacuum platens 30 with a vacuum pump 32. Photoconductive belt 20 moves in the direction indicated by the solid line arrow, drive thereto being effected through roll 21, which in turn is driven by main drive motor 34, as seen in FIG. 4.

Processor 12 includes a generally rectangular, horizontal transparent platen 35 on which each original 2 to be copies is disposed. A two or four sided illumination assembly, consisting of internal reflectors 36 and flash lamps 37 (shown in FIG. 2) disposed below and along at least two sides of platen 35, is provided for illuminating the original 2 on platen 35. To control temperatures within the illumination space, the assembly is coupled through conduit 33 with a vacuum pump 38 which is adapted to withdraw overly heated air from the space. To retain the original 2 in place on platen 35 and prevent escape of extraneous light from the illumination assembly, a platen cover 35' may be provided.

The light image generated by the illumination system is projected via mirrors 39, 40 and a variable magnification lens assembly 41 onto the photoreceptive belt 20 at the exposure station 27. Reversible motor 43 is provided to move the main lens and add on lens elements that comprise the lens assembly 41 to different predetermined positions and combinations to provide the preselected image sizes corresponding to push button selectors 818, 819, 820 on operator module 800. (See FIG. 32) Sensors 116, 117, 118 signal the present disposition of lens assembly 41. Exposure of the previously charged belt 20 selectively discharges the photoconductive belt to produce on belt 20 an electrostatic laten image of the original 2. To prepare belt 20 for imaging, belt 20 is uniformly charged to a preselected level by charge corotron 42 upstream of the exposure station 27.

Figure 5:
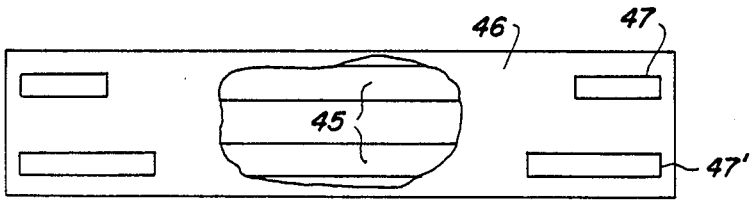
FIG. 5 is an enlarged view showing details of the photoreceptor edge fade-out mechanism for the apparatus shown in FIG. 1.

To prevent development of charged but unwanted image areas, erase lamps 44, 45 are provided. Lamp 44, which is referred to herein as the pitch fadeout lamp, is supported in transverse relationship to belt 20, lamp 44 extending across substantially the entire width belt 20 to erase (i.e. discharge) areas of belt 20 before the first image, between successive images, and after the last image. Lamps 45, which are referred to herein as edge fadeout lamps, serve to erase areas bordering each side of the images. Referring particularly to FIG. 5, edge fadeout lamps 45, which extend transversely to belt 20, are disposed within a housing 46 having a pair of transversely extending openings, 47, 47' of differing length adjacent each edge of belt 20. By selectively actuating one or the other of the lamps 45, the width of the area bordering the sides of the image that is erased can be controlled.

Figure 6:
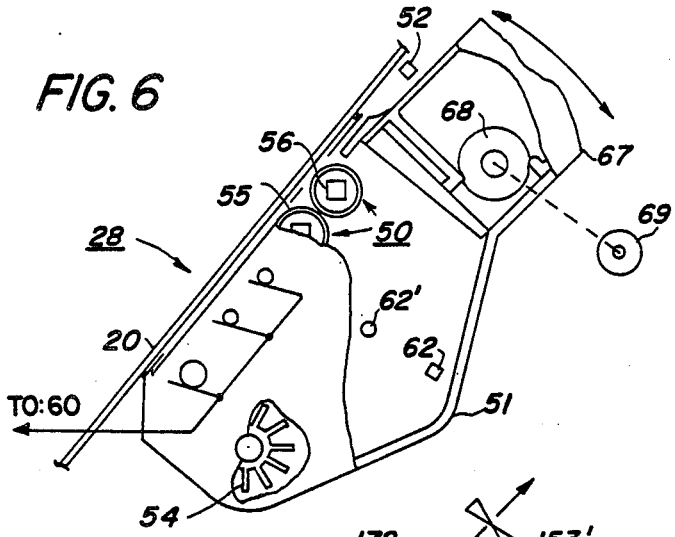
FIG. 6 is an enlarged view showing details of the developing mechanism for the apparatus shown in FIG. 1.
Figure 7:
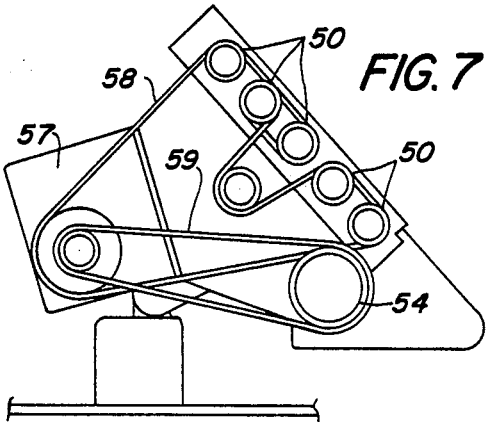
FIG. 7 is an enlarged view showing details of the developing mechanism drive.

Referring to FIGS. 1, 6 and 7, magnetic brush rolls 50 are provided in a developer housing 51 at developing station 28. Housing 51 is pivotally supported adjacent the lower end thereof with interlock switch 52 to sense disposition of housing 51 in operative position adjacent belt 20. The bottom of housing 51 forms a sump within which a supply of developing material is contained. A rotatable auger 54 in the sump area serves to mix the developing material and bring the material into operative relationship with the lowermost of the magnetic brush rolls 50.

As will be understood by those skilled in the art, the electrostatically attractable developing material commonly used in magnetic brush developing apparatus of the type shown comprises a pigmented resinous powder, referred to as toner, and larger granular beads referred to as carrier. To provide the necessary magnetic properties, the carrier is comprised of a magnetizable material such as steel. By virtue of the magnetic fields established by developing rolls 50 and the interrelationship therebetween, a blanket of developing material is formed along the surfaces of developing rolls 50 adjacent the belt 20 and extending from one roll to another. Toner is attracted to the electrostatic latent image from the carrier bristles to produce a visible powder image on the surface of belt 20.

Magnetic brush rolls 50 each comprise a rotatable exterior sleeve 55 with relatively stationary magnet 56 inside. Sleeves 55 are rotated in unison and at substantially the same speed as belt 20 by a developer drive motor 57 through a belt and pulley arrangement 58. A second belt and pulley arrangement 59 drives auger 54.

To regulate development of the latent electrostatic images on belt 20, magnetic brush sleeves 55 are electrically biased. A suitable power supply 60 is provided for this purpose with the amount of bias being regulated by controller 18.

Figure 8:
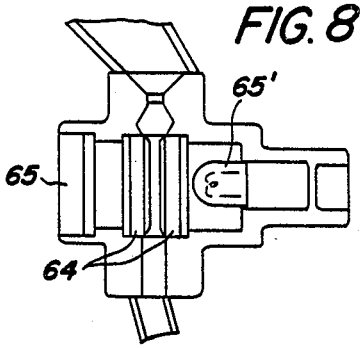
FIG. 8 is an enlarged view showing details of the developability control for the apparatus shown in FIG. 1.
Figure 11:
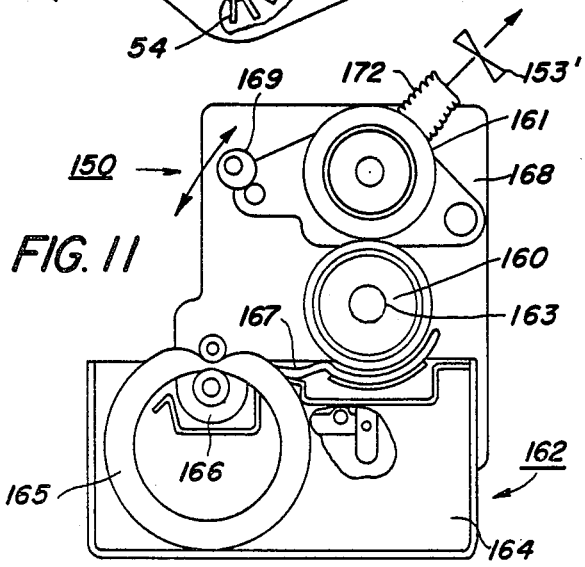
FIG. 11 is an enlarged view showing details of the fuser for the apparatus shown in FIG. 1.

Developing material is returned to the upper portion of developer housing 51 for reuse and is accomplished by utilizing a photocell 62 which monitors the level of developing material in housing 51 and a photocell lamp 62' spaced opposite to the photocell 62 in cooperative relationship therewith. The disclosed machine is also provided with automatic developability control which maintains an optimum proportion of toner-to-carrier material by sensing toner concentration and replenishing toner, as needed. As shown in FIG. 8, the automatic developability control comprises a pair of transparent plates 64 mounted in spaced, parallel arrangement in developer housing 51 such that a portion of the returning developing material passes therebetween. A suitable circuit, not shown, alternately places a charge on the plates 64 to attract toner thereto. Photocell 65 on one side of the plate senses the developer material as the material passes therebetween. Lamp 65' on the opposite side of plate pair 64 provides reference illumination. In this arrangement, the returning developing material is alternately attracted and repelled to and from plate 64. The accumulation of toner, i.e. density determines the amount of light transmitted from lamp 65' to photocell 65. Photocell 65 monitors the density of the returning developing material with the signal output therefrom being used by controller 18 to control the amount of fresh or make-up toner to be added to developer housing 51 from toner supply container 67.

To discharge toner from container 67, rotatable, dispensing roll 68 is provided in the inlet to developer housing 51. Motor 69 drives roll 68. When fresh toner is required, as determined by the signal from photocell 65, controller 18 actuates motor 69 to turn roll 68 for a timed interval. The rotating roll 68, which is comprised of a relatively porous sponge-like material, carries toner particles thereon into developer housing 51 where it is discharged. Pre-transfer corotron 70 and lamp 71 are provided downstream of magnetic brush rolls 50 to regulate developed image charges before transfer.

A magnetic pick-off roll 72 is rotatably supported opposite belt 20 downstream of pre-transfer lamp 71, roll 72 serving to scavenge leftover carrier from belt 20 preparatory to transfer of the developed image to the copy sheet 3. Motor 73 turns roll 72 in the same direction and at substantially the same speed as belt 20 to prevent scoring or scratching of belt 20. One type of magnetic pick-off roll is shown in U.S. Pat. No. 3,834,804, issued Oct. 10, 1974 to Bhagat et al.

Figure 9:
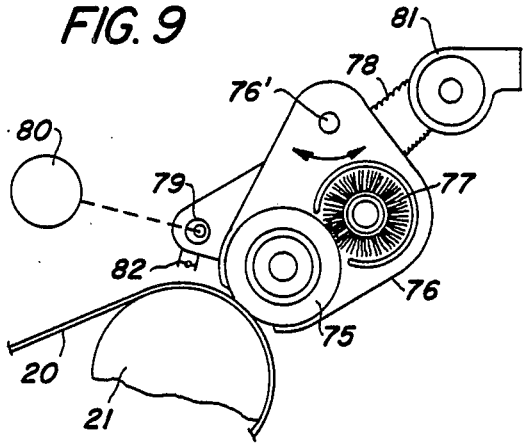
FIG. 9 is an enlarged view showing details of the transfer roll support mechanism for the apparatus shown in FIG. 1.
Figure 12:
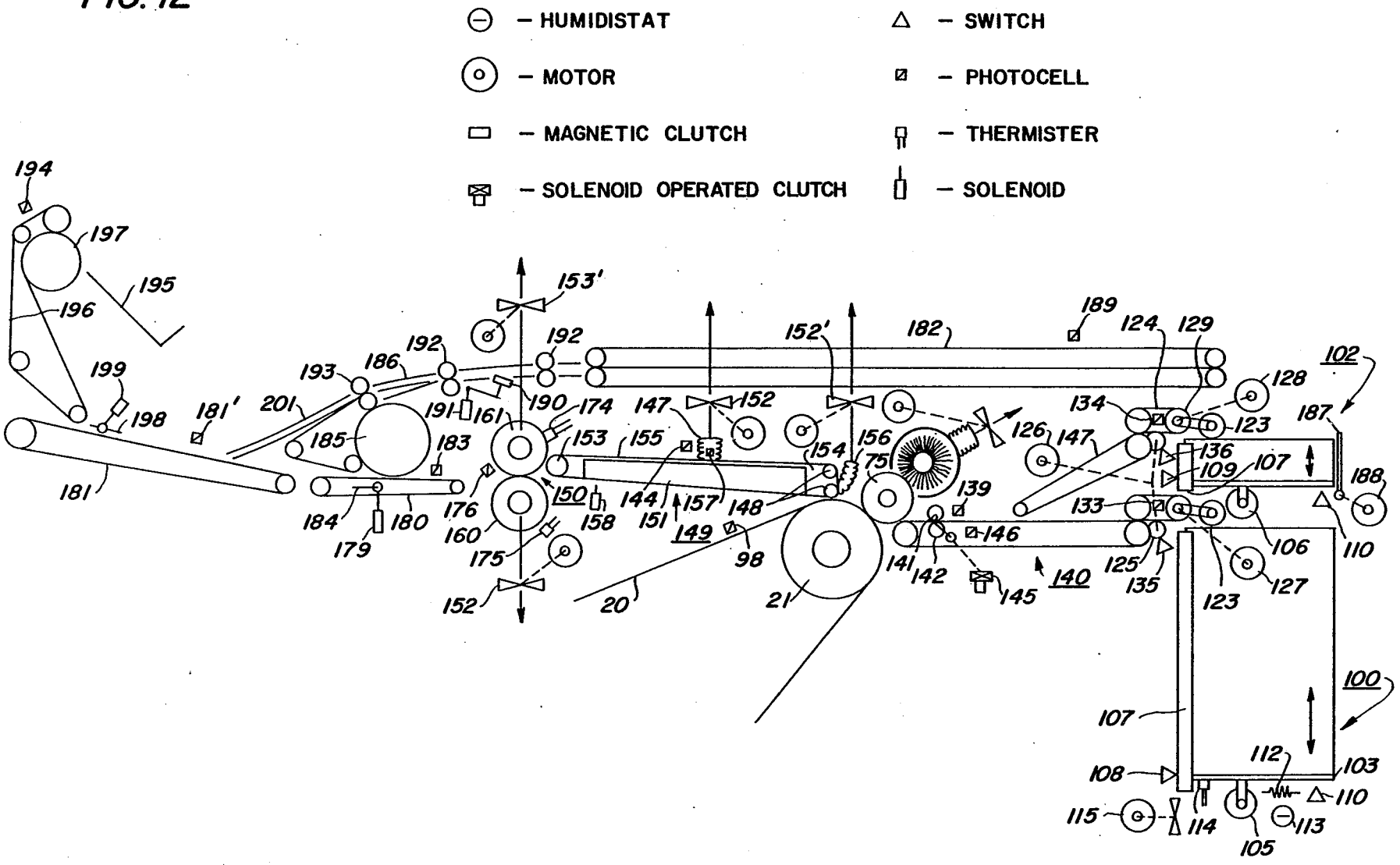
FIG. 12 is a schematic view showing the paper path and sensors of the apparatus shown in FIG. 1.

Referring to FIGS. 4, 9 and 12, to transfer developed images from belt 20 to the copy sheets 3, a transfer roll 75 is provided. Transfer roll 75, which forms part of the copy sheet feed path, is rotatably supported within a transfer roll housing opposite belt suport roll 21. Housing 76 is pivotally mounted at 76' to permit the transfer roll assembly to be moved into and out of operative relationship with belt 20. A transfer roll cleaning brush 77 is rotatably journalled in transfer roll housing 76 with the brush periphery in contact with transfer roll 90. Transfer roll 75 is driven through contact with belt 20 while cleaning brush 77 is coupled to main drive motor 34. To remove toner, housing 76 is connected through conduit 78 with vacuum pump 81. To facilitate and control transfer of the developed images from belt 20 to the copy sheets 3, a suitable electrical bias is applied to transfer roll 75.

To permit transfer roll 75 to be moved into and out of operative relationship with belt 20, cam 79 is provided in driving contact with transfer roll housing 76. Cam 79 is driven from motor 34 through an electromgnetically operated one revolution clutch 80. Spring means (not shown) serves to maintain housing 76 in driving engagement with cam 79.

To facilitate separation of the copy sheets 3 from belt 20 following transfer of developed images, a detack corotron 82 is provided. Corotron 82 generates a charge designed to neutralize or reduce the charges tending to retain the copy sheet on belt 20. Corotron 82 is supported on transfer roll housing 76 opposite belt 20 and downstream of transfer roll 75.

Figure 10:
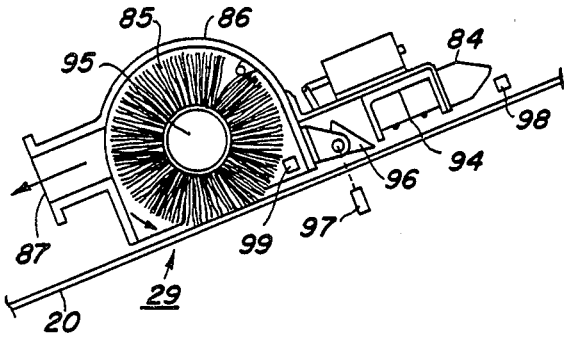
FIG. 10 is an enlarged view showing details of the photoreceptor cleaning mechanism for the apparatus shown in FIG. 1.

Referring to FIGS. 1, 2 and 10, to prepare belt 20 for cleaning, residual charges on belt 20 are removed by discharge lamp 84 and preclean corotron 94. A cleaning brush 85, rotatably supported within an evacuated semicircular shaped brush housing 86 at cleaning station 29, serves to remove residual developed from belt 20. Motor 95 drives brush 85, brush 85 turning in a direction opposite that of belt 20.

Vacuum conduit 87 couples brush housing 86 through a centrifugal type separator 88 with the suction side of vacuum pump 93. A final filter 89 on the outlet of motor 93 traps particles that pass through separator 88. The heavier toner particles separated by separator 88 drop into and are collected in one or more collecting bottles 90. Pressure sensor 91 monitors the condition of final filter 89 while a sensor 92 monitors the level of toner particles in collecting bottles 90.

To obviate the danger of copy sheets remaining on belt 20 and becoming entangled with the belt cleaning mechanism, a deflector 96 is provided upstream of cleaning brush 85. Deflector 96, which is pivotally supported on the brush housing 86, is operated by solenoid 97. In the normal or off position, deflector 96 is spaced from belt 20 (the solid line position shown in the drawings). Energization of solenoid 97 pivots deflector 96 downwardly to bring the deflector leading edge into close proximity to belt 20.

Sensors 98, 99 are provided on each side of deflector 96 for sensing the presence of copy material on belt 20. A signal output from upstream sensor 98 triggers solenoid 97 to pivot deflector 96 into position to intercept the copy sheet on belt 20. The signal from sensor 98 also initiates a system shutdown cycle (mis-strip jam) wherein the various operating components are, within a prescribed interval, brought to a stop. The interval permits any copy sheet present in fuser 150 to be removed, sheet trap solenoid 158 (FIG. 12) having been actuated to prevent the next copy sheet from entering fuser 150 and becoming trapped therein. The signal from sensor 99, indicating failure of deflector 96 to intercept or remove the copy sheet from belt 20, triggers an immediate or hard stop (sheet on selenium jam) of the processor. In such instances the power to drive motor 34 is interrupted to bring belt 20 and the other components driven therefrom to an immediate stop.

Referring particularly to FIGS. 1 and 12, copy sheets 3 comprise precut paper sheets supplied from either main or auxiliary paper trays 100, 102. Each paper tray has a platform or base 103 for supporting in stack-like fashion a quantity of sheets. The tray permits 103 are supported for vertical up and down movement by motors 105, 106. Side guide pairs 107, in each tray 100, 102 delimit the tray side boundaries, the guide pairs being adjustable toward and away from one another in accommodation of different size sheets. Sensors 108, 109 respond to the position of each side guide pair 107, the output of sensors 108, 109 serving to regulate operation of edge fadeout lamps 45 and fuser cooling valve 171 (FIG. 3). Lower limit switches 110 on each tray prevent overtravel of the tray platform in a downward direction,.

A heater 112 is provided below the platform 103 of main tray 100 to warm the tray area and enhance feeding of sheets therefrom. Humidstat 113 and thermostat 114 control operation of heater 112 in response to the temperature/humidity conditions of main tray 100. Fan 115 is provided to circulate air within tray 100.

To advance the sheets 3 from either main or auxiliary tray 100, 102, main and auxiliary sheet feeders 120, 121 are provided. Feeders 120, 121 each include a nudger roll 123 to engage and advance the topmost sheet in the paper tray forward into the nip formed by a feed belt 124 and retard roll 125. Retard rolls 125, which are driven at an extremely low speed by motor 126, cooperate with feed belts 124 to restrict feeding of sheets from trays 100, 102 to one sheet at a time.

Feed belts 124 are driven by main and auxiliary sheet feed motors 127, 128 respectively. Nudger rolls 123 are supported for pivotal movement about the axis of feed belt drive shaft 129 with drive to the nudger rolls taken from drive shaft 129. Stack height sensors 133, 134 are provided for the main and auxiliary trays, the pivoting nudger rolls 123 serving to operate sensors 133, 134 in response to the sheet stack height. Main and auxiliary tray misfeed sensors 135, 136 are provided at the tray outlets.

Main transport 140 extends from main paper tray 100 to a point slightly upstream of the nip formed by photoconductive belt 20 and transfer roll 75. Transport 140 is driven from main motor 34. To register sheets 3 with the images developed on belt 20, sheet register fingers 141 are provided, fingers 141 being arranged to move into and out of the path of the sheets on transport 140 once each revolution (see also (FIG. 4). Registration fingers 141 are driven from main motor 34 through electromagnetic clutch 145. A timing or reset switch 146 is set once on each revolution of sheet register fingers 141. Sensor 139 monitors transport 140 for jams. Further amplification of sheet register system may be found in U.S. Pat. No. 3,781,004, issued Dec. 25, 1973 to Buddendeck et al.

Pinch roll pair 142 is interspaced between transport belts that comprise main transport 140 on the downstream side of register fingers 141. Pinch roll pair 142 are driven from main motor 34.

Auxiliary transport 147 extends from auxiliary tray 102 to main transport 140 at a point upstream of sheet register fingers 141. Transport 147 is driven from motor 34.

To maintain the sheets in driving contact with the belts of transports 140, 147, suitable or retainers (not shown) may be provided along the belt runs.

The image bearing sheets leaving the nip formed by photoconductive belt 20 and transfer roll 75 are picked off by belts 155 of the leading edge of vacuum transport 149. Belts 155, which are perforated for the admission of vacuum therethrough, ride on forward roller pair 148 and rear roll 153. A pair of internal vacuum plenums 151, 154 are provided, the leading plenum 154 cooperating with belts 155 to pick up the sheets leaving the belt/transfer roll nip. Transport 149 conveys the image bearing sheets to fuser 150. Vacuum conduits 147, 156 communicate plenums 151, 154 with vacuum pumps 152, 152'. A pressure sensor 157 monitors operation of vacuum pump 152. Sensor 144 monitors transport 149 for jams.

To prevent the sheet on transport 149 from being carried into fuser 150 in the event of a jam or malfunction, a trap solenoid 158 is provided below transport 149. Energization of solenoid 158 raises the armature thereof into contact with the lower face of plenum 154 to intercept and stop the sheet moving therepast.

Referring particularly to FIGS. 4, 10 and 12, fuser 150 comprises a lower heated fusing roll 160 and upper pressure roll 161. Rolls 160, 161 are supported for rotation in fuser housing 162. The core of fusing roll 160 is hollow for receipt of heating rod 163 therewithin.

Housing 162 includes a sump 164 for holding a quantity of liquid release agent, herein termed oil. Dispensing belt 165, moves through sump 164 to pick up the oil, belt 165 being driven by motor 166. A blanket-like wick 167 carries the oil from belt 165 to the surface of fusing roll 160.

Pressure roll 161 is supported within an upper pivotal section 168 of housing 162. This enables pressure roll 161 to be moved into and out of operative contact fusing roll 160. Cam shaft 169 in the lower portion of fuser housing 162 serves to move housing section 168 and pressure roll 161 into operative relationship with fusing roll 160 against a suitable bias (not shown). Cam shaft 169 is coupled to main motor 34 through an electromagnetically operated one revolution clutch 159.

Fuser section 168 is evacuated, conduit 170 coupling housing section 168 with vacuum pump 152. The ends of housing section 168 are separated into vacuum compartments opposite the ends of pressure roll 161 thereunder to cool the roll ends where smaller size copy sheets 3 are being processed. Vacuum valve 171 (FIG. 3) in conduit 172 regulates communication of the vacuum compartments with vacuum pump 153' in response to the size sheets as sensed by side guide sensors 108, 109 in paper trays 100, 102.

Fuser roll 160 is driven from main motor 34. Pressure roll 161 is drivingly coupled to fuser roll 160 for rotation therewith.

Thermostat 174 (FIG. 12) in fuser housing 162 controls operation of heating rod 163 in response to temperature. Sensor 175 protects against fuser overtemperature. To protect against trapping of a sheet in fuser 150 in the event of a jam, sensor 176 is provided.

Following fuser 150, the sheet is carried by post fuser transport 180 to either discharge transport 181 or, where duplex or two sided copies are desired, to return transport 182. Sheet sensor 183 monitors passage of the sheets from fuser 150. Transports 180, 181 are driven from main motor 34. Sensor 181' monitors transport 181 for jams. Suitable retaining means may be provided to retain the sheets on transports 180, 181.

A deflector 184, when extended, directs sheets on transport 180 onto conveyor roll 185 and into chute 186 leading to return transport 182. Solenoid 179, when energized raises deflector 184 into the sheet path. Return transport 182 carries the sheets back to auxiliary tray 102. Sensor 189 monitors transport 182 for jams. The forward stop 187 of tray 102 is supported for oscillating movement. Motor 188 drives stop 187 back and forth tap sheets returned to auxiliary tray 102 into alignment for refeeding.

To invert duplex copy sheets following fusing of the second or duplex image, a displaceable sheet stop 190 is provided adjacent the discharge end of chute 186. Stop 190 is pivotally supported for swinging movement into and out of chute 186. Solenoid 191 is provided to move stop 190 selectively into or out of chute 186. Pinch roll pairs 192, 193 serve to draw the sheet trapped in chute 186 by stop 190 and carry the sheet forward onto discharge transport 181. Further description of the inverter mechanism may be found in U.S. Pat. No. 3,856,295, issued Dec. 24, 1974, to John H. Looney.

Output tray 195 receives unsorted copies. Transport 196 a portion of which is wrapped around a turn around roll 197, serves to carry the finished copies to tray 195. Sensor 194 monitors transport 196 for jams. To route copies into output tray 195, a deflector 198 is provided. Deflector solenoid 199, when energized, turns deflector 198 to intercept sheets on conveyor 181 and route the sheets onto conveyor 196.

When output tray 195 is not used, the sheets are carried by conveyor 181 to sorter 14.

SORTER

Figure 13:
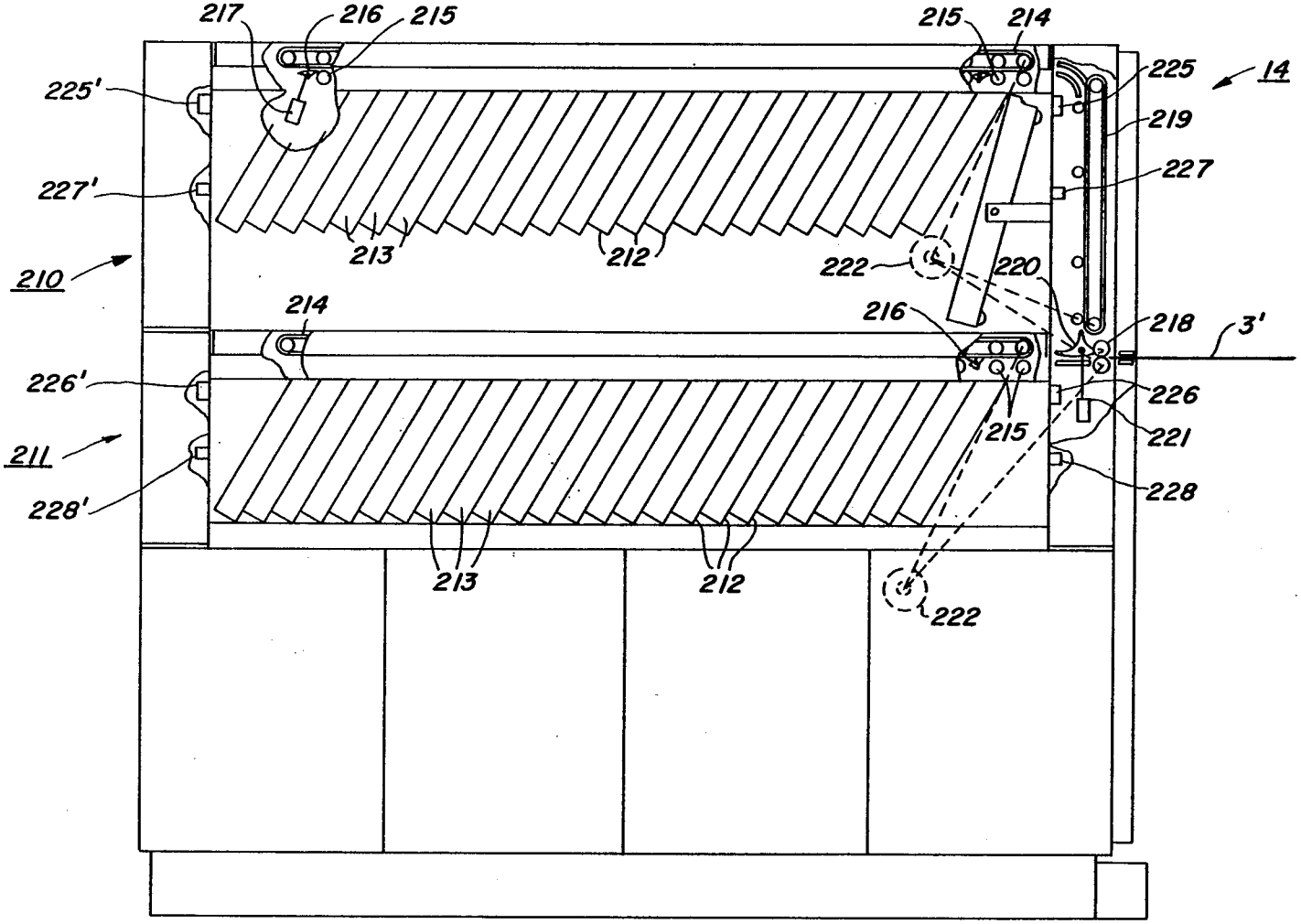
FIG. 13 is an enlarged view showing details of the copy sorter for the apparatus shown in FIG. 1.

Referring particularly to FIG. 13, sorter 14 comprises upper and lower bin arrays 210, 211. Each bin array 210, 211 consists of series of spaced downwardly inclined trays 212, forming a series of individual bins 213 for receipt of finished copies 3'. Conveyors 214 along the top of each bin array, cooperate with idler rolls 215 adjacent the inlet to each bin to transport the copies into juxtaposition with the bins. Individual deflectors 216 at each bin cooperate, when depressed, with the adjoining idler roll 215 to turn the copies into the bin associated therewith. An operating solenoid 217 is provided for each deflector.

A driven roll pair 218 is provided at the inlet to sorter 14. A generally vertical conveyor 219 serves to bring copies 3' to the upper bin array 210. Entrance deflector 220 routes the copies selectively to either the upper or lower bin array 210, 211 respectively. Solenoid 221 operates deflector 220.

Motor 222 is provided for each bin array to drive the conveyors 214 and 219 of upper bin array 210 and conveyor 214 of lower bin array 211. Roll pair 218 is drivingly coupled to both motors.

To detect entry of copies 3' in the individual bins 213, a photoelectric type sensor 225, 226 is provided at one end of each bin array 210, 211 respectively. Sensor lamps 225', 226' are disposed adjacent the other end of the bin array. To detect the presence of copies in the bins 213, a second set of photoelectric type sensors 227, 228 is provided for each bin array, on a level with a tray cutout (not shown). Reference lamps 227', 228' are disposed opposite sensors 227, 228.

DOCUMENT HANDLER

Figure 14:
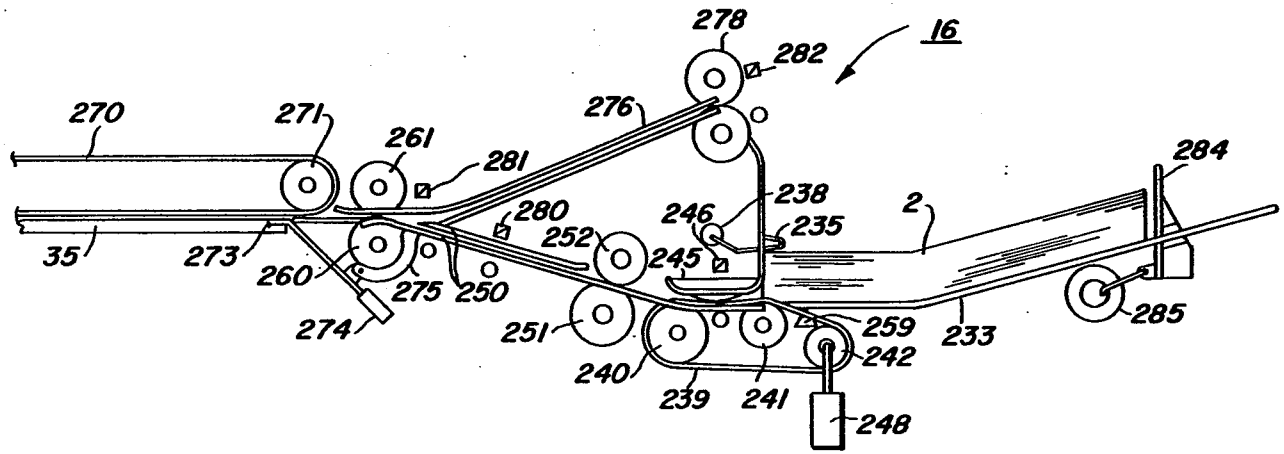
FIG. 14 is a schematic view showing details of the document handler for the apparatus shown in FIG. 1.
Figure 15:
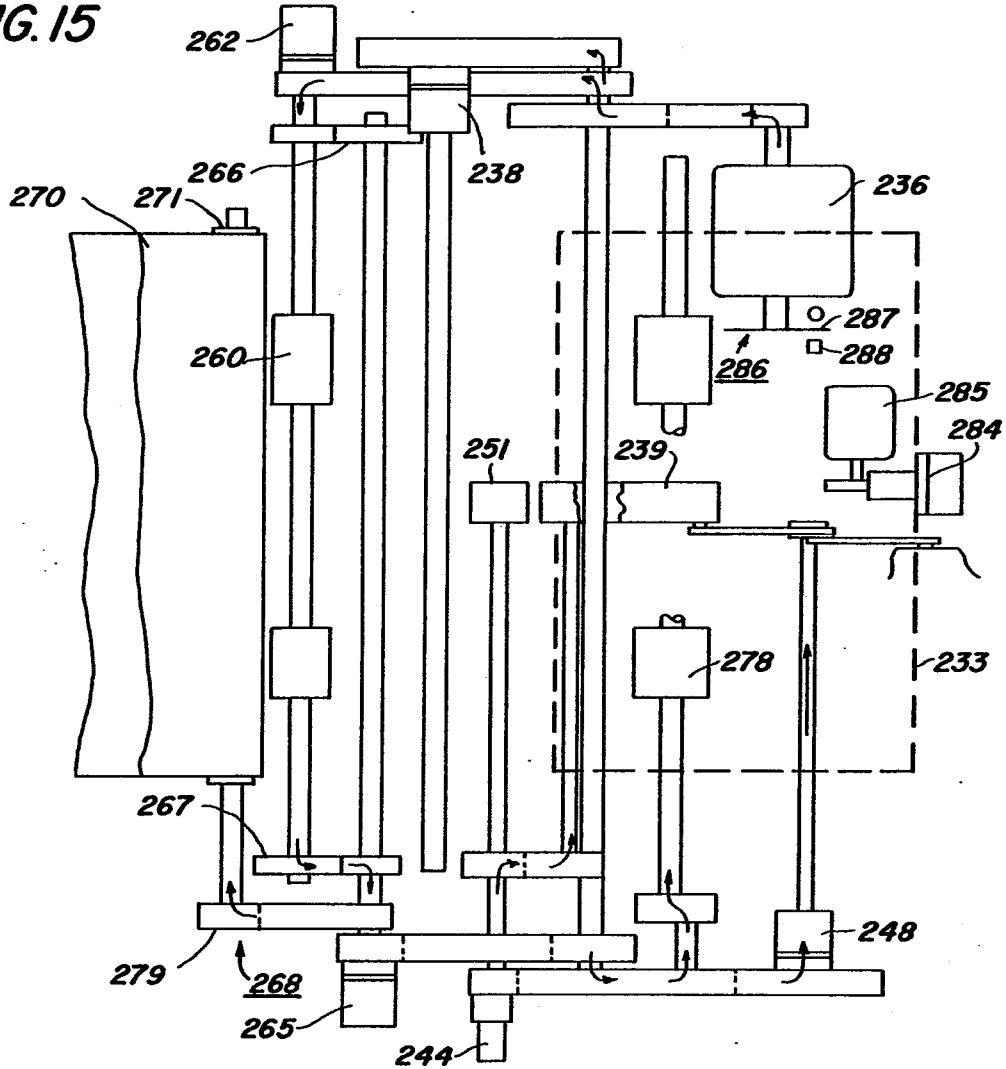
FIG. 15 is a view showing details of the drive mechanism for the document handler shown in FIG. 14.

Referring particularly to FIGS. 14 and 15, document handler 16 includes a tray 233 into which originals or documents 2 to be copied are placed by the operator following which a cover (not shown) is closed. A movable bail or separator 235, driven in an oscillatory path from motor 236 through a solenoid operated one revolution clutch 238, is provided to maintain document separation.

A document feed belt 239 is supported on drive and idler rolls 240, 241 and kicker roll 242 under tray 233, tray 233 being suitably apertured to permit the belt surface to project therewithin. Feedbelt 239 is driven by motor 236 through electromagnetic clutch 244. Guide 245, disposed near the discharge end of feed belt 239, cooperates with belt 239 to form a nip between which the documents pass.

A photoelectric type sensor 246 is disposed adjacent the discharge end of belt 239. Sensor 246 responds on failure of a document to feed within a predetermined interval to actuate solenoid operated clutch 248 which raises kicker roll 242 and increases the surface area of feed belt 239 in contact with the documents. Another sensor 259 located underneath tray 233 provides an output signal when the last document 2 of each set has left the tray 233.

Document guides 250 route the document fed from tray 233 via roll pair 251, 252 to platen 35. Roll 251 is drivingly coupled to motor 236 through electromagnetic clutch 244. Contact of roll 251 with roll 252 turns roll 252.

Roll pair 260, 261 at the entrance to platen 35 advance the document onto platen 35, roll 260 being driven through electromagnetic clutch 262 in the forward direction. Contact of roll 260 with roll 261 turns roll 261 in the document feeding direction. Roll 260 is selectively coupled through gearset 268 with motor 236 through electromagnetic clutch 265 so that on engagement of clutch 265 and disengagement of clutch 262, roll 260 and roll 261 therewith turn in the reverse direction to carry the document back to tray 233 via return chute 276. One way clutches 266, 267 permit free wheeling of the roll drive shafts.

The document leaving roll pair 260, 261 is carried by platen feed belt 270 onto platen 35, belt 270 being comprised of a suitable flexible material having an exterior surface of xerographic white. Belt 270 is carried about drive and idler rolls 271, 272. Roll 271 is drivingly coupled to motor 236 for rotation in either a forward or reverse direction through clutches 262, 265. Engagement of clutch 262 operates through belt and pulley drive 279 to drive belt in the forward direction, engagement of clutch 265 operates through drive 279 to drive belt 270 in the reverse direction.

To locate the document in predetermined position on platen 35, a register 273 is provided at the platen inlet for engagement with the document trailing edge. For this purpose, control of platen belt 270 is such that following transporting of the document onto plate 35 and beyond register 273, belt 270 is reversed to carry the document backwards against register 273.

To remove the document from platen 35 following copying, register 273 is retracted to an inoperative position. Solenoid 274 is provided for moving register 273.

A document deflector 275, is provided to route the document leaving platen 35 into return chute 276. For this purpose, platen belt 270 and pinch roll pair 260, 261 are reversed through engagement of clutch 265. Discharge roll pair 278, driven by motor 236, carry the returning document into tray 233.

To monitor movement of the documents in document handler 16 and detect jams and other malfunctions, photoelectric type sensors 246 and 280, 281 and 282 are disposed along the document routes.

To align documents 2 returned to tray 233, a document patter 284 is provided adjacent one end of tray 233. Patter 284 is oscillated by motor 285.

TIMING

To provide the requisite operational synchronization between host machine 10 and controller 18 as will appear, processor or machine clock 202 is provided. Referring particularly to FIG. 1, clock 202 comprises a toothed disc 203 drivingly supported on the output shaft of main drive motor 34. A photoelectric type signal generator 204 is disposed astride the path followed by the toothed rim of disc 203, generator 204 producing, whenever drive motor 34 is energized, a pulse like signal output at a frequency correlated with the speed of motor 34, and the machine components driven therefrom.

As described, a second machine clock, termed a pitch reset clock 138 herein, and comprising timing switch 146 is provided. Switch 146 cooperates with sheet register fingers 141 to generate an output pulse once each revolution of fingers 141. As will appear, the pulse like output of the pitch reset clock is used to reset or resynchronize controller 18 with host machine 10.

Figure 17:
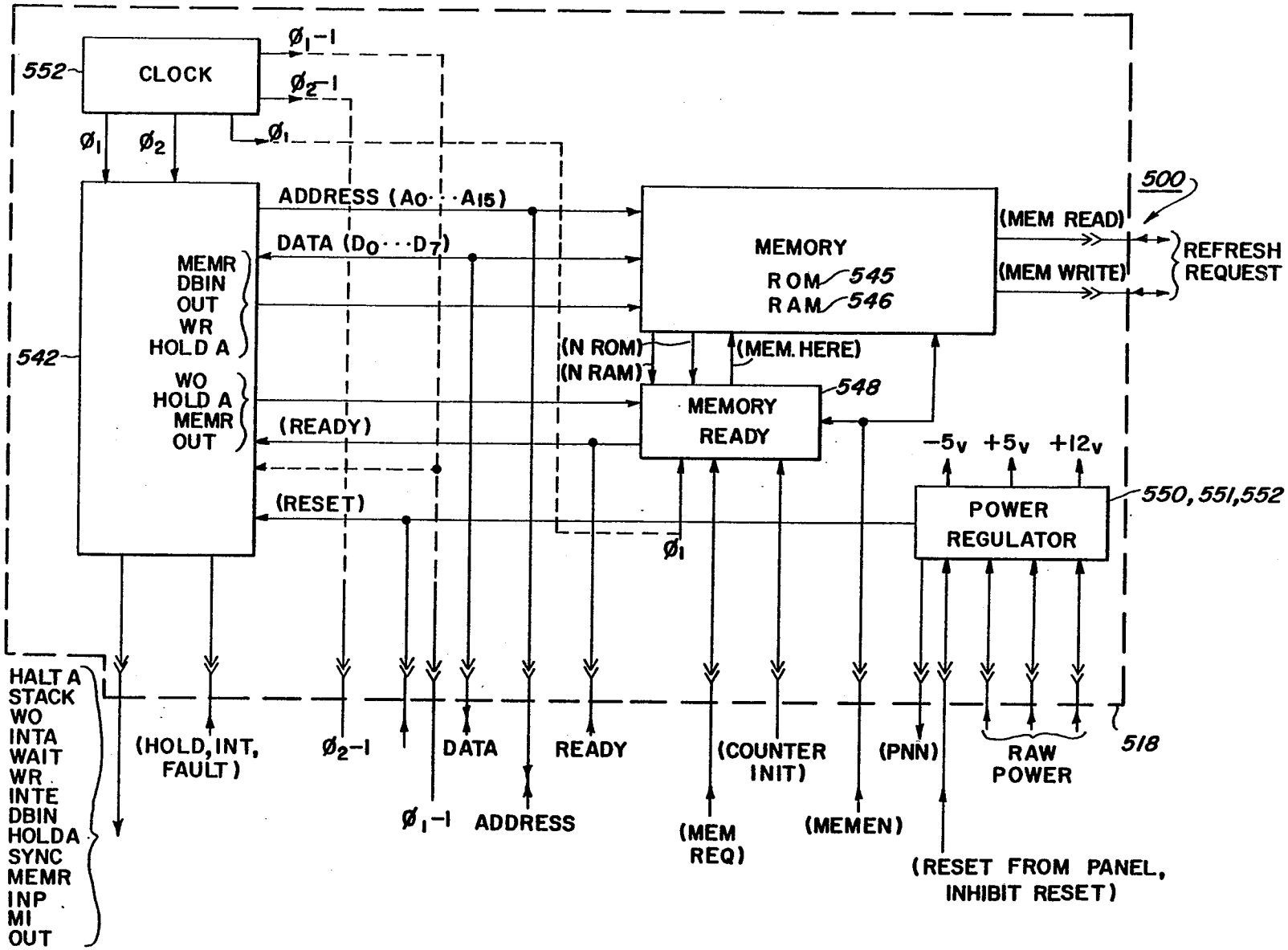
FIG. 17 is a block diagram of the controller CPU.

Referring to FIG. 15, a document handler clock 286 consisting of apertured disc 287 on the output shaft of document handler drive motor 236 and cooperating photoelectric type signal generator 288 is provided. As in the case of machine clock 202, document handler clock 286 produces an output pulse train from which components of the document handler may be synchronized. A real time clock such as clock 552 of FIG. 17, is utilized to control internal operations of the controller 18 as is known in the art.

CONTROLLER

Figure 16:
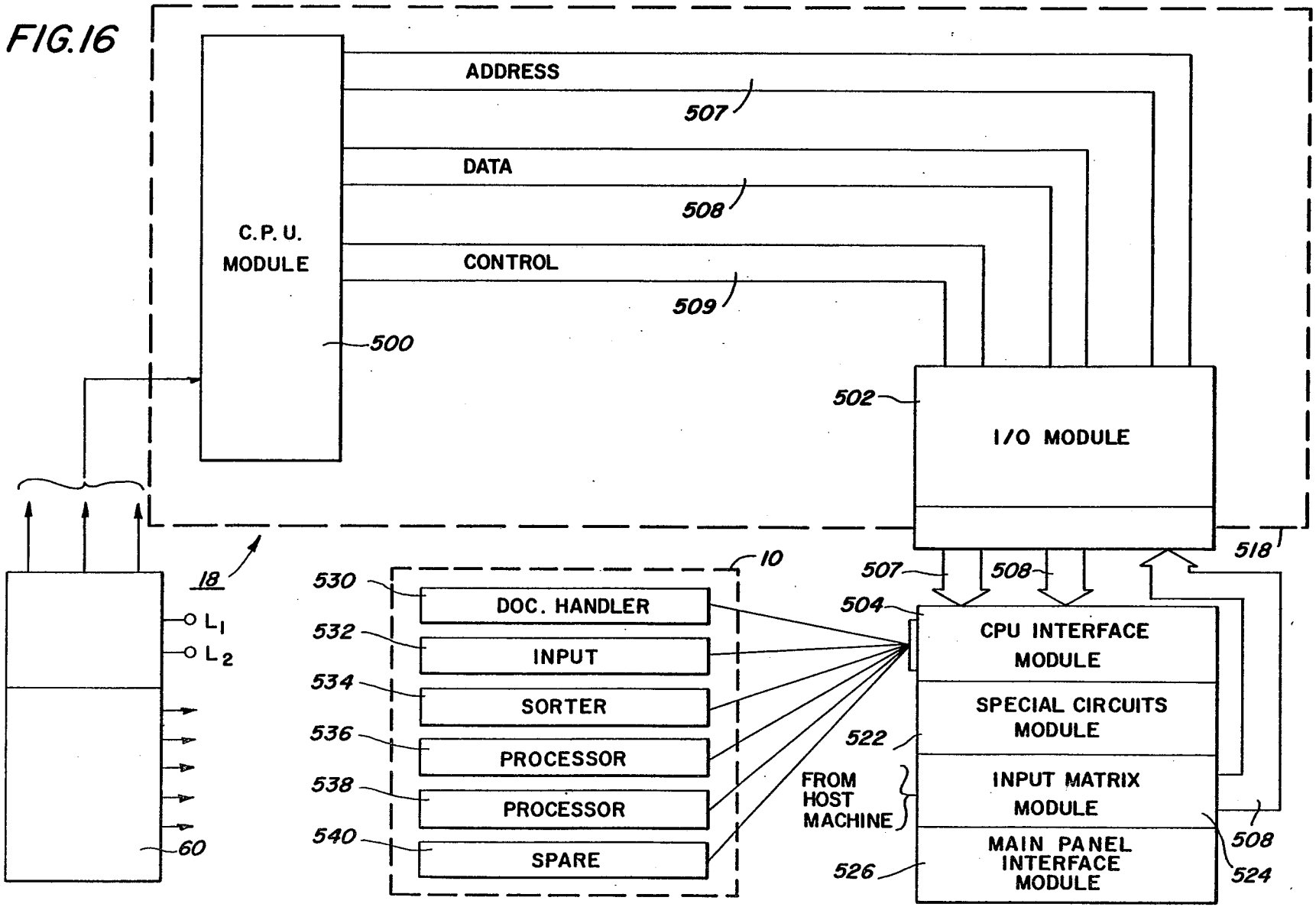
FIG. 16 is a block diagram of the controller for the apparatus shown in FIG. 1.

Referring to FIG. 16, controller 18 includes a Central Processor Unit (CPU) Module 500, Input/Output (I/O) Module 502, and Interface 504. Address, Data and Control Buses 507, 508, 509 respectively operatively couple CPU Module 500 and I/O Module 502. CPU Module 500 I/O Module 502 are disposed within a shield 518 to prevent noise interference.

Interface 504 couples I/O Module 502 with special circuits module 522, input matrix module 524, and main panel interface module 526. Module 504 also couples I/O Module 502 to operating sections of the machine, namely, document handler section 530, input section 532, sorter section 534 and processor sections 536, 538. A spare section 540, which may be used for monitoring operation of the host machine, or which may be later utilized to control other devices, is provided.

Figure 18A:
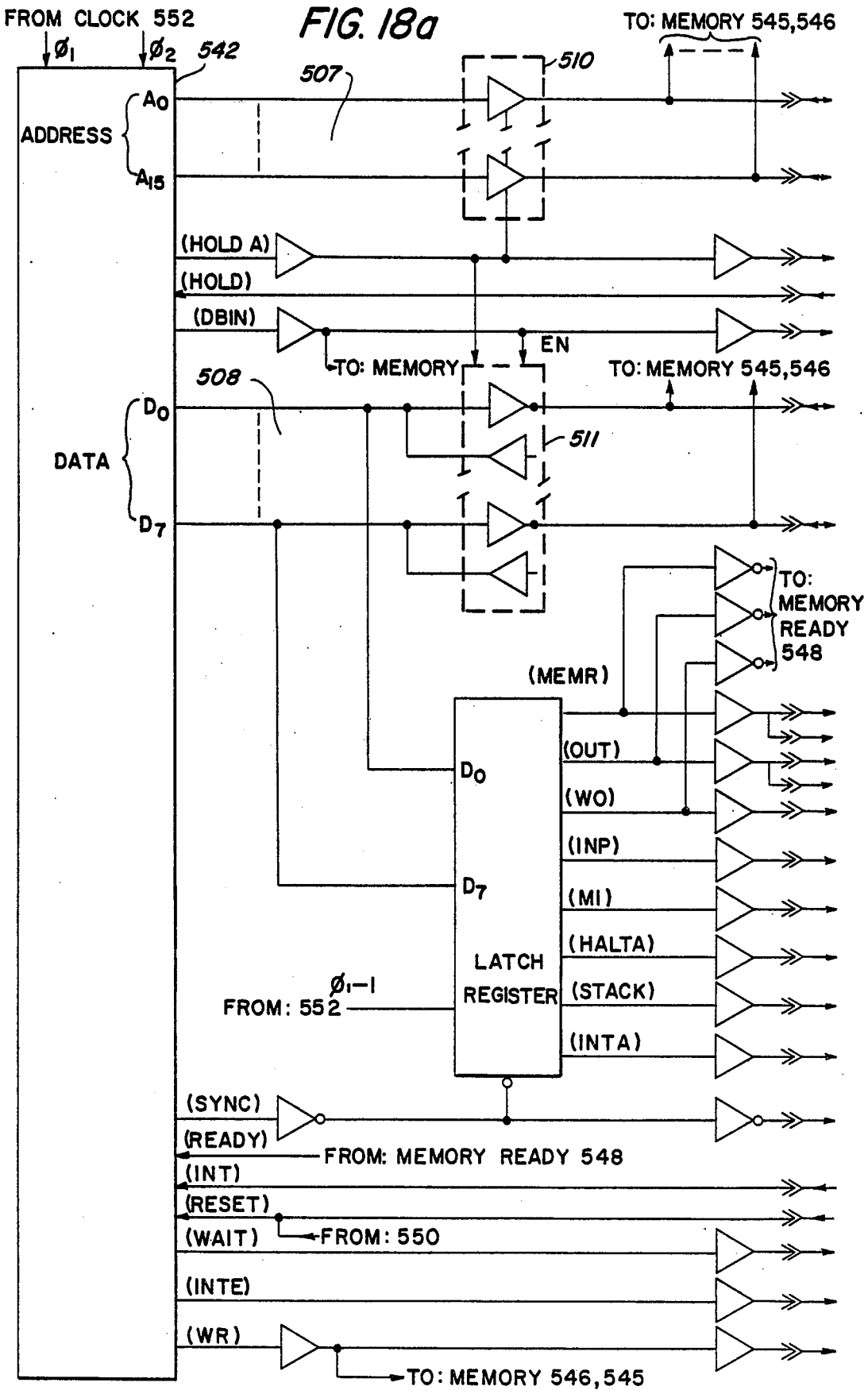
FIG. 18*a* is a block diagram showing the CPU microprocessor input/output connections.
Figure 18B:
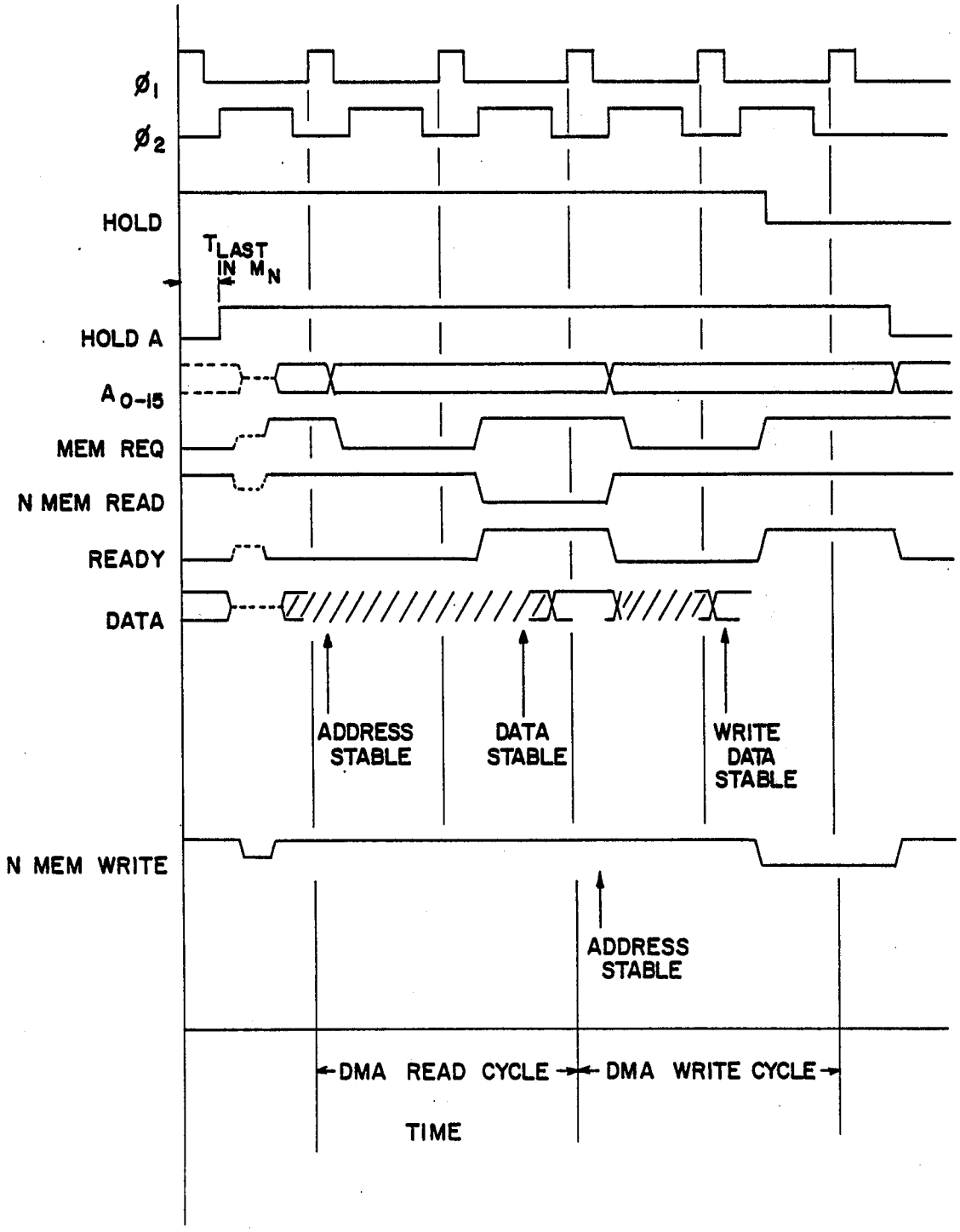
FIG. 18*b* is a timing chart of Direct Memory access (DMA) Read and Write cycles.

Referring to FIGS. 17, 18, CPU module 500 comprises a processor 542 such as an Intel 8080 microprocessor manufactured by Intel Corporation, Santa Clara, Calif., 16K Read Only Memory (herein ROM) and 2K Random Access Memory (herein RAM) sections 545, 546, Memory Ready section 548, power regulator section 550, and onboard clock 552. Bipolar tri-state buffers 510, 511 in Address and Data buses 507, 508 disable the bus on a Direct Memory access (DMA) signal (HOLDA) as will appear. While the capacity of memory sections 545, 546 are indicated throughout as being 16K and 2K respectively, other memory sizes may be readily contemplated.

Figure 19A:
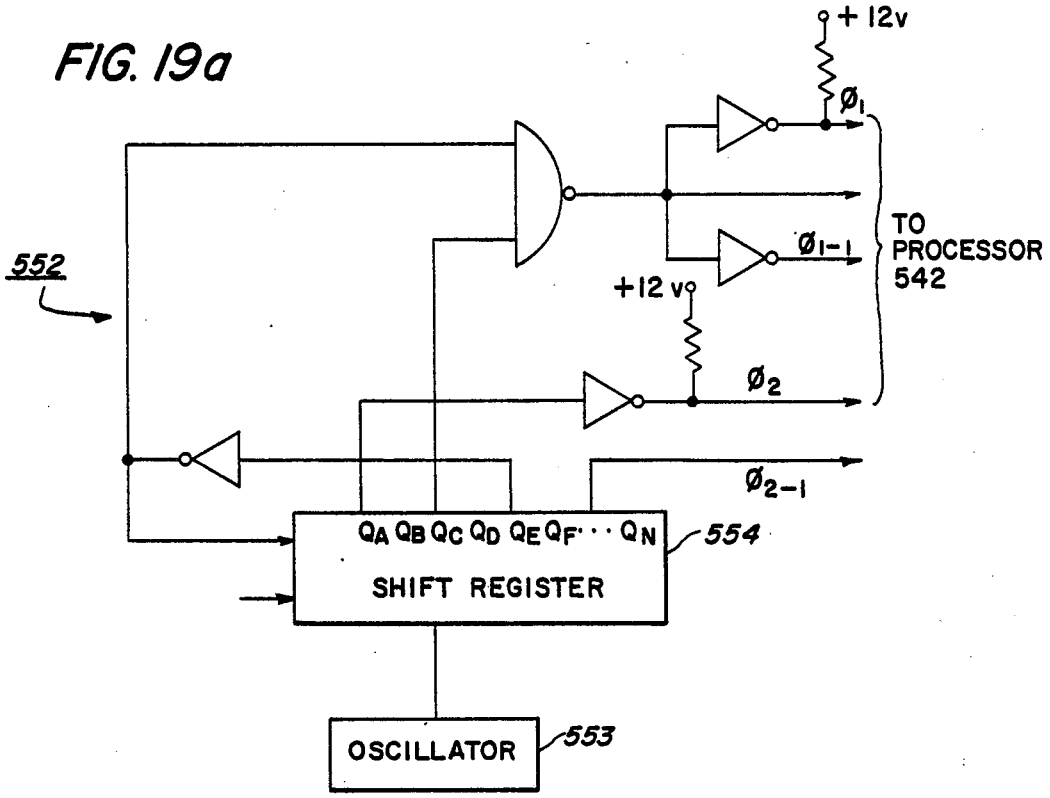
FIG. 19*a* is a logic schematic of the CPU clock.
Figure 19B:
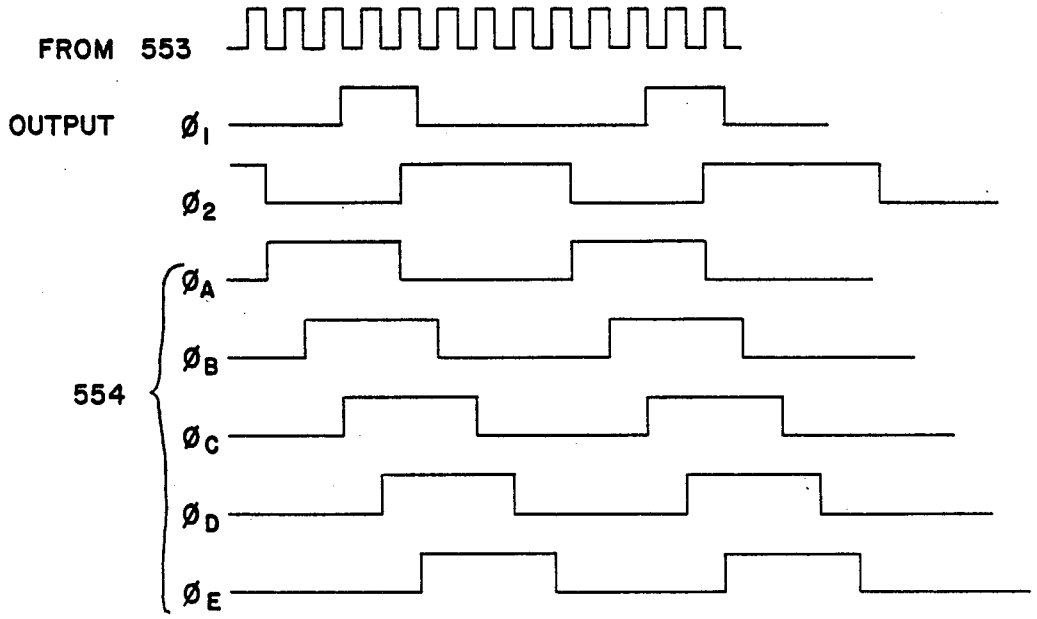
FIG. 19*b* is a chart illustrating the output wave form of the clock shown in FIG. 19*a;*

Referring particularly to FIG. 19, clock 552 comprises a suitable clock oscillator 553 feeding a multi-bite (Qa - Qn) shift register 554. Register 554 includes an internal feedback path from one bit to the serial input of register 554. Output signal waveforms $\phi_1, \phi_2, \phi_{1\text{-}1}$ and $\phi_{2\text{-}1}$ are produced for use by the system.

Figure 20:
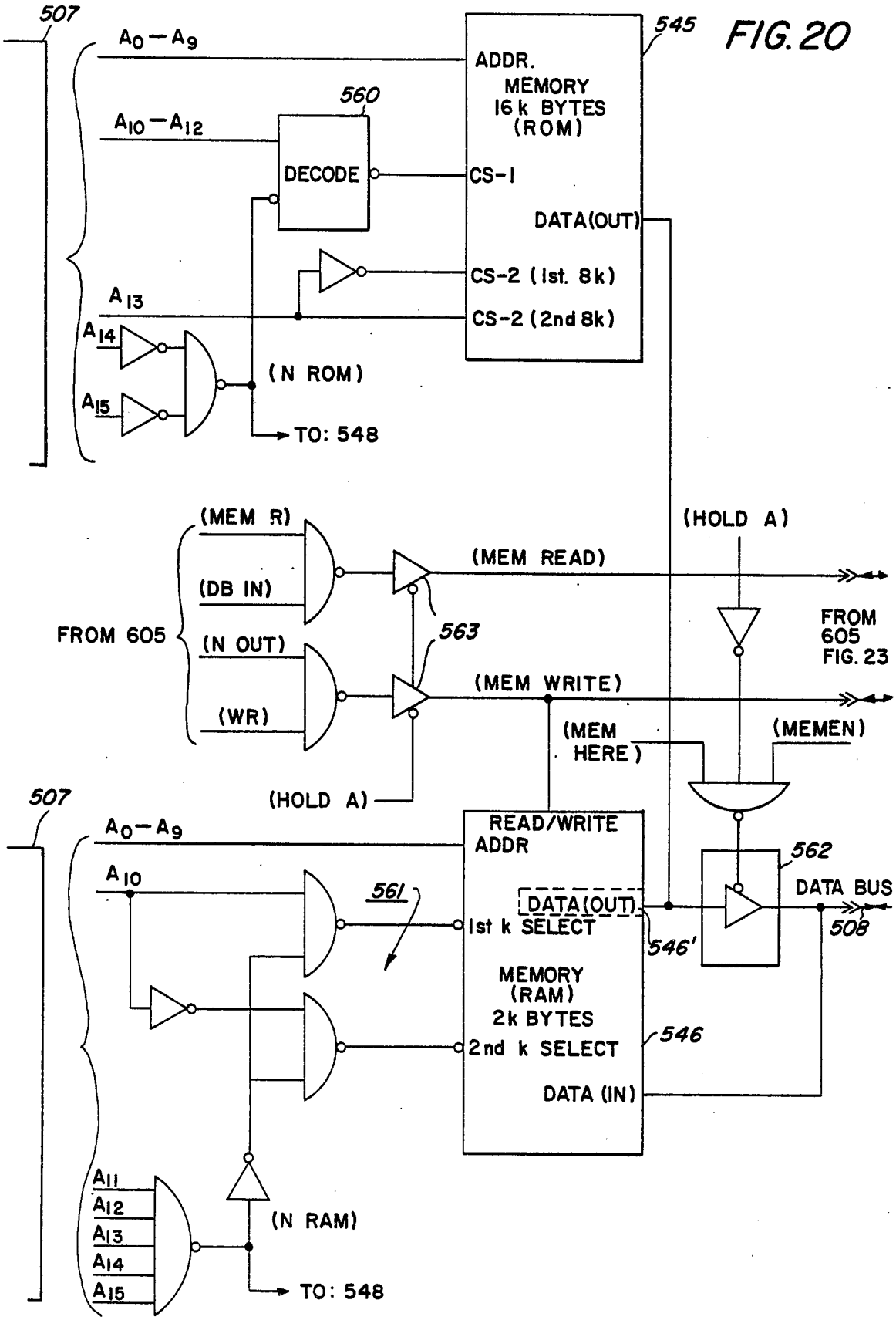
FIG. 20 is a logic schematic of the CPU memory.

Referring to FIG. 20, the memory bytes in ROM section 545 are implemented by address signals (Ao–A 15) from processor 542, selection being effected by 3 to 8 decode chip 560 controlling chip select 1 (CS-1) and a 1 bit selection (A 13) controlling chip select 2 (CS-2). The most significant address bits (A 14, A 15) select the first 16K of the total 64 bytes of the addressing space. The memory bytes in RAM section 546 are implemented by Address signals (Ao–A 15) through selector circuit 561. Address bit A 10 serves to select the memory bank while the remaining five most significant bits (A 11–A 15) select the last 2 K bytes out of the 64K bytes of addressing space. RAM memory section 546 includes a 40 bit output buffer the output of which is tied together with the output from ROM memory section 545 and goes to tri-state buffer 562 to drive Data bus 508. Buffer 562 is enabled when either memory section 545 or 546 is being addressed and either a (MEM READ) or DMA (HOLD A) memory request exists. An enabling signal (MEMEN) is provided from the machine control or service panel (not shown) which is used to permit disabling of buffer 562 during servicing of CPU Module 500. Write control comes from either processor 542 (MEM WRITE) or from DMA (HOLD A) control. Tri-state buffers 563 permit Refresh Control 605 of I/O Module 502 to access MEM READ and MEM WRITE control channels directly on a DMA signal (HOLD A) from processor 542 as will appear.

Referring to FIG. 21, memory ready section 548 provides a READY signal to processor 542. A binary counter 566, which is initialized by a SYNC signal ($\phi$,) to a prewired count as determined by input circuitry 567, counts up at a predetermined rate. At the maximum count, the output at gate 568 comes true stopping the counter 566. If the cycle is a memory request (MEM REQ) and the memory location is on board as determined by the signal (MEM HERE) to tri-state buffer 569, a READY signal is sent to processor 542. Tri-state buffer 570 in MEM REQ line permits Refresh Control 605 of I/O Module 502 to access the MEM REQ channel directly on a DMA signal (HOLD A) from processor 542 as will appear.

Figure 22A:
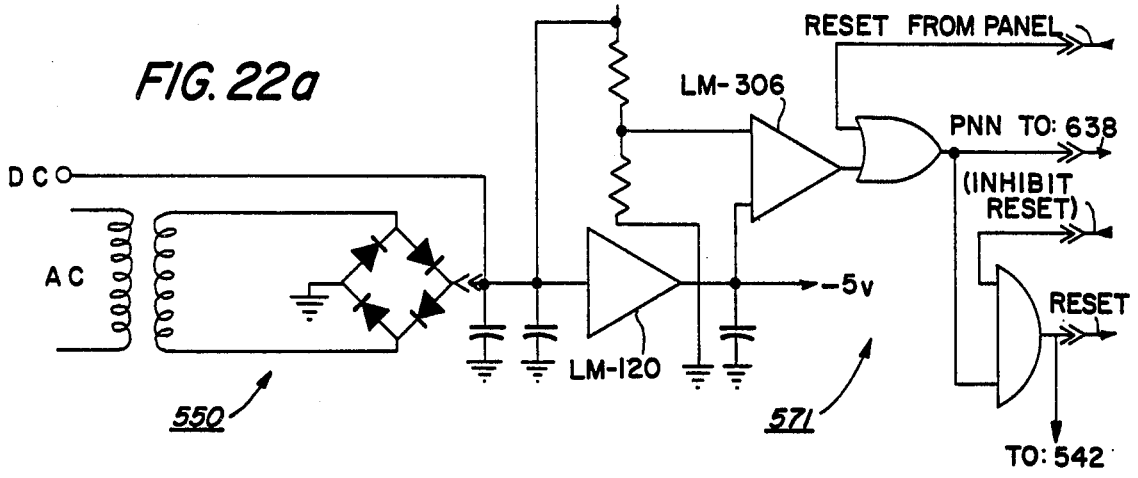
FIGS. 22*a*, 22*b*, 22*c* are logic schematics of the CPU power supply stages.
Figure 22B:
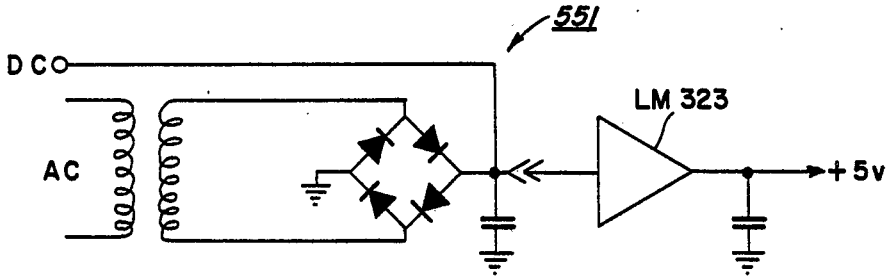
Figure 22C:
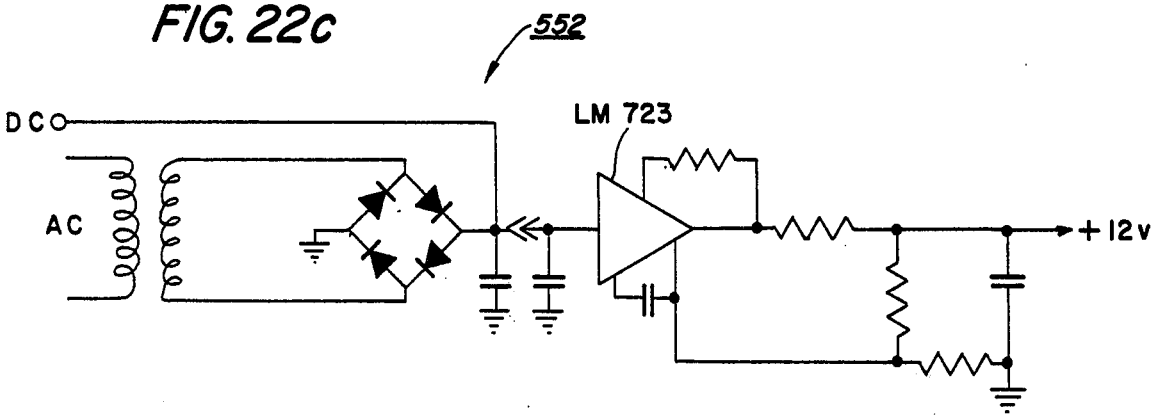

Referring to FIG. 22, power regulators 550, 551, 552 provide the various voltage levels, i.e. +5v, +12v, and −5v D.C. required by the module 500. Each of the three on board regulators 550, 551, 552 employ filtered D.C. inputs. Power Not Normal (PNN) detection circuitry 571 is provided to reset processor 542 during the power up time. Panel reset is also provided via PNN. An enabling signal (INHIBIT RESET) allows completion of a write cycle in Non Volatile (N.V.) Memory 610 of I/O Module 502.

Figure 23A:
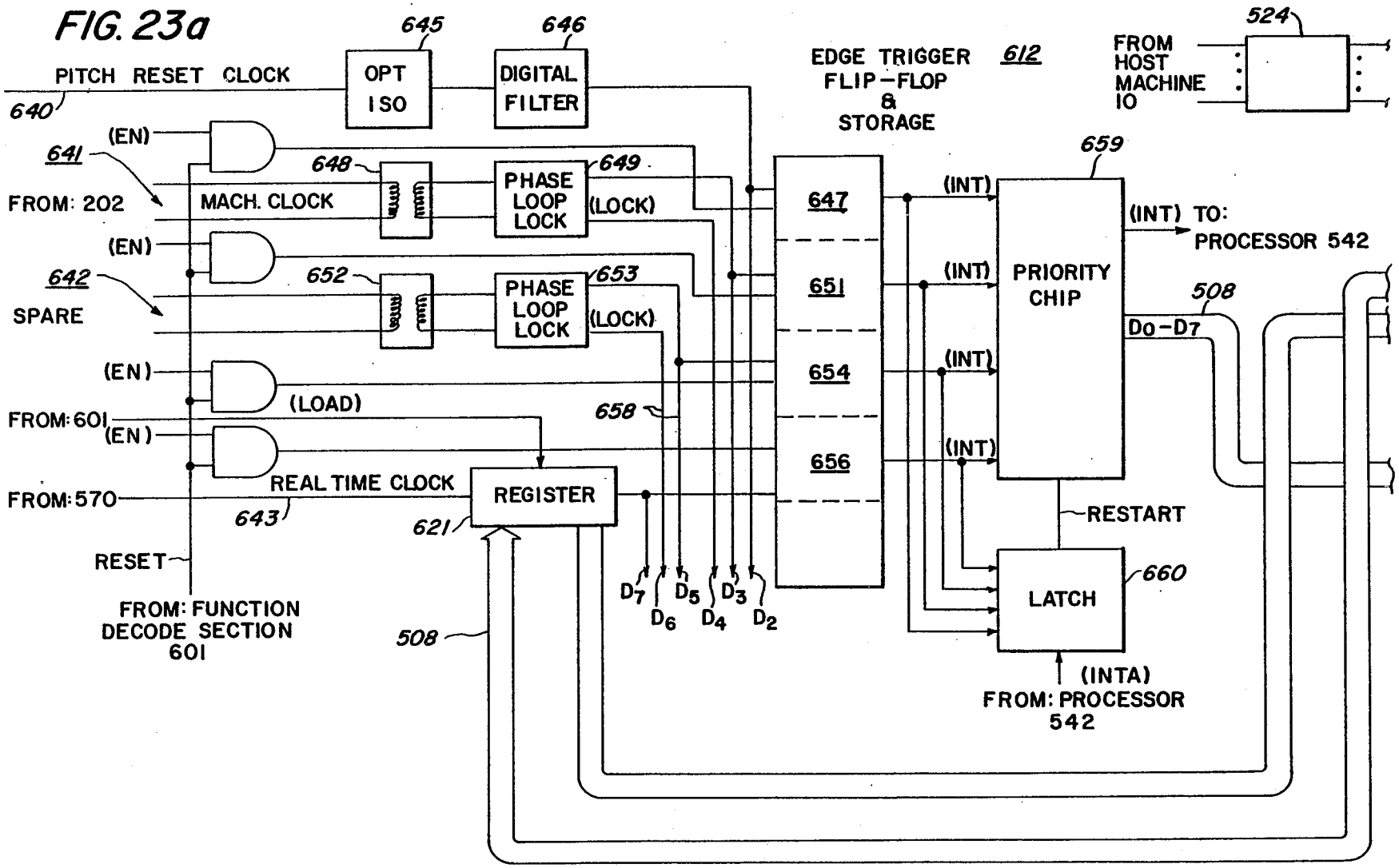
FIGS. 23*a* and 23*b* comprise a block diagram of the controller I/O module.

Referring to FIGS. 18, 20, 21, and the DMA timing chart (FIG. 18*a*) data transfer from RAM section 546 to host machine 10 is effected through Direct Memory Access (DMA), as will appear. To initiate DMA, a signal (HOLD) is generated by Refresh Control 605 (FIG. 23*a*). On acceptance, processor 542 generates a signal HOLD ACKNOWLEDGE (HOLD A) which works through tri-state buffers 510, 511 and through buffers 563 and 570 to release Address bus 507, Data bus 508 and MEM READ, MEM WRITE, and MEM REQ channels (FIGS. 20, 21) to Refresh Control 605 of I/O Module 502.

Figure 23B:
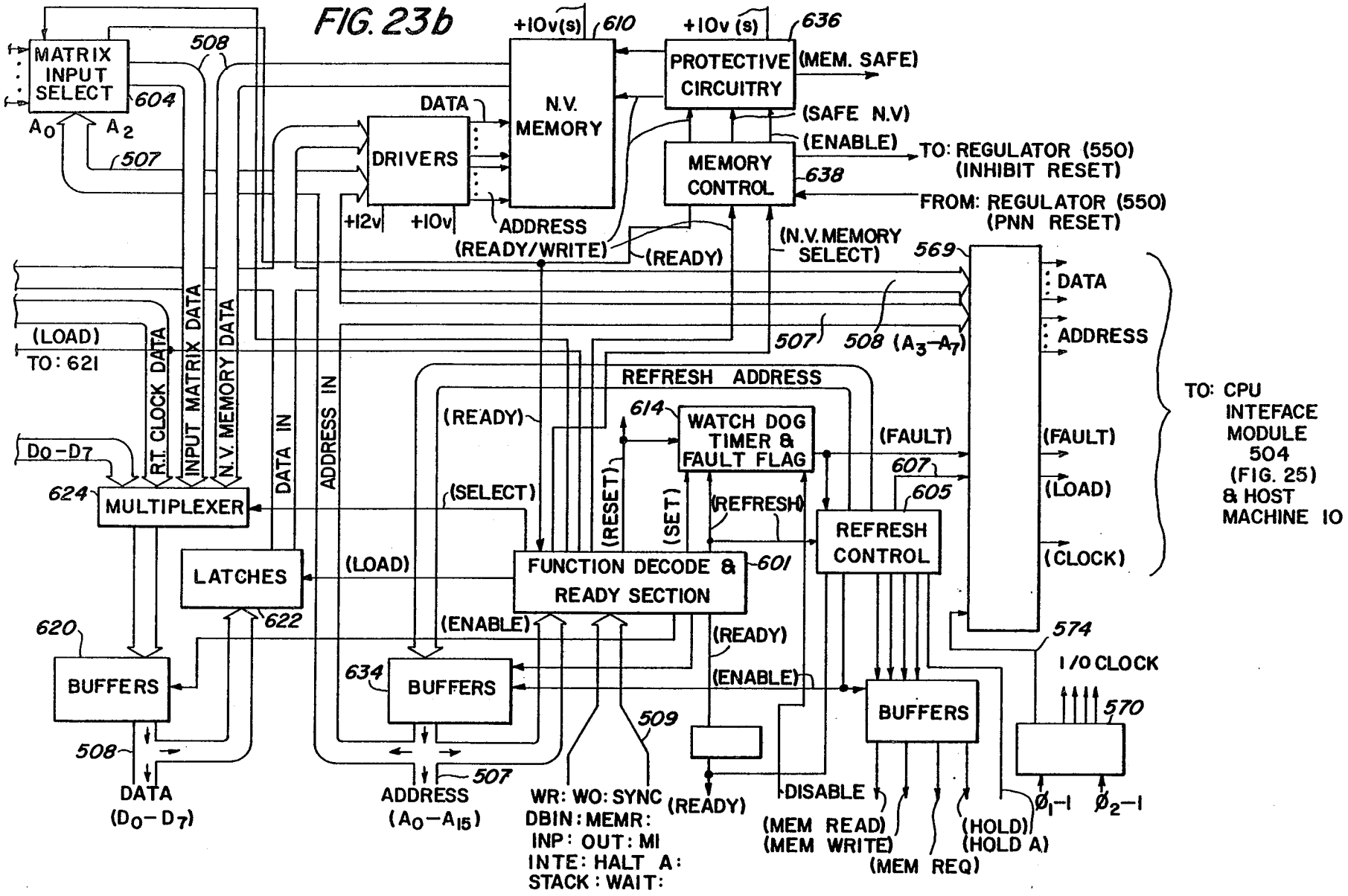

Referring to FIG. 23, I/O Module 502 interfaces with CPU module 500 through bi-directional Address, Data and Control buses 507, 508, 509. I/O Module 502 appears to CPU module 500 as a memory portion. Data transfers between CPU and I/O modules 500, 502, and commands to I/O module 502 except for output refresh are controlled by memory reference instructions executed by CPU module 500. Output refresh which is initiated by one of several uniquely decoded memory reference commands, enables Direct Memory access (DMA) by I/O module 502 to RAM section 546.

I/O module 502 includes Matrix Input select 604 (through which inputs from the host machine 10, are received), Refresh Control 605, Nonvolatile (NV) memory 610, Interrupt Control 612, Watch dog Timer and failure Flag 614 and clock 570.

A Function Decode Section 601 receives and interprets commands from CPU section 500 by decoding information on address bus 507 along with control signals from processor 542 on control bus 509. On command, decode section 601 generates control signals to perform the function indicated. These functions include (a) controlling tri-state buffers 620 to establish the direction of data flow in Data bus 508; (b) strobing data from Data bus 508 into buffer latches 622; (c) controlling multiplexer 624 to put data from Interrupt Control 612, Real Time clock register 621, Matrix Input Select 604 or N.V. memory 610 onto data bus 508; (d) actuating refresh control 605 to initiate a DMA operation; (e) actuating buffers 634 to enable address bits Ao–A 7 to be sent to the host machine 10 for input matrix read operations; (f) commanding operation of Matrix Input Select 604; (g) initiating read or write operation of N.V. memory 610 through Memory Control 638; (h) loading Real Time clock register 621 from data bus 508; and (i) resetting the Watch Dog timer or setting the Fault Failure flag 614. In addition, section 601 includes logic to control and synchronize the READY control line to CPU module 500, the READY line being used to advise module 500 when data placed on the Data bus by I/O module 502 is valid.

Watch dog timer and failure flag 614, which serves to detect certain hardwired and software malfunctions, comprises a free running counter which under normal circumstances is periodically reset by an output refresh command (REFRESH) from Function Decode Section 601. If an output refresh command is not received within a preset time interval, (i.e. 25m sec) a fault flip flop is set and a signal (FAULT) sent to the host machine 10. The signal (FAULT) also raises the HOLD line to disable CPU Module 500. Clearing of the fault flip flop may be by cycling power or generating a signal (RESET). A selector (not shown) may be provided to disable (DISABLE) the watch dog timer when desired. The fault flip flop may also be set by a command from the CPU Module to indicate that the operating program detected a fault.

Matrix Input select 604 has capacity to read up to 32 groups of 8 discrete inputs from host machine 10. Lines $A_3$ through $A_7$ of Address bus 507 are routed to host machine 10 via CPU Interface Module 504 to select the desired group of 8 inputs. The selected inputs from machine 10 are received via Input Matrix Module 524 (FIG. 28) and are placed by matrix 604 onto data bus 508 and sent to CPU Module 500 via multiplexer 624. Bit selection is effected by lines $A_0$ through $A_2$ of Address bus 507.

Output refresh control 605, when initiated, transfers either 16 or 32 sequential words from RAM memory output buffer 546' to host machine 10 at the predetermined clock rate in line 574. Direct Memory access (DMA) is used to facilitate transfer of the data at a relatively high rate. On a Refresh signal from Function Decode Section 601, Refresh Control 605 generates a HOLD signal to processor 542. On acknowledgement (HOLD A) processor 542 enters a hold condition. In this mode, CPU Module 500 releases address and data buses 507, 508 to the high impedance state giving I/O module 502 control thereover. I/O module 502 then sequentially accesses the 32 memory words from output buffer 546' (REFRESH ADDRESS) and transfers the contents to the host machine 10. CPU Module 500 is dormant during this period.

A control signal (LOAD) in line 607 along with the predetermined clock rate determined by the clock signal (CLOCK) in line 574 is utilized to generate eight 32 bit serial words which are transmitted serially via CPU Interface Module 504 to the host machine remote locations where serial to parallel transformation is performed. Alternatively, the data may be stored in addressable latches and distributed in parallel directly to the required destinations.

N.V. memory 610 comprises a predetermined number of bits of non-volatile memory stored in I/O module 502 under Memory Control 638. N.V. memory 610 appears to CPU module 500 as part of the CPU module memory complement and therefore may be accessed by the standard CPU memory reference instruction set. Referring particularly to FIG. 24, to sustain the contents of N.V. memory 610 should system power be interrupted, one or more rechargeable batteries 635 are provided exterior to I/O module 502. CMOS protective circuitry 636 couples batteries 635 to memory 610 to preserve memory 610 on a failure of the system power. A logic signal (INHIBIT RESET) prevents the CPU Module 500 from being reset during the N.V. memory write cycle interval so that any write operation in progress will be completed before the system is shut down.

For tasks that require frequent servicing, high speed response to external events, or synchronization with the operation of host machine 10, a multiple interrupt system is provided. These comprise machine based interrupts, herein referred to as Pitch Reset interrupt and the Machine interrupt, as well as a third clock driven interrupt, the Real Time interrupt.

Referring particularly to FIGS. 23(*a*) and 34, the highest priority interrupt signal, Pitch reset signal 640, is generated by the signal output of pitch reset clock 138. The clock signal is fed via optical isolator 645 and digital filter 646 to edge trigger flip flop 647.

The second highest priority interrupt signal, machine clock signal 641, is sent directly from machine clock 202 through isolation transformer 648 to a phase locked loop 649. Loop 649, which serves as bandpath filter and signal conditioner, sends a square wave signal to edge trigger flip flop 651. The second signal output (LOCK) serves to indicate whether loop 649 is locked onto a valid signal input or not.

The lowest priority interrupt signal, Real Time Clock signal 643, is generated by register 621. Register 621 which is loaded and stored by memory reference instructions from CPU module 500 is decremented by a clock signal in line 643 which may be derived from I/O Module clock 570. On the register count reaching zero, register 621 sends an interrupt signal to edge trigger flip flop 656. A spare interrupt 642 is also provided.

Setting of one or more of the edge trigger flip flops 647, 651, 654, 656 by the interrupt signals 640, 641, 642, 643 generates a signal (INT) via priority chip 659 to processor 542 of CPU Module 500. On acknowledgement, processor 542, issues a signal (INTA) transferring the status of the edge trigger flip flops 647, 651, 654, 656 to a four bit latch 660 to generate an interrupt instruction code (RESTART) onto the data bus 508.

Each interrupt is assigned a unique RESTART instruction code. Should an interrupt of higher priority be triggered, a new interrupt signal (INT) and RESTART instruction code are generated resulting in a nesting of interrupt software routines whenever the interrupt recognition circuitry is enabled within the CPU 500.

Priority chip 659 serves to establish a handling priority in the event of simultaneous interrupt signals in accordance with the priority schedule described.

Once triggered, the edge trigger flip flop 647, 651, 654 or 656 must be reset in order to capture the next occurrence of the interrupt associated therewith. Each interrupt subroutine serves, in addition to performing the functions programmed, to reset the flip flops (through the writing of a coded byte in a uniquely selected address) and to re-enable the interrupt (through execution of a re-enabling instruction). Until re-enabled, initiation of a second interrupt is precluded while the first interrupt is in progress.

Lines 658 permit interrupt status to be interrogated by CPU module 500 on a memory reference instruction.

I/O Module 502 includes a suitable pulse generator or clock 570 for generating the various timing signals required by module 502. Clock 570 is driven by the pulse-like output $\phi_{1-1}$,$\phi_{2-1}$ of processor clock 552 (FIG. 19*a*). As described, clock 570 provides a reference clock pulse (in line 574) for synchronizing the output refresh data and is the source of clock pulses (in line 643) for driving Real Time register 621.

Figure 25:
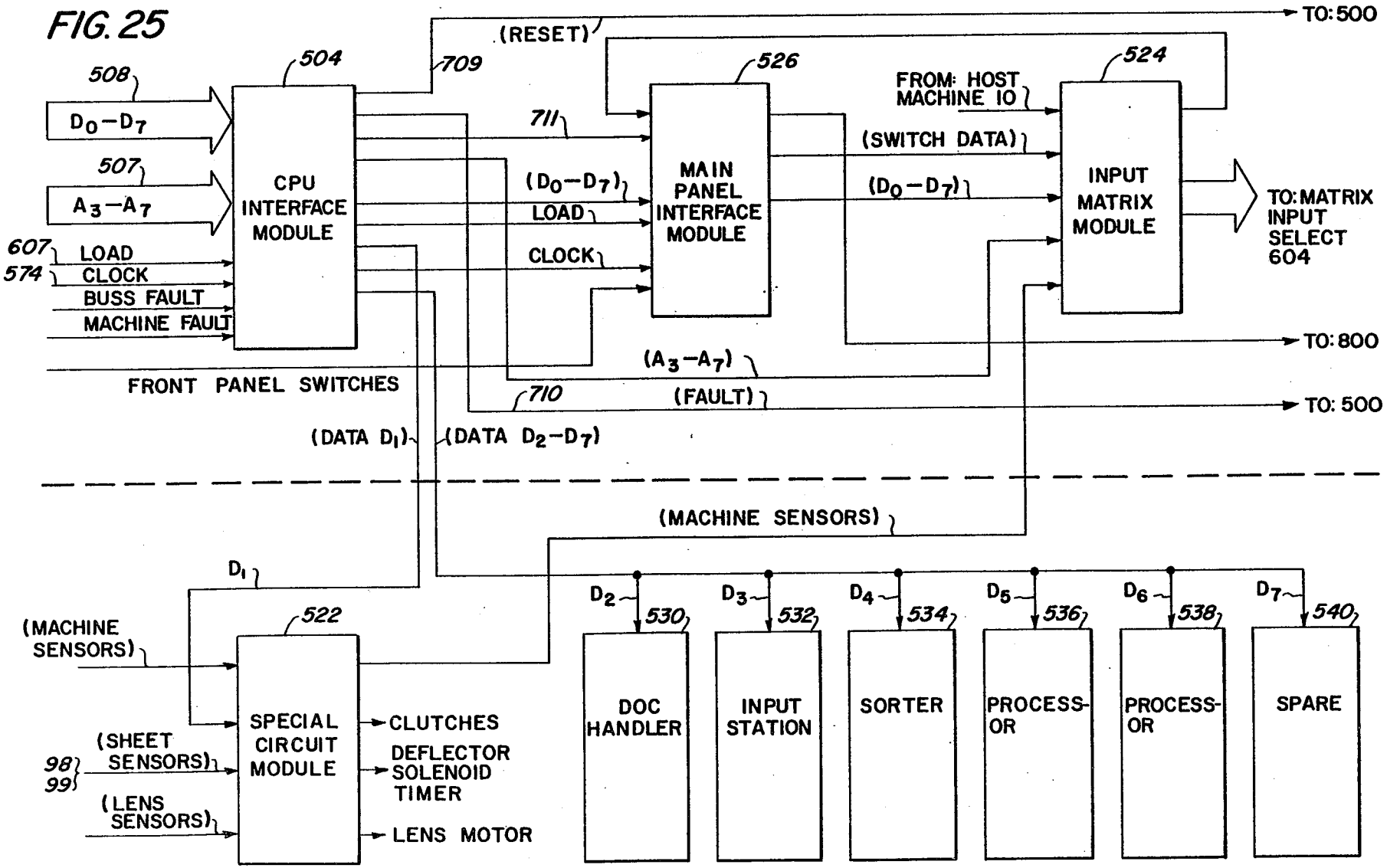
FIG. 25 is a block diagram of the apparatus interface and remote output connections.
Figure 26:
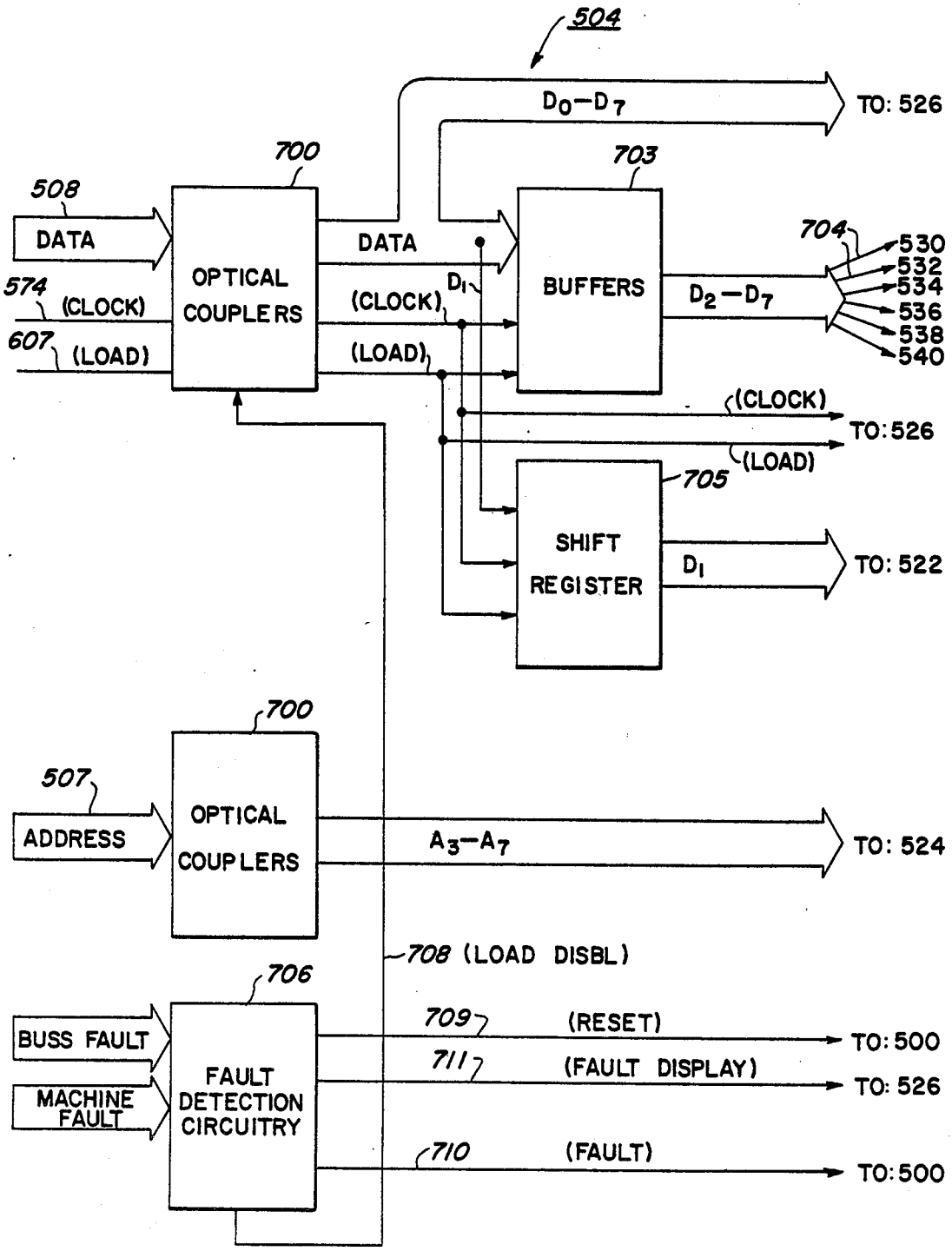
FIG. 26 is a block diagram of the CPU interface module.

CPU interface module 504 interfaces I/O module 502 with the host machine 10 and transmits operating data stored in RAM section 546 to the machine. referring particularly to FIGS. 25 and 26, data and address information are inputted to module 504 through suitable means such as optical type couplers 700 which convert the information to single ended logic levels. Data in bus 508 on a signal from Refresh Control 605 in line 607 (LOAD), is clocked into module 546 at the referenced clock rate in line 574 parallel by bit, serial by byte for a preset byte length, with each data bit of each successive byte being clocked into a separate data channel D0–D7. As best seen in FIG. 25, each data channel D0–D7 has an assigned output function with data channel D0 being used for operating the front panel lamps 830 in the digital display, (see FIG. 32), data channel D1 for special circuits module 522, and remaining data channels D2–D7 allocated to the host machine operating sections 530, 532, 534, 536, 538 and 540. Portions of data channels D1–D7 have bits reserved for front panel lamps and digital display.

Since the bit capacity of the data channels D2–D7 is limited, a bit buffer 703 is preferably provided to catch any bit overflow in data channels D2–D7.

Inasmuch as the machine output sections 530, 532, 534, 536, 538 and 540 are electrically a long distance away, i.e. remote, from CPU interface module 504, and the environment is electrically "noisy", the data stream in channels D2–D7 is transmitted to remote sections 530, 532, 534, 536, 538 and 540 via a shielded twisted pair 704. By this arrangement, induced noise appears as a differential input to both lines and is rejected. The associated clock signal for the data is also transmitted over line 704 with the line shielded carrying the return signal currents for both data and clock signals.

Data in channel $D_1$ destined for special circuits module 522 is inputted to shift register type storage circuitry 705 for transmittal to module 522. Data is also inputted to main panel interface module 526. Address information in bus 507 is converted to single ended output by couplers 700 and transmitted to Input Matrix Module 524 to address host machine inputs.

CPU interface module 504 includes fault detector circuitry 706 for monitoring both faults occurring in host machine 10 and faults or failures along the buses, the latter normally comprising a low voltage level or failure in one of the system power lines. Machine faults may comprise a fault in CPU module 500, a belt mistrack signal from sensor 27 (see FIG. 2), opening one of the machine doors or covers as responded to by conventional cover interlock sensors (not shown), a fuser over temperature as detected by sensor 175, etc. In the event of a bus fault, a reset signal (RESET) is generated automatically in line 709 to CPU module 500 (see FIGS. 17 and 18) until the fault is removed. In the event of a machine fault, a signal is generated by the CPU in line 710 to actuate a suitable relay (not shown) controlling power to all or a portion of host machine 10. A load disabling signal (LOAD DISBL) is inputted to optical couplers 700 via line 708 in the event of a fault in CPU module 500 to terminate input of data to host machine 10. Other fault conditions are monitored by the software background program. In the event of a fault, a signal is generated in line 711 to the digital display on control console 800 (via main panel interface module 526) signifying a fault.

Figure 27:
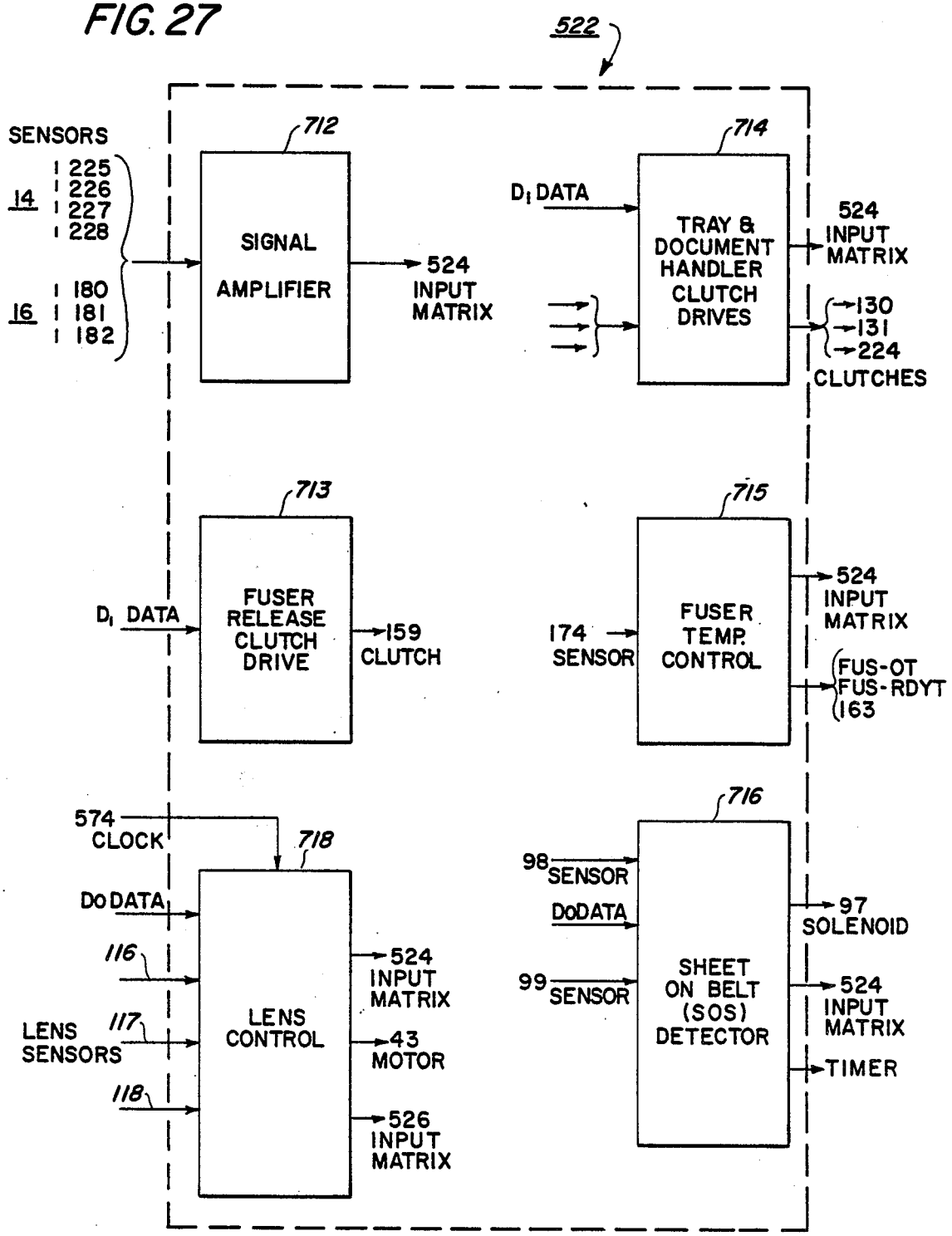
FIG. 27 is a block diagram of the apparatus special circuits module.

Referring particularly to FIGS. 25 and 27, special circuits module 522 comprises a collection of relatively independent circuits for either monitoring operation of and/or driving various elements of host machine 10. Module 522 incorporates suitable circuitry 712 for amplifying the output of sensors 225, 226, 227, 228 and 280, 281, 282 of sorter 14 and document handler 16 respectively; circuitry 713 for operating fuser release clutch 159; and circuitry 714 for operating main and auxiliary paper tray feed roll clutches 130, 131 and document handler feed clutch 244.

Additionally, fuser detection circuitry 715 monitors temperature conditions of fuser 150 as responded to by sensor 174. On overheating of fuser 150, a signal (FUS-OT) is generated to turn heater 163 off, actuate clutch 159 to separate fusing and pressure rolls 160, 161; trigger trap solenoid 158 to prevent entrance of the next copy sheet into fuser 150, and initiate a shutdown of host machine 10. Circuitry 715 also cycles fuser heater 163 to maintain fuser 150 at proper operating temperatures and signals (FUS-RDUT) host machine 10 when fuser 150 is ready for operation.

Circuitry 716 provides closed loop control over sensor 98 which responds to the presence of a copy sheet 3 on belt 20. On a signal from sensor 98, solenoid 97 is triggered to bring deflector 96 into intercepting position adjacent belt 20. At the same time, a backup timer (not shown) is actuated. If the sheet is lifted from the belt 20 by deflector 96 within the time allotted, a signal from sensor 99 disables the timer and a misstrip type jam condition of host machine 10 is declared and the machine is stopped. If the signal from sensor 99 is not received within the allotted time, a sheet on selenium (SOS) type jam is declared and an immediate machine stop is effected.

Circuitry 718 controls the position (and hence the image reduction effected) by the various optical elements that comprise main lens 41 in response to the reduction mode selected by the operator and the signal inputs from lens position responsive sensors 116, 117, 118. The signal output of circuitry 718 serves to operate lens drive motor 43 as required to place the optical elements of lens 41 in proper position to effect the image reduction programmed by the operator.

Figure 28:
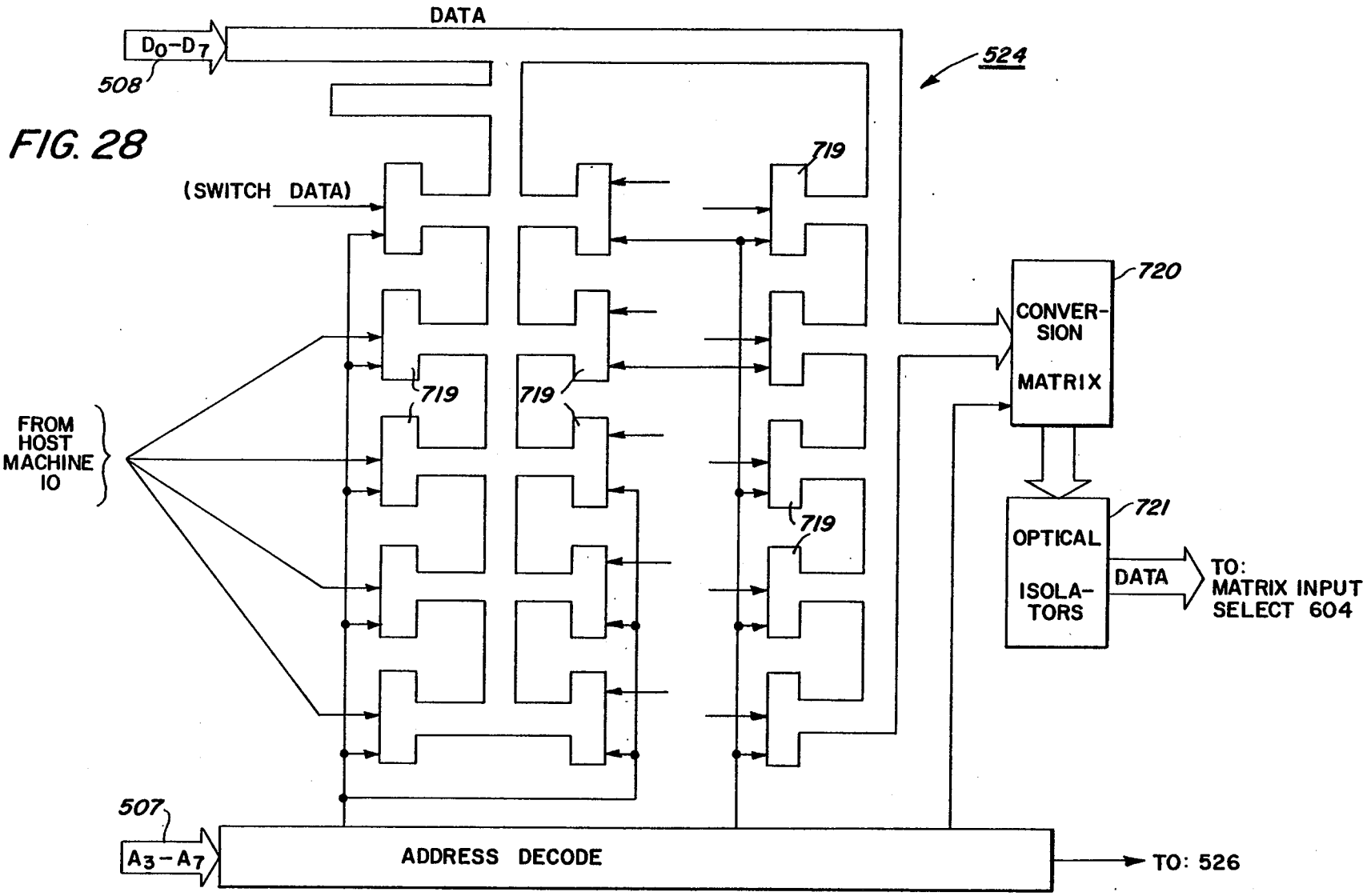
FIG. 28 is a block diagram of the main panel interface module.

Referring to FIG. 28, input matrix module 524 provides analog gates 719 for receiving data from the various host machine sensors and inputs (i.e. sheet sensors 135, 136; pressure sensor 157; etc), module 524 serving to convert the signal input to a byte oriented output for transmittal to I/O module 502 under control of Input Matrix Select 604. The byte output to module 524 is selected by address information inputted on bus 507 and decoded on module 524. Conversion matrix 720, which may comprise a diode array, converts the input logic signals of "O" to logic "1" true. Data from input matrix module 524 is transmitted via optical isolators 721 and Input Matrix Select 604 of I/O module 502 to CPU Module 500.

Figure 29:
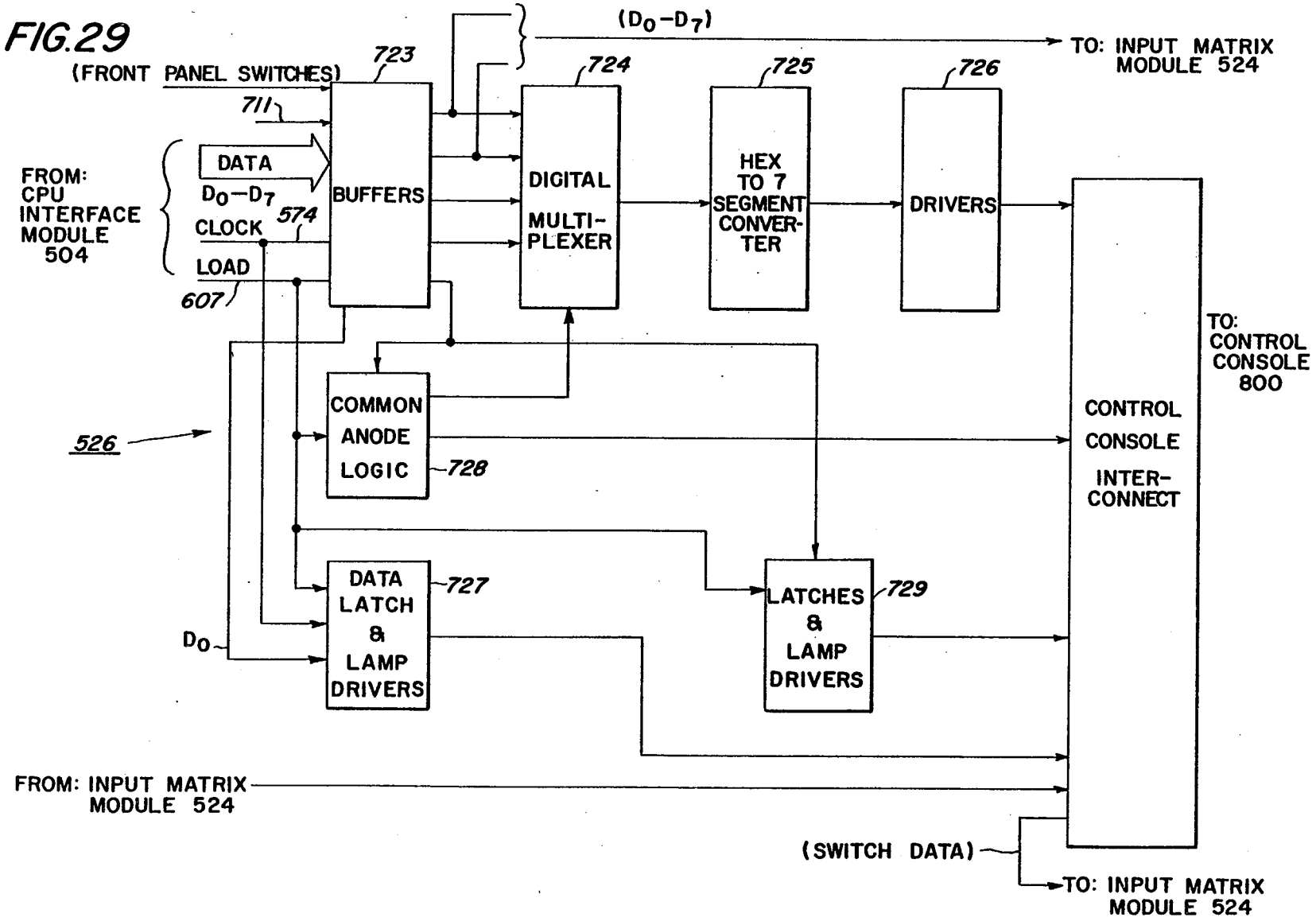
FIG. 29 is a block diagram of the input matrix module.

Referring particularly to FIG. 29, main panel interface module 526 serves as interface between CPU interface module 504 and operator control console 800 for display purposes and as interface between input matrix module 524 and the console switches. As described, data channels D0–D7 have data bits in each channel associated with the control console digital display or lamps. This data is clocked into buffer circuitry 723 and from there, for digital display, data in channels D1–D7 is inputted to multiplexer 724. Multiplexer 724 selectively multiplexes the data to HEX to 7 segment converter 725. Software controlled output drivers 726 are provided for each digit which enable the proper display digit in response to the data output of converter 725. This also provides blanking control for leading zero suppression or inter digit suppression.

Buffer circuitry 723 also enables through anode logic 728 the common digit anode drive. The signal (LOAD) to latch and lamp driver control circuit 729 regulates the length of the display cycle.

For console lamps 830, data in channel D0 is clocked to shift register 727 whose output is connected by drivers to the console lamps. Access by input matrix module 524 to the console switches and keyboard is through main panel interface module 526.

The machine output sections 530, 532, 534, 536, 538, 540 are interfaced with I/O module 502 by CPU interface module 504. At each interrupt/refresh cycle, data is outputted to sections 530, 532, 534, 536, 538, 540 at the clock signal rate in line 574 over data channels D2, D3, D4, D5, D6, D7 respectively.

Figure 30:
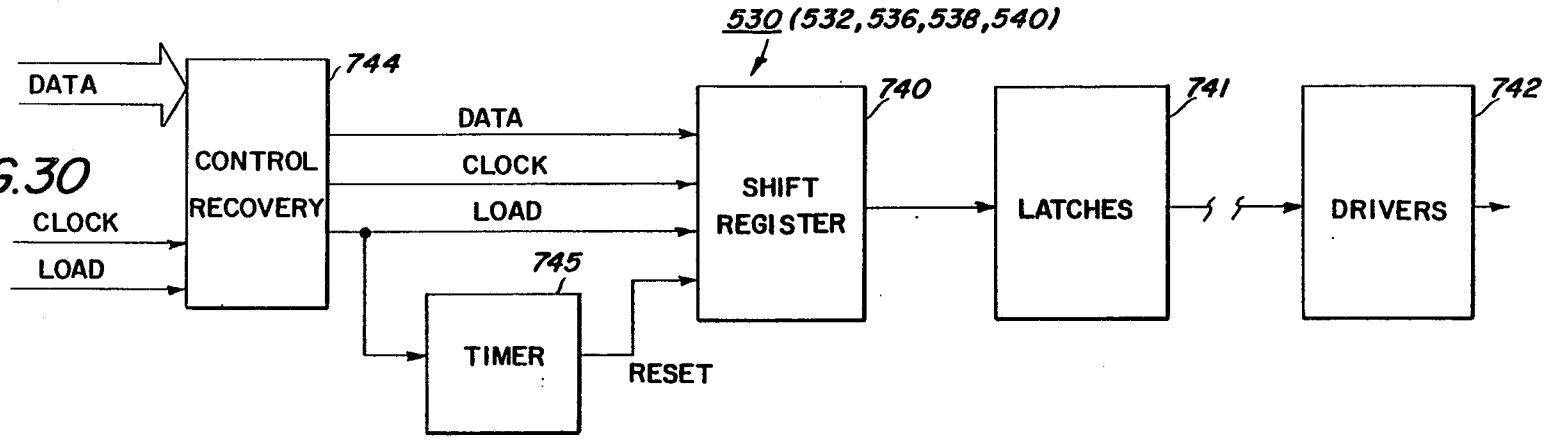
FIG. 30 is a block diagram of a typical remote.

Referring to FIG. 30, wherein a typical output section i.e. document handler section 530 is shown, data inputted to section 530 is stored in shift register/latch circuit combination 740, 741 pending output to the individual drivers 742 associated with each machine component. Preferably d.c. isolation between the output sections is maintained by the use of transformer coupled differential outputs and inputs for both data and clock signals and a shielded twisted conductor pair. Due to transformer coupling, the data must be restored to a d.c. waveform. For this purpose, control recovery circuitry 744, which may comprise an inverting/non-inverting digital comparator pair and output latch is provided.

The LOAD signal serves to lockout input of data to latches 741 while new data is being clocked into shift register 740. Removal of the LOAD signal enables commutation of the fresh data to latches 741. The LOAD signal also serves to start timer 745 which imposes a maximum time limit within which a refresh period (initiated by Refresh Control 605) must occur. If refresh does not occur within the prescribed time limit, timer 745 generates a signal (RESET) which sets shift register 740 to zero.

With the exception of sorter section 534 discussed below, output sections 532, 536, 538 and 540 are substantially identical to document handler section 530.

Figure 31:
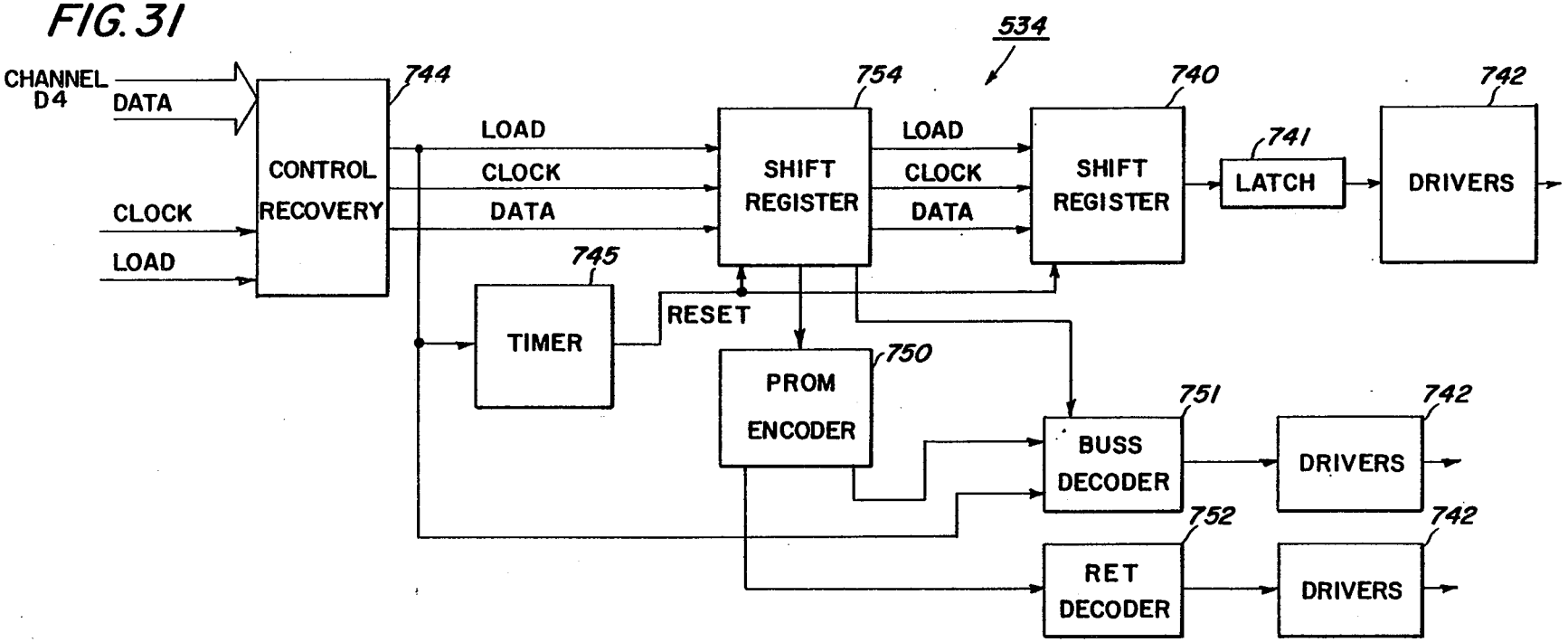
FIG. 31 is a block diagram of the sorter remote.

Referring to FIG. 31 wherein like numbers refer to like parts, to provide capacity for driving the sorter deflector solenoids 221, a decode matrix arrangement consisting of a Prom encoder 750 controlling a pair of decoders 751, 752 is provided. The output of decoders 751, 752 drive the sorter solenoids 221 of upper and lower bin arrays 210, 211 respectively. Data is inputted to encoder 750 by means of shift register 754.

Figure 32:
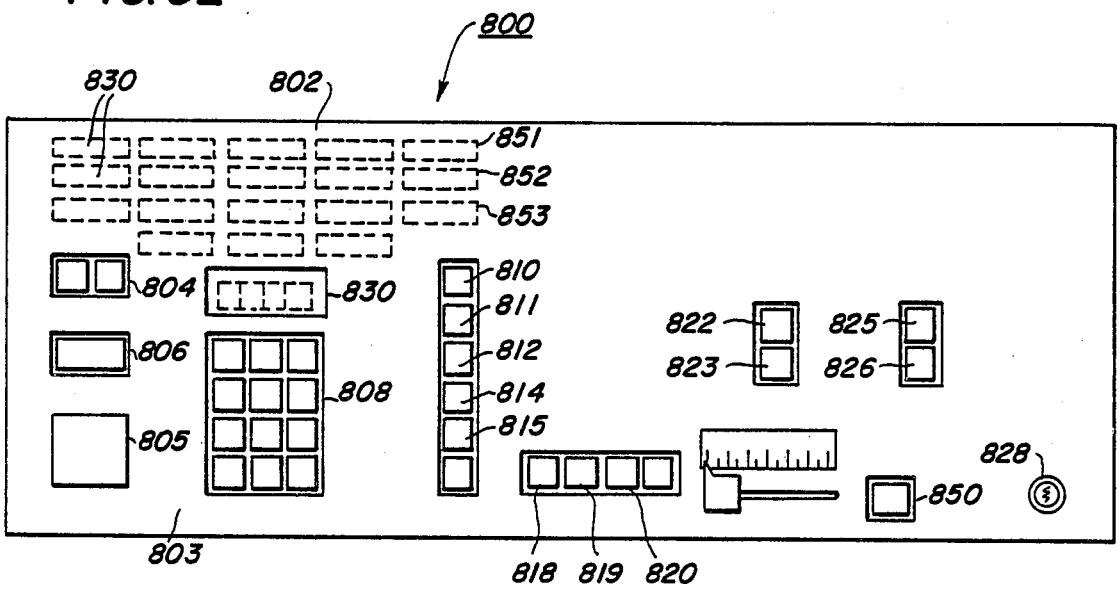
FIG. 32 is a view of the control console for inputting copy run instructions to the apparatus shown in FIG. 1.

Referring now to FIG. 32, control console 800 serves to enable the operator to program host machine 10 to perform the copy run or runs desired. At the same time, various indicators on console 800 reflect the operational condition of machine 10. Console 800 includes a bezel housing 802 suitably supported on host machine 10 at a convenient point with decorative front or face panel 803 on which the various machine programming buttons and indicators appear. Programming buttons include power on/off buttons 804, start print (PRINT) buttons 805, stop print (STOP) button 806 and keyboard copy quantity selector 808. A series of feature select buttons consisting of auxiliary paper tray button 810, two sided copy button 811, copy density selector 816, and variable density control 817 are provided.

Additionally, image size selector buttons 818, 819, 820; multiple or single document select buttons 822, 823 for operation of document handler 16; and sorter sets or stacks buttons 825, 826 are provided. An on/off service selector 828 is also provided for activation during machine servicing.

Indicators comprise program display lamps 830 and displays such as READY, WAIT, SIDE 1, SIDE 2, ADD PAPER, CHECK STATUS PANEL, PRESS FAULT CODE, QUANTITY COMPLETED, CHECK DOORS, UNLOAD AUX TRAY, CHECK DOCUMENT PATH, CHECK PAPER PATH, JOB INCOMPLETE and UNLOAD SORTER. Other display information may be envisioned.

MACHINE OPERATION

As will appear, host machine 10 is conveniently divided into a number of operational states. The machine control program is divided into background routines and Foreground routines with operational control normally residing in the Background routine or routines appropriate to the particular machine state then in effect. The output buffer 546' of RAM memory section 546 is used to transfer/refresh control data to the various remote locations in host machine 10, control data from both Background and Foreground routines being inputted to buffer 546' for subsequent transmittal to host machine 10. Transmittal/refresh of control data presently in output buffer 546' is effected through Direct Memory access (DMA) under the aegis of a Machine Clock interrupt routine.

Foreground routine control data which includes a Run Event Table built in response to the particular copy run or runs programmed, is transferred to output buffer 546' by means of a multiple prioritized interrupt system wherein the Background routine in process is temporarily interrupted with fresh Foreground routine control data is inputted to buffer 546' following which the interrupted Background routine is resumed.

The operating program for host machine 10 is divided into a collection of foreground tasks, some of which are driven by the several interrupt routines and background or non-interrupt routines. Foreground tasks are tasks that generally require frequent servicing, high speed response, or synchronization with the host machine 10. Background routines are related to the state of host machine 10, different background routines being performed with different machine states. A single background software control program (STCK) composed of specific sub-programs associated with the principal operating states of host machine 10 is provided. A byte called STATE contains a number indicative of the current operating state of host machine 10. The machine STATES are as follows:

| STATE NO. | MACHINE STATE | CONTROL SUBR. |
|---|---|---|
| 0 | Software Initialize | INIT |
| 1 | System Not Ready | NRDY |
| 2 | System Ready | RDY |
| 3 | Print | PRINT |
| 4 | System Running, Not Print | RUNNPRT |
| 5 | Service | TECHREP |

Figure 33:
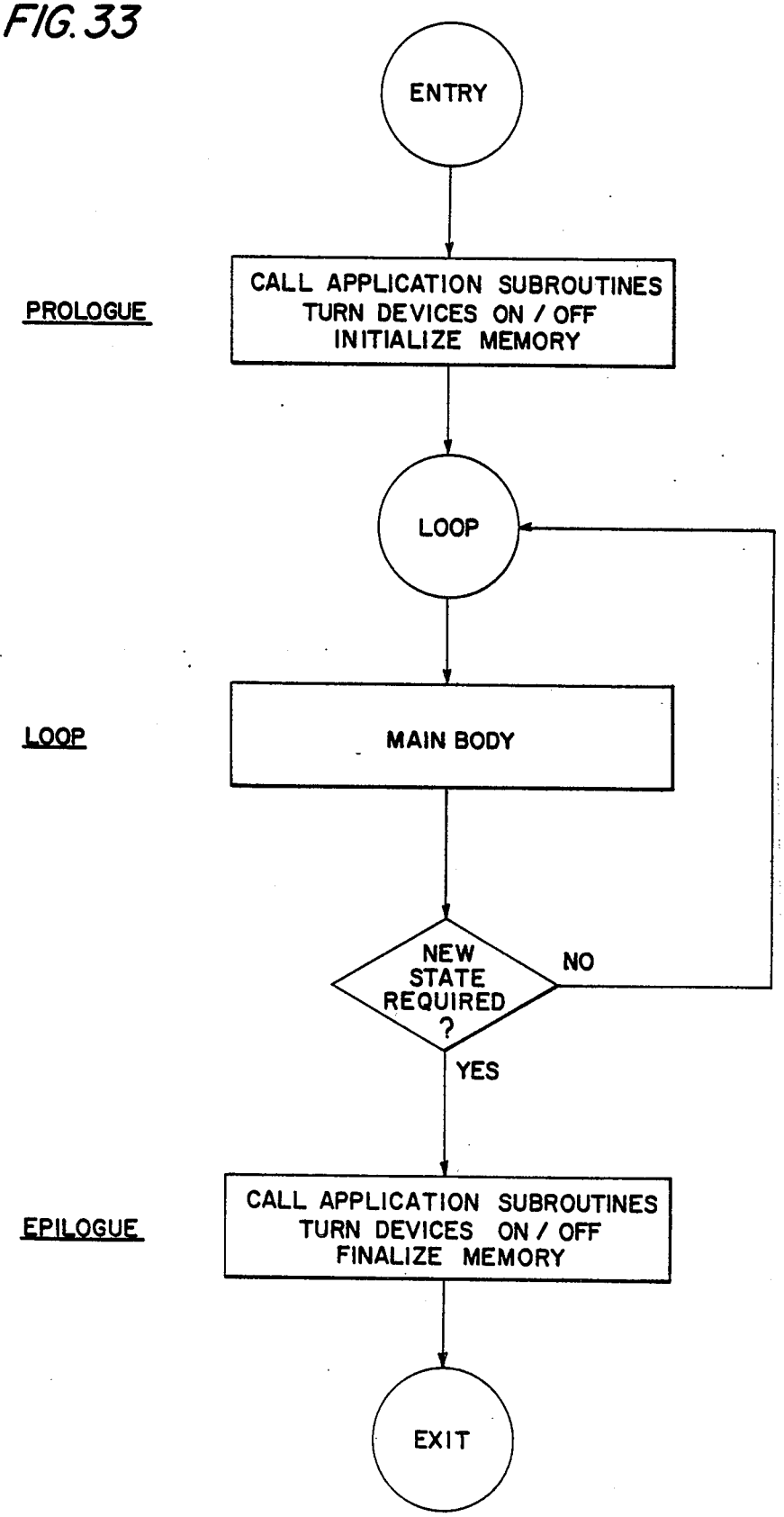
FIG. 33 is a flow chart illustrating a typical machine state.

Referring to FIG. 33, each STATE is normally divided into PROLOGUE, LOOP and EPILOGUE sections. As will be evident from the exemplary program STCK reproduced in TABLE I, entry into a given STATE (PROLOGUE) normally causes a group of operations to be performed, these consisting of operations that are performed once only at the entry into the STATE. For complex operations, a CALL is made to an applications subroutine therefor. Relatively simpler operations (i.e. turning devices on or off, clearing memory, presetting memory, etc.) are done directly.

Once the STATE PROLOGUE is completed, the main body (LOOP) is entered. The program (STCK) remains in this LOOP until a change of STATE request is received and honored. On a change of STATE request, the STATE EPILOGUE is entered wherein a group of operations are performed, following which the STATE moves into the PROLOGUE of the next STATE to be entered.

Figure 34:
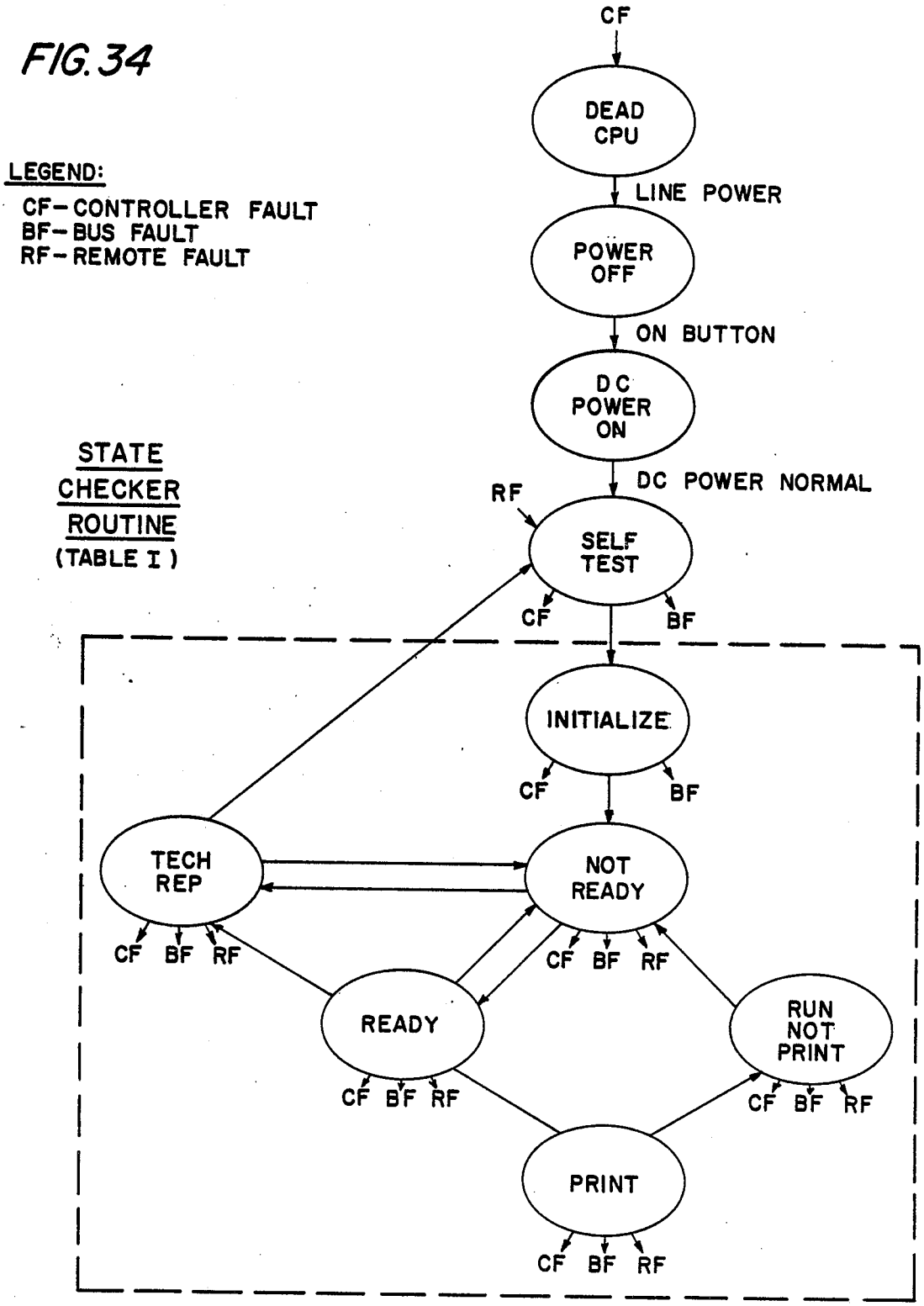
FIG. 34 is a flow chart of the machine state routine.

Referring to FIG. 34 and the exemplary program (STCK) in TABLE I. On actuation of the machine POWER-ON button 804, the software Initialize STATE (INIT) is entered. In this STATE, the controller is initialized and a software controlled self test subroutine is entered. If the self test of the controller is successfully passed, the System Not Ready STATE (NRDY) is entered. If not, a fault condition is signaled.

In the System Not Ready STATE (NRDY), background subroutines are entered. These include setting of Ready flags, control registers, timers, and the like; turning on power supplies, the fuser, etc., initializing the Fault Handler, checking for paper jams (left over from a previous run), door and cover interlocks, fuser temperatures, etc. During this period, the WAIT lamp on console 800 is lit and operation of host machine 10 precluded.

When all ready conditions have been checked and found acceptable, the controller moves to the system ready state (RDY). The READY lamp on console 800 is lit and final ready checks made. Host Machine 10 is now ready for operation upon completion of input of a copy run program, loading of one or more originals 2 into document handler 16 (if selected by the operator), and actuation of START PRINT button 805. As will appear hereinafter, the next state is PRINT wherein the particular copy run programmed is carried out.

While the machine is completing a copy run, the controller normally enters the Run Not Print state (RUNNPRT) where the controller calculates the number of copies delivered, resets various flags, stores certain machine event information in the memory, as well as generally conditioning the machine for another copy run, if desired. The controller then returns to the System Not Ready state (NRDY) to recheck for ready conditions prepatory for another copy run, with the same state sequence being repeated until the machine is turned off by actuation of POWER OFF button 804 or a malfunction inspired shutdown is triggered. The last state (TECH REP) is a machine servicing state wherein certain service routines are made available to the machine/repair personnel, i.e. Tech Reps.

Referring particularly to FIG. 32 and Tables II, III, IV, V, VI and VII, the machine operator uses control console 800 to program the machine for the copy run desired. Programming may be done during either the System Not Ready (NRDY) or System Ready (RDY) states, although the machine will not operate during the System Not ready state should START PRINT button 805 be pushed. The copy run includes selecting (using keyboard 808) the number of copies to be made, and such other ancillary program features as may be desired, i.e. use of auxiliary paper tray 102, (push button 810), image size selection (push buttons 818, 819, 820), document handler/sorter selection (push buttons 822, 823, 825, 826), copy density selection (push button 816) duplex or two sided copy button 811, etc. On completion of the copy run program, START PRINT button 805 is actuated to start the copy run programmed (presuming the READY lamp is on and an original or originals 2 have been placed in tray 233 of document handler 16 if the document handler has been selected).

With programming of the copy run instructions, controller 18 enters a Digit Input routine in which the program information is transferred to RAM section 546. The copy run program data passes via Main Panel Interface Module 526 to Input Matrix Module 524 and from there is addressed through Matrix Input Select 604, Multiplexer 624, and Buffers 620 of I/O Module 502 to RAM section 546 of CPU Module 500.

On entering PRINT STATE, a Run Event Table (FIG. 35) comprised of Foreground tasks is built for operating in cooperation with the background tasks the various components of host machine 10 in an integrated manner to produce the copies programmed. The run Event Table is formed by controller 18 through merger of a Fixed Pitch Event Table (TABLE II) (stored in ROM 545 and Non Volatile Memory 610) and a Variable Pitch Event Table (TABLE III) in a fashion appropriate to the parameters of the job selected.

The Fixed Pitch Event Table (TABLE II) is comprised of machine events whose operational timing is fixed during each pitch cycle such as the timing of bias to transfer roll 75, (TRN 2 CURR), actuating toner concentration sensor 65 (ADC ACT), loading roll 161 of fuser 150 (FUS*LOAD), and so forth, irrespective of the particular copy run programmed. The Variable Pitch Table (TABLE III) is comprised of machine events whose operational timing varies with the individual copy run programmed, i.e. timing of pitch fade-out lamp 44 (FO*ONBSE) and timing of flash illuminations lamps 37 (FLSH BSE). The variable Pitch Table is built by the Pitch Table Builder (Table IV) from the copy run information programmed in by controller 18 (using the machine control program stored in ROM section 545 and Non-Volatile Memory 610), coupled with event address information from ROM section 545, sorted by absolute clock count (via the routine shown in TABLE V), and stored in RAM section 546 (via the routine shown in TABLE VI). The Fixed Pitch Event Table and Variable Pitch Table are merged with the relative clock count differences between Pitch events calculated to form a Run Event Table (TABLE VII).

Figure 35:
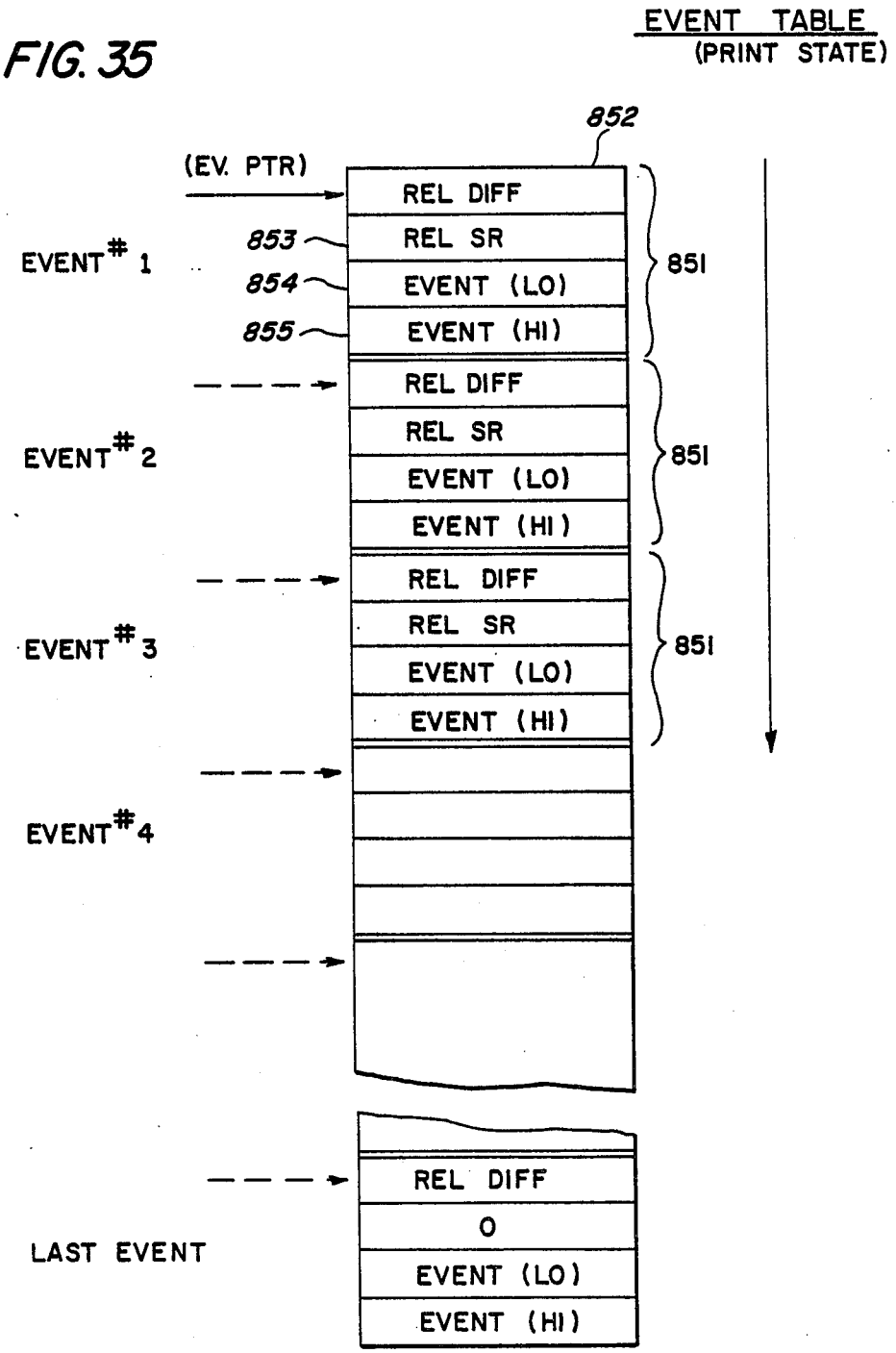
FIG. 35 is a view showing the event table layout.
Figure 36:
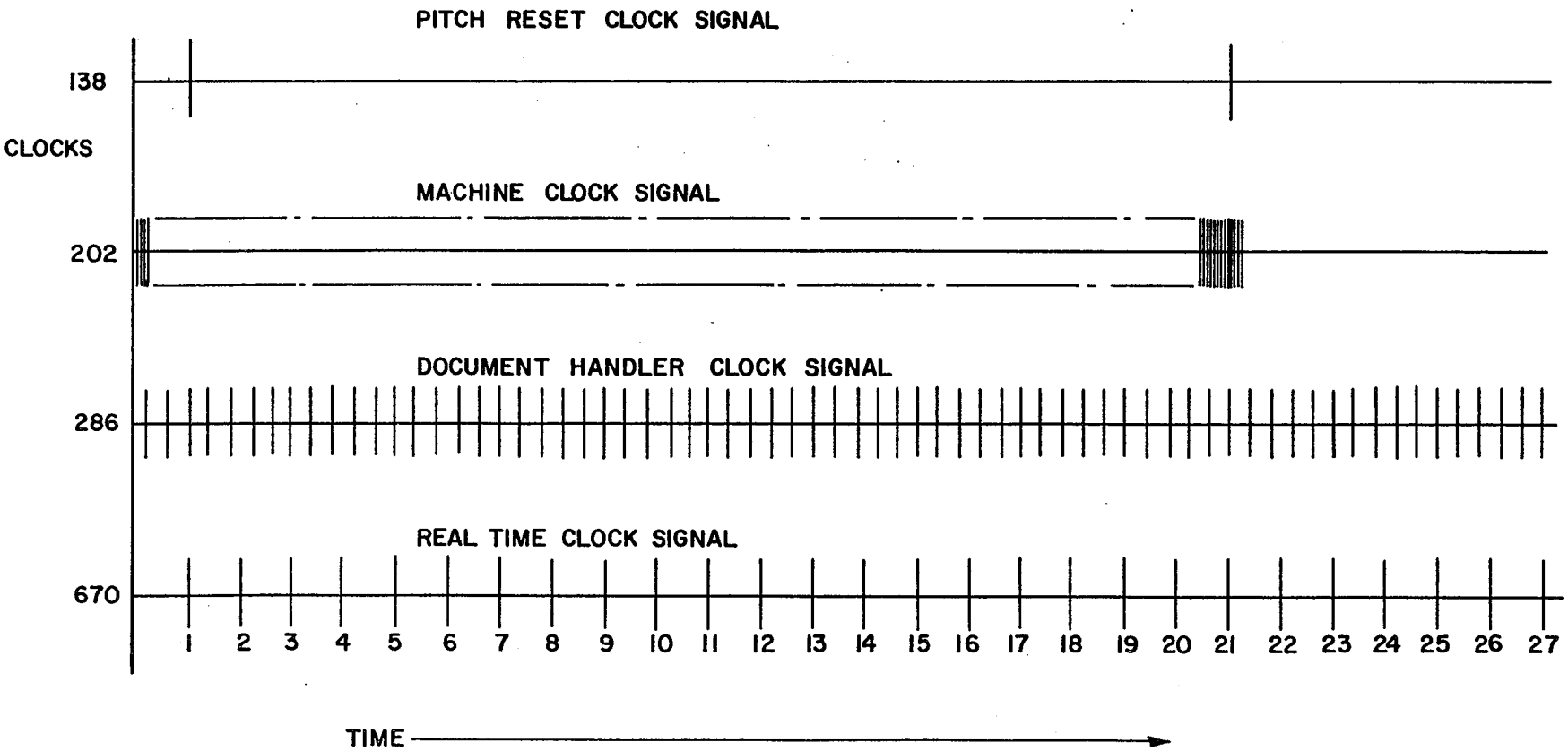
FIG. 36 is a chart illustrating the relative timing sequences of the clock interrupt pulses.
Figure 37:
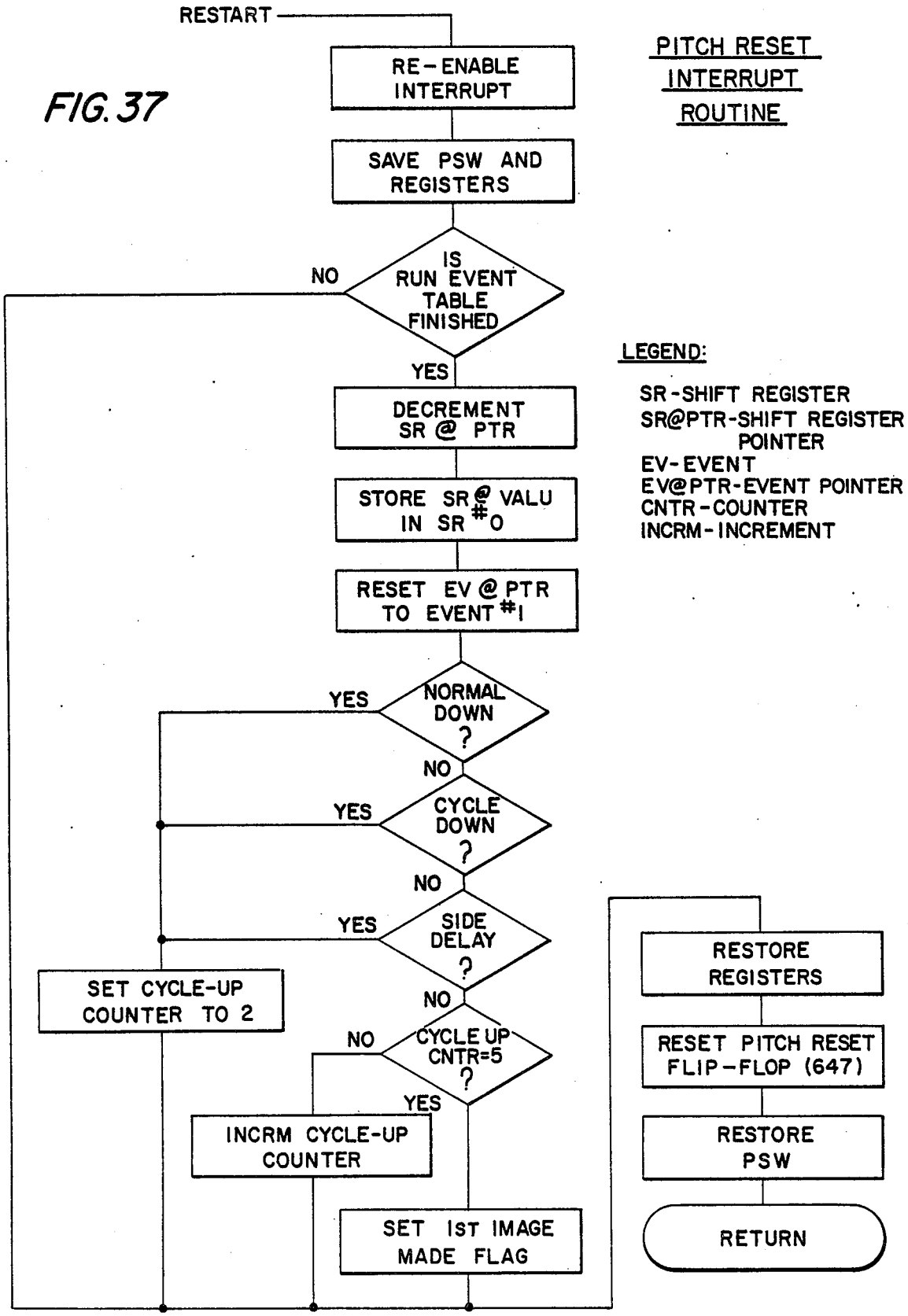
FIG. 37 is a flow charge of the pitch interrupt routine.

Referring particularly to FIG. 35, the Run Event Table consists of successive groups of individual events 851. Each event 851 is comprised of four data blocks, data block 825 containing the number of clock pulses (from machine clock 202) to the next scheduled pitch event (REL DIFF), data block 853 containing the shift register position associated with the event (REL SR), and data blocks 854, 855 (EVENT LO) (EVENT HI) containing the address of the event subroutine.

In machine states other than PRINT, data blocks 825, 853 (REL DIFF) (REL SR) are set to zero. Data blocks 854, 855 hold the address information for the Non-Print state event.

Control Data in the Run Event Table represents a portion of the foreground tasks and is transferred to the output buffer 546' of RAM memory section 546 by the Pitch Reset and Machine Clock interrupt routines. Other control data, representing foreground tasks not in the Run Event Table is transferred to RAM output buffer 546' by the Real Time Clock interrupt routine. Transfer of the remainder of the control data to output buffer 546' is by means of background (non-interrupt) routines.

Transfer of control data from output buffer 546' of RAM memory section 546 to the various locations in host machine 10 is through output Refresh via Direct Memory access (DMA) in response to machine clock interrupt signals as will appear. The interrupt routines are initiated by the respective interrupt signals.

Referring particularly to FIG. 23 and 35–37 and TABLES VII, VIII the interrupt having the highest priority, the Pitch Reset interrupt (signal 640), is operable only during the PRINT state, and occurs once each revolution of sheet register fingers 141 as responded to by sensor 146 of pitch reset clock 138. At each pitch reset interrupt signal, after a determination of priority by Priority Chip 659 in the event of multiple interrupt signals, an interrupt signal (INT) is generated. The acknowledgement signal (INTA) from processor 542 initiates the pitch reset interrupt routine.

On entering the pitch reset routine, the interrupt is re-enabled and the contents of the program working registers stored. A check is made to determine if building of the Run Event Table is finished. Also checks are made to insure that a new shift register schedules have been built and at least 910 clock counts since the last pitch reset have elaspsed. If not, an immediate machine shutdown is initiated.

Presuming that the above checks are satisfactory, the shift register pointer (SR PTR), which is the byte variable containing the address of a pre-selected shift register position (SR O), is decremented by one and adjusted for overflow and the shift register contents are updated with a byte variable (SR+VALUV) containing the new shift register value to be shifted in following the pitch reset interrupt. The event pointer (EV*PTR), a two byte variable containing the full address of the next scheduled event, is reset to Event #1. The count in the C register equals the time to the first event.

Machine Cycle Down, Normal Down, and Side One Delay checks are made, and if negative, the count on a cycle up counter (CYC UP CT) is checked. If the count is less than a predetermined control count (i.e. 5), the counter (CYC UP CT) is incremented by one. When the count on the cycle up counter equals the control count, an Image Made Flag is set.

If a Normal Down, Cycle Down, or Side One Delay has been initiated, the cycle up counter (CYC UP CT) is reset to a preset starting count (i.e. 2). The pitch reset interrupt routine is exited with restoration of the working registers and resetting of pitch reset flip flop 647.

The Machine Clock Interrupt routine, which is second in priority, is operative in all operational states of host machine 10. Although nominally driven by machine clock 202, which is operative only during Print state when processor main drive motor 34 is energized, machine clock pulses are also provided by phase locked loop 649 when motor 34 is stopped.

Referring particularly to FIG. 38 and TABLE IX, entry to the Machine Clock interrupt routine there shown is by a signal (INTA) from processor 542 following a machine clock interrupt signal 642 as described earlier. On entry, the event control register (C REG) is obtained and the working register contents stored. The C REG is decremented by one, the register having been previously set to a count corresponding to the next event in the Event Run Table.

The control register (C REG) is checked for zero. If the count is not zero and is an odd number, an output refresh cycle is initiated to effect transfer/refresh of data in RAM output buffer 546' to host machine 10. If the number is even, or following an output refresh, the interrupt system is re-enabled, the machine clock interrupt flip flop 651 is reset and the working registers are restored. Return is then made to the interrupted routine.

If the control register (C REG) count is zero, the Event Pointer (EV*PTR), which identifies the clock count (in data block 852) for the next scheduled event (REL DIFF), is loaded and the control register (C REG) reset to a new count equal to the time to the next event. The Event Pointer (EV*PTR) is incremented to the relative shift address for the event (REL SR, data block 853), and the shift register address information is set in appropriate shift registers (B, D, E. A registers).

The event Pointer (EV*PRT) is incremented successively to the event subroutine address information (EVENT LO) (EVENT HI) in the Event Run Table, and the address information therefrom loaded into a register pair (D & E registers). The Event Pointer (EV PTR) is incremented to the first data block (REL DIFF) of the next succeeding event in the Run Event Table, saved, and the register pair (H & L registers) that comprise the Event Pointer are loaded with the event subroutine address from the register pair (D & E registers) holding the information. The register pair (D & E registers) are set to the return address for the Event Subroutine. Using the address information, the Event Subroutine is called and the subroutine data transferred to RAM output buffer 546' for transfer to the host machine on the next Output Refresh.

Following this, the Machine Clock interrupt routine is exited as described earlier.

The Output Refresh cycle alluded to earlier functions, when entered, to transfer/refresh data from the output buffer of 546' RAM section 546 to host machine 10. Direct Memory Access (DMA) is used to insure a high data transfer rate.

On a refresh, Refresh Control 605 (see FIG. 23) raises the HOLD line to processor 542, which on completion of the operation then in progress, acknowledges by a HOLD A signal. With processor 542 in a hold mode and Address and Data buses 507, 508 released to I/O Module 502 (through operation of tri-state buffers 510, 511, 563, 570), the I/O module then sequentially accesses the output buffer 546' of RAM section 546 and transfers the contents thereof to host machine 10. Data previously transferred is refreshed.

The Real Time Interrupt, which carries the lowest priority, is active in all machine states. Primarily, the interrupt acts as an interval timer by decrementing a series of timers which in turn serve to control initiation of specialized subroutines used for control and error checking purposes.

Figure 39A:
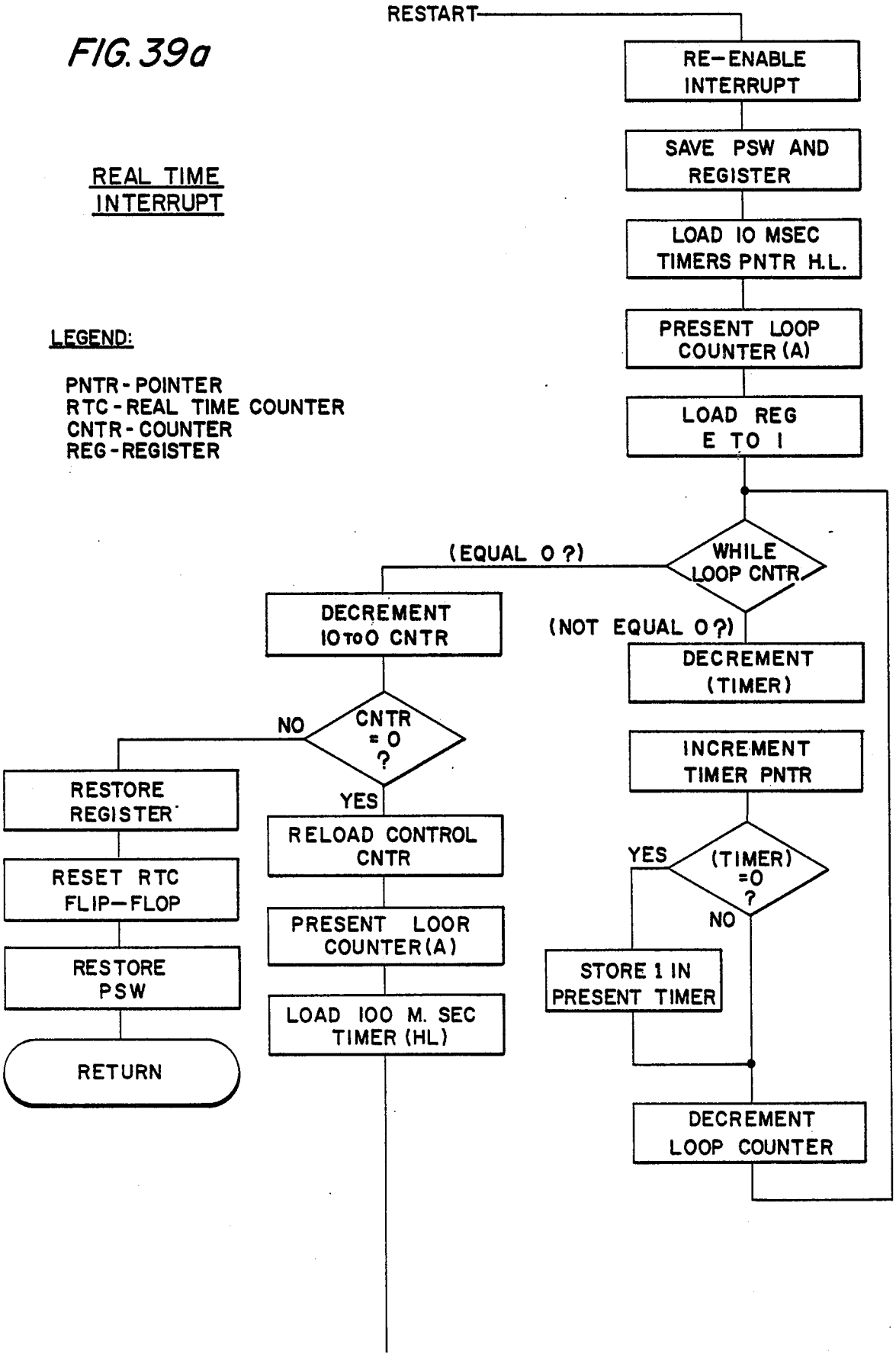
FIG. 39*a* and 39*b* comprise a flow chart of the real time interrupt routines.
Figure 39B:
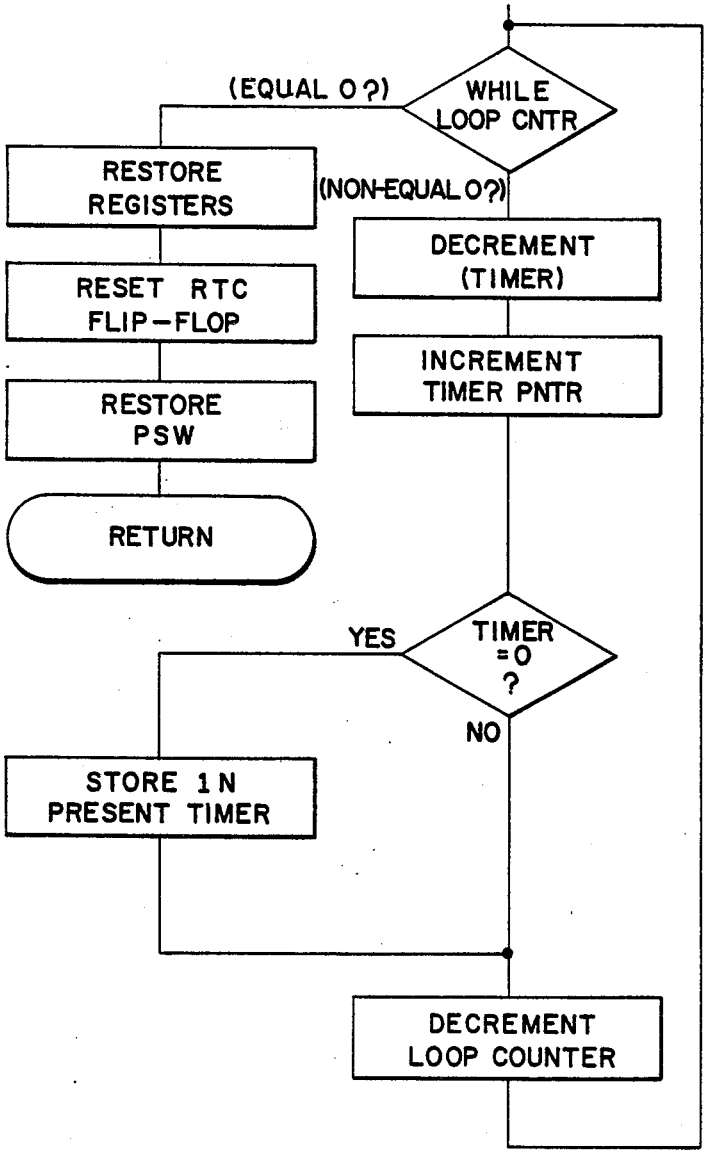

Referring particularly to FIG. 39 and TABLE X, the Real Time interrupt routine is entered in the same manner as the interrupt routines previously described, entry being in response to a specific RESTART instruction code assigned to the Real Time Interrupt. On entry, the interrupt is re-enabled and the register contents stored. The timer pointer (PNTR) for the first class of timers (i.e. 10 msec TIMERS) is loaded, and a loop counter identifying the number of timers of this class (i.e. 10 msec TIMERS) preset. A control register (E REG) is loaded and a timer decrementing loop is entered for the first timer. The loop decrements the particular timer, increments the timer pointer (PNTR) to the location of the next timer in this class, checks the timer count, and decrements the loop counter. The decrementing loop routine is repeated for each timer in the class (i.e. 10 msec TIMERS) following which a control counter (CNTR) for the second group of timers (i.e. 100 msec TIMERS) is decremented by one and the count checked.

The control counter (CNTR) is initially set to a count equal to the number of times the first timer interval is divisible into the second timer interval. For example, if the first class of timers are 10 msec timers and the second timer class are 100 msec timers, the control counter (CNTR) is set at 10 initially and decremented on each Real Time interrupt by one down to zero.

If the count on the control counter (CNTR) is not zero, the registers are restored, Real Time interrupt flip flop 856 reset, and the routine exited. If the count on the control counter is zero, the counter is reloaded to the original maximum count (i.e 10) and a loop is entered decrementing individually the second group of timers (i.e. 100 msec TIMERS). On completion, the routine is exited as described previously.

In the following TABLES:

"@" is used to indicate flags, counters and subroutine names.

"#"-is used to indicate input signals.

"$"-is used to indicate output signals.

":"-is used to indicate macro instructions, system subroutines, system flags, and data, etc.

For further explanation of the mnemonics and particular instructions utilized by the following routines, the reader is directed to Intel Corporation's Programming Manual for the 8080 Microcomputer System.

TABLE I

```
 99                                  *NAR
100                                  *
101                                  *        I N I T I A L I Z E   S T A T E
102                                  *
103                                  *        INIT: SUBROUTINE
104                                  *
105                                  *        INITIALIZE STATE- EXECUTED AFTER EACH START OR RESTART.  SETS
106                                  *        ALL POINTERS, FLAGS, AND DATA TO INITIAL VALUES REQUIRED TO
107                                  *        START EXECUTION OF ANY CONTROL ALGORITHMS.  ALWAYS EXITS TO
108                                  *        'NOT READY' STATE.
110                                  *        EPILOG
112  05 00000   3E0A     A   INIT:   MVI      A,10
113  05 00002   3252FD   N           STA      DIVD:10                    INITIALIZE TO 10
114  05 00005   32B5FC   N           STA      SLOWTOGL                   INITIALIZE TO 10
115  05 00008   211907   N           LXI      H,EV@STBY:                 H&L= ADDR OF STBY EVENT TABLE
116  05 0000B   2264FD   N           SHLD     EV@PTR:                    SAVE FOR MACH CLK ROUTINE
117  05 0000E   21FFFF   A           LXI      H,X'FFFF'                  INIT INSTRUMENTATION REMOTE
118  05 00011   2272FB   N           SHLD     INS@PTRR                     ADDR PNTR TO END OF RAM
119  05 00014   21FFFF   N           LXI      H,ADHORRMT-1               SET PNTR TO RAM CNTRL TABLE
120  05 00017   2278FB   N           SHLD     TAB@STRT                   SAVE PNTR
121  05 0001A   3E7F     A           MVI      A,X'7F'                    INIT TO UN-BYPASS
122  05 0001C   3280FC   N           STA      JAM@BYPS                                ALL JAM SWS
123                                  *
124                                  *        TIMER INITIALIZATION
125                                  *        MUST BE DONE BEFORE ANY TIMERS CAN BE USED
126                                  *
127  05 0001F   211FF9   A           LXI      H,AVAIL:+8+X'1F'           SET H&L TO END OF AVAIL: TABLE
128  05 00022   36FF     A           MVI      M,X'FF'                    STORE X'FF' IN LAST TABLE ADDR
129  05 00024   3E1F     A           MVI      A,31                       SET A-REG TO VALUE TO BE STORED
130                                  REPEAT
131  05 00026   2D       A               DCR      L                      STEP TO NEXT TABLE LOCATION
132  05 00027   77       A               MOV      M,A                    STORE INITIALIZATION VALUE
133  05 00028   3D       A               DCR      A                      STEP TO NEXT VALUE
134  05 00029   C22600   N           UNTIL:   CC,Z,S                     IS INITIALIZATION COMPLETE
135  05 0002C   2120FE   A           LXI      H,ADR(DATA,TIME:OUT)       TO INITIALIZE TIME:OUT TABLE
136  05 0002F   225FFD   N           SHLD     INPTR:                      SET IN/OUT POINTERS TO
137  05 00032   2261FD   N           SHLD     OUTPTR:                     BEGINNING OF TIME:OUT TABLE
138                                  *
139                                  *        INITIALIZE SPOOL
140                                  *        POINTERS
141                                  *
142  05 00035   2140FE   A           LXI      H,ADR(DATA,SPL:TBL)        SET PNTRS
143  05 00038   226AFD   N           SHLD     SPL:IN                                  TO START
144  05 0003B   226CFD   N           SHLD     SPL:OUT                                          OF TABLE
145                                  *
146                                  *        CHECK IF PAPER WAS PRESENT WHEN POWER WENT DOWN
147                                  *
148  05 0003E   3AC9E2   A           RNVNIB   MVOJAM@N                   A = JAM INFO FROM POWER DOWN
149  05 00041   0F       A           RRC                                 SET CARRY TO FOR JAM INFO
150  05 00042   D25A00   N           IFI      CC,C,S                     WAS THERE PAPER IN FOR AREA
```

```
151  05 00045   47        A          MOV      B,A                      YES, SAVE JAM INFO
152  05 00046   213CFD    A          SFBIT,P  FDR@AJAM,FDR@MJAM        SET FEEDER JAMS
     05 00049   3E0C      A
     05 0004B   B6        A
     05 0004C   77        A
153  05 0004D   2121F9    A          SFBIT,P  ON@X02,ON@X03            SIGNAL TRANSPT CLEARANCE REQ'D
     05 00050   3E03      A
     05 00052   B6        A
     05 00053   77        A
154  05 00054   3E80      A          SFLG     CLP@REQD                 TELL FLT HNDLR CLEARANCE REQD
     05 00056   3267F4    A
155  05 00059   78        A          MOV      A,B                      RESTORE THE A-REG
156                                 ENDIF
157  05 0005A   0F        A          RRC                               SET CARRY TO IMED@ON!
158  05 0005B   D27100    N          IF!      CC,C,S                   WAS THERE AN IMED@ON!
159                                 *
160                                 *
161  05 0005E   2EFF      A          MVI      L,MSK(FBIT,L@PR@FLT,JAM2@FLT,JAM3@FLT,JAM4@FLT,!
162                                 *          JAM5@FLT,JAM6@FLT,RET1@FLT,RET2@FLT)
163  05 00060   2603      A                                            SETS ALL JAM FBITS IN REG-L
164                                 *
165  05 00062   223BFD    A          MVI      H,MSK(FBIT,S@S@JAM,MISSTRIP)
166  05 00065   3E80      A                                            SETS ADDITIONAL FBITS IN H
     05 00067   3267F4    A          SHLD     ADR(FBYT,PAP!1)          MOVE FBITS INTO FBYTES
167  05 0006A   2120F9    A          SFLG     CLR@REQD                 TELL FLT HNDLR CLEARANCE REQD
     05 0006D   3E21      A
     05 0006F   B6        A          SFBIT,P  TS@FUS,TS@X02            TURN ON UNDEDICATED MAP LAMPS
     05 00070   77        A
168                                 ENDIF
169                                 IF!      XBYT,A,AND,!             IS EITHER SRT JAM FLAG SET
170  05 00071   E60C      A                   MSK(NVBIT,NV@L@W@J,NV@UP@J),NZ  IN NVNIB
     05 00073   CABA00    N
171                                 IF!      XBYT,A,EQ,!              YES, ARE BOTH SET
172  05 00076   FE0C      A                   MSK(NVBIT,NV@L@W@J,NV@UP@J)
     05 00078   C28300    N
173  05 00078   3E80      A          SFLG     TW@@ACT                  TELL SRT THAT THERE WAS A JAM
     05 0007D   3261F4    A
174  05 00080   C3B700    N          ELSE!
175  05 00083   0F        A              RRC                           GET NV@L@W@J TO SIGN BIT &
176                                     ID!READ  NV@L@W@J
177  05 00084   3237F4    A              MODFLG   L@W@MOD               TELL SRT IF UP OR LOW JAM
178                                 ENDIF
179  05 00087   CD0000    N          CALL     JAM@SET                  LET SRT SET JAM FLAGS & LAMPS
180                                 ENDIF
181  05 0008A   3E80      A          SFLG     SRT@RDY                  SIGNAL SRT NOT IN USE (READY)
     05 0008C   328CF7    A
182  05 0008F   3287F7    A          MODFLG   PROG@RDY                 SET PROG ROUTINE READY
183  05 00092   3268F4    A          MODFLG   2SD@ENAB                 ALLOW SELECTION OF DUPLEX MODE
184  05 00095   3EF2      A          MVI      A,X'F2'                  RE-ENABLE
185  05 00097   3200E6    A          STA      RSINTFF!                 INTERRUPT
186  05 0009A   FB        A          EI                                SYSTEM
187  05 0009B   CD0000    N          S@BIT,S  NPF@$ON,24V$SPL          PFO OFF (INVT'D) & 24V ON
     05 0009E   02        A
     05 0009F   E480      A
     05 000A1   EE80      A
188  05 000A3   CD0000    N          STIMR    FLT@DLY,25000,FLT@CHK    START LENS FAULT TIMER
     05 000A6   12        A
     05 000A7   FA        A
     05 000A8   0000      N
189  05 000AA   CD0000    N          CALL     D@C@CLP                  INITIALIZE D@C@NUM TO 1      (1)
190  05 000AD   327AFC    N          STA      CF@DIGIT                 ENABLE '0' IN QTY FLASHED    (2)
191  05 000B0   3E08      A          MVI      A,MSK(FBIT,P@P@RS)       TELL FLT ASSUME
192  05 000B2   3286FC    N          STA      XP@PREV                  BRUSH HOUSE OPN
193  05 000B5   3E02      A          MVI      A,!NRDY                  INIT STCK
194  05 000B7   3254FD    N          STA      !STATE!                  SYNCRONIZED BACKGROUND
195  05 000BA   3253FD    N          STA      STATE!                   CONTROL LOOP
196  05 000BD   CD3702    N          CALL     NRDY:PRL                 INIT CONTROL TO NOT-READY STATE

198                                 ***********************************************************************
199                                 *                                                                     *
200                                 *   S Y C R O N I Z E D   B A C K G R O U N D   C O N T R O L   L O O P S *
201                                 *                                                                     *
202                                 ***********************************************************************

204                                 *        PRIORTIES!
205                                 *                FIRST     10MS TIME OUT REQUESTS
206                                 *                SECOND    10MS CALLS
207                                 *                THIRD     SPOOLED CALLS
208                                 *                FOURTH    20MS CALLS
209                                 *                FIFTH     100MS CALLS
210                                 *                SIXTH     100MS TIME OUT REQUESTS

212  05 000C0   2151FD    A          LXI      H,ADR(DATA,SB!RQST)      SET MEM PNTR TO SB BYTE
213                                 REPEAT                            LOOP-3 FROM HLT ON ALL INTER'S
214                                     REPEAT                        LOOP-2 BACK AFTER EACH 100MS
215                                         REPEAT                    LOOP-1 BACK AFTER EACH 20MS
216  05 000C3   7E        A                  MOV      A,M              A= SYNC BKGND REQUESTS FROM RTC
217                                         ID!READ  SB!RQST
218  05 000C4   07        A                  RLC                       TEST FOR 10MS
219  05 000C5   D2F700    N                  IF!      CC,C,S                   SB REQUEST
220                                 *
221                                 *                                  TIMER SERVICE REQUESTS
222                                 *                                   CALLS TIMED OUT TIMER SUBRS
223                                 *                                   USING WRAP AROUND TABLE AND
224                                 *                                   IN/OUT PNTRS - RTC! SETS
225                                 *                                   INPTR! & ENTERS CALL ADDR
226                                 *
227  05 000C8   3A5FFD    N                  WHILE!   XBYT,INPTR!,NE,OUTPTR! ARE PNTRS AT SAME TABL
     05 000CB   2161FD    N
     05 000CE   BE        A
     05 000CF   CAE500    N
228  05 000D2   6E        A                      MOV      L,M          SET L-REG TO ADDR(L) IN TABLE
229  05 000D3   26FE      A                      MVI      H,HADR(DATA,TIME:OUT) MEM PNTR NOW SET TO
230  05 000D5   5E        A                      MOV      E,M                MOVE CALL ADDR(L) TO E
```

```
231   05 000D6    23        A
232   05 000D7    56        A
233   05 000D8    23        A
234   05 000D9    7D        A
235
236
237   05 000DA    E62F      A
238   05 000DC    3261FD    A
239   05 000DF    CD0000    N
240   05 000E2    C3C800    N
241
242   05 000E5    2A55FD    N
243   05 000E8    CDC000    N
244   05 000EB    2151FD    A
245   05 000EE    F3        A
246   05 000EF    7E        A
      05 000F0    E67F      A
      05 000F2    77        A
247
248   05 000F3    FB        A
249   05 000F4    C31501    N
250   05 000F7    3A6AFD    N
      05 000FA    216CFD    N
      05 000FD    BE        A
      05 000FE    CA1101    N
251   05 00101    6E        A
252   05 00102    26FE      A
253   05 00104    5E        A
254   05 00105    23        A
255   05 00106    56        A
256   05 00107    23        A
257   05 00108    7D        A
258   05 00109    E64F      A
259   05 0010B    326CFD    A
260   05 0010E    CD0000    N
261
262   05 00111    2151FD    A
263   05 00114    7E        A
264
265
266   05 00115    07        A
267   05 00116    07        A
268   05 00117    D24201    N
269   05 0011A    2A59FD    N
270   05 0011D    5E        A
271   05 0011E    23        A
272   05 0011F    7E        A
      05 00120    FEFF      A
      05 00122    C23701    N
273   05 00125    2A57FD    N
274   05 00128    2259FD    N
275   05 0012B    2151FD    A
276   05 0012E    F3        A
277   05 0012F    7E        A
      05 00130    E6BF      A
      05 00132    77        A
278
279   05 00133    FB        A
280   05 00134    C34201    N
281   05 00137    56        A
282   05 00138    23        A
283   05 00139    2259FD    N
284   05 0013C    CD0000    N
285   05 0013F    2151FD    A
286
287
288   05 00142    7E        A
      05 00143    E640      A
      05 00145    C2C300    N
289
290   05 00148    7E        A
      05 00149    E620      A
      05 0014B    CA9E01    N
291
292   05 0014E    2A5DFD    N
293   05 00151    5E        A
294   05 00152    23        A
295   05 00153    7E        A
      05 00154    FEFF      A
      05 00156    C29301    N
296   05 00159    2A5BFD    N
297   05 0015C    225DFD    N
298                                  *
299                                  *
300                                  *
301                                  *
302                                  *
303                                  *
304                                  *
305                                  *
306                                  *
307                                  *
308                                  *
309   05 0015F    2130FA    N
310   05 00162    1614      A
312                                  *
314   05 00164    3A45FD    A
      05 00167    E640      A
      05 00169    CA6E01    N
315
316   05 0016C    1611      A
317
318                                  *
```

```
            INX       H                STEP TO NEXT TABLE BYTE
            MOV       D,M              MOVE CALL ADDR(H) TO D
            INX       H                STEP TO NEXT TABLE BYTE
            MOV       A,L          PREPARE TO UPDATE PNTR
            ID:READ   TIME:OUT     DYNAMIC TABLE CONTAINING ADDRS
            MODBYT    A,AND,)      ADJUST FOR END OF TABLE
                      TIME:MSK
            STA       ADR(DATA,OUTPTR:) PNTR TO ADDR OF LAST SE
            CALL      DE:IND       DO TIMEOUT CALL
        ENDWHILE                   YES, ALL TIME OUTS SERVICED
                                   END TIMER SECTION
        LHLD      10:CALLS         GET PROPER 10MS CALL TABLE
        CALL      HL:IND           DO 10MS CALLS
        LXI       H,ADR(DATA,SB:RQST) SET MEM PNTR TO SB BYTE
        DI
        MODBYT    M,AND, 10:RQST REMOVE 10MS REQUEST

        ID:ALTR   SB:RQST
        EI                         (WATCH OUT FOR UNPRINTABLE NOT)
    ELSE:                          DO ANY SPOOLFD ROUTINES
        IF:       XBYT,SPL:IN,NE,SPL:OUT


            MOV       L,M
            MVI       H,HADR(DATA,SPL:TBL)
            MOV       E,M
            INX       H
            MOV       D,M
            INX       H
            MOV       A,L
            MODBYT    A,AND,SPL:MSK
            STA       ADR(DATA,SPL:OUT)
            CALL      DE:IND
        ENDIF
        LXI       H,ADR(DATA,SB:RQST)
        MOV       A,M
    ENDIF
    ID:READ   SB:RQST
    RLC
    RLC                            TEST FOR 20MS
    IF:       CC,C,S                         SB REQUEST
        LHLD      20PNTR           SET MEM PTR TO CALL IN 20MS TAB
        MOV       E,M              MOVE CALL ADDR(L) TO E
        INX       H                STEP MEM PTR TO ADDR(H)
        IF:       XBYT,M,EQ,X'FF'  IS POINTER AT END OF TABLE


            LHLD      20:PNTR      YES, SET MOVING POINTER
            SHLD      20PNTR           BACK TO BEGINNING OF TABLE
            LXI       H,ADR(DATA,SB:RQST)      SET MEM PNTR TO
            DI
            MODBYT    M,AND, 20:RQST REMOVE 20MS REQUEST


            ID:ALTR   SB:RQST
            EI
        ELSE:
            MOV       D,M              NO, MOVE CALL ADDR(H) TO D
            INX       H                STEP TO NEXT CALL IN TABLE
            SHLD      20PNTR           SAVE FOR NEXT LOOP-1
            CALL      DE:IND
            LXI       H,ADR(DATA,SB:RQST) SET MEM PNTR TO SB BY
        ENDIF
    ENDIF
UNTIL:    XBYT,M,AND,20:RQST,Z  MORE 20MS CALLS TO DO  (LOOP-1)


ID:READ   SB:RQST
IF:       XBYT,M,AND,100:RQST,NZ TEST FOR 100MS SB REQUEST


    ID:READ   SB:RQST
    LHLD      100PNTR              SET MEM PNTR TO CALL IN 100 TAB
    MOV       E,M                  MOVE CALL ADDR(L) TO E
    INX       H                    STEP MEM PNTR TO ADDR(H)
    IF:       XBYT,M,EQ,X'FF'      IS PNTR AT END OF TABLE


        LHLD      100:PNTR       YES, SET MOVING PNTR BACK
        SHLD      100PNTR            TO BEGINNING OF TABLE

                                 100MS TIMER SERVICE
                                  DECREMENTS TIMERS AND CALLS
                                  SUBROUTINE REQUESTED WHEN
                                  TIMER TIMES OUT
                                  USES 3 TABLES ON 3 CONSECUTIVE
                                  RAM PAGES -100:CNT W/TIMER
                                            -100:LS W/ADDR(L)
                                            -100:LS W/ADDR(H)
                                  ADDR IS FOR REQSTED SUBR

        LXI       H,100:CNT      STARTING ADDR OF 100MS TIMERS
        MVI       D,100:TMAX     D-REG SET TO QTY OF 100MS TMRS

                                 CONDITIONAL HOLD OF 100MS TMRS

        IF:       FBIT,STDBOPNO,T IS STAND-BY RELAY OPEN


            MVI       D,100:TMAX; YES, HOLD SPECIFIED NUMBER
                      -HOLDTMRS          OF TIMERS
        ENDIF
```

```
319                                                REPEAT                    LOOP TO DECR & SERVICE TIMEOUTS
320  05 0016E   7E      A                               IF:       VBYT,M,NZ IS TIMER ACTIVE
     05 0016F   A7      A
     05 00170   CA8201  N
321  05 00173   35      A                                     DCR       M     DECR TIMER
322  05 00174   C28201  N                                     IF:       CC,Z,S HAS TIMER TIMED OUT
323  05 00177   D5      A                                         PUSH      D     SAVE # TIMERS TO SERVICE
324  05 00178   E5      A                                         PUSH      H     SAVE ADDR OF CURRENT TIMER
325  05 00179   24      A                                         INR       H     STEP TO NEXT RAM PAGE
326  05 0017A   5E      A                                         MOV       E,M   MOVE CALL ADDR(L) TO E
327  05 0017B   24      A                                         INR       H     STEP TO NEXT RAM PAGE
328  05 0017C   56      A                                         MOV       D,M   MOVE CALL ADDR(H) TO D
329  05 0017D   CD0000  N                                         CALL      DE:IND
330  05 00180   E1      A                                         POP       H     RECALL ADDR OF CURRENT THR
331  05 00181   D1      A                                         POP       D     RECALL NUMBER OF TIMERS
332                                  *                                             YET TO BE SERVICED
333                                                           ENDIF
334                                                       ENDIF
335  05 00182   23      A                                    INX       H         STEP TO NEXT TIMER ADDR
336  05 00183   15      A                                    DCR       D         DECR NUMBER OF 100MS TIMERS
337  05 00184   C26E01  N                                UNTIL:    CC,Z,S       HAVE ALL TIMERS BEEN SERVICED
338                                  *                                          END 100MS TIMER SECTION
339  05 00187   2151FD  A                                LXI       H,ADR(DATA,SB:RQST) SET MEM PNTR TO SB BYTE
340  05 0018A   F3      A                                DI
341  05 0018B   7E      A                                MODBYT    M,AND, 100:RQST REMOVE 100MS REQUEST
     05 0018C   E6DF    A
     05 0018E   77      A
342                                                     ID:ALTR   SB:RQST
343  05 0018F   FB      A                                EI
344  05 00190   C39E01  N                            ELSE:
345  05 00193   56      A                                MOV       D,M           NO, MOVE CALL ADDR(H) TO D
346  05 00194   23      A                                INX       H                 STEP PNTR TO NEXT CALL
347  05 00195   225DFD  N                                SHLD      100PNTR           SAVE FOR NEXT LOOP-2
348  05 00198   CD0000  N                                 CALL      DE:IND
349  05 0019B   2151FD  A                                 LXI       H,ADR(DATA,SB:RQST) SET MEM PNTR TO SB BYTE
350                                                   ENDIF
351                                               ENDIF
352  05 0019E   7E      A                       UNTIL:    VBYT,M,Z                  MORE SB CALLS TO DO  (LOOP-2)
     05 0019F   A7      A
     05 001A0   C2C300  N
353                                                 ID:READ   SB:RQST
354  05 001A3   76      A                           HLT                             COOL IT UNTIL INTERRUPT RESTART
355  05 001A4   CAC300  N                       UNTIL:    CC,Z,C                    WAS INTERRUPT RTC  (LOOP-3)
356  05 001A7   F3      A                       DI                                  ONLY KIDDING BEFORE, BUT THIS
357  05 001A8   76      A                       HLT                                  TIME REALLY STOP (ABORT)
359                                  *
360                                  *       SUBR TO SET CALL TABLE POINTERS
361                                  *       CALLED BY EACH STATE PROLOG
362                                  *
363                                  *       POSITION SB:TABLE POINTER
364                                  *
365  05 001A9   3A53FD  N   SB:PNTRS LDA       STATE:                              WHAT STATE IS WANTED
366  05 001AC   110600  A            LXI       D,X'06'                             LOAD D&E WITH SKIP NUMBER
367  05 001AF   21D501  N            LXI       H,SB:TABLE-X'06'                    H&L=6'<' TABLE ADDR
368                                 REPEAT
369  05 001B2   19      A                DAD       D                               SKIP THREE WORDS
370  05 001B3   3D      A                DCR       A                               DECR STATE LOOP COUNTER
371  05 001B4   F2B201  N            UNTIL:    CC,S,S                              IS POINTER AT CORRECT STATE
372                                  *
373                                  *       TRANSFER ADDRS TO VARIABLE SB POINTERS
374                                  *
375  05 001B7   1155FD  N            LXI       D,10:CALLS                          SET D&E TO FIRST OF SB PNTRS
376  05 001BA   0602    A            MVI       B,2                                 LOAD 10:CALLS
377  05 001BC   CDCE01  N            CALL      MV:WORDS                                     & 20:PNTR
378  05 001BF   2B      A            DCX       H                                   ADJUST 'FROM' PNTR
379  05 001C0   2B      A            DCX       H                                                BACK 1 WORD
380  05 001C1   0602    A            MVI       B,2                                 LOAD 20PNTR
381  05 001C3   CDCE01  N            CALL      MV:WORDS                                     & 100:PNTR
382  05 001C6   2B      A            DCX       H                                   ADJUST 'FROM' PNTR
383  05 001C7   2B      A            DCX       H                                                BACK 1 WORD
384  05 001C8   CDCC01  N            CALL      MV:WORD                             LOAD 100PNTR
385                                  ID:ALTR   10:CALLS,20:PNTR,20PNTR,            DATA WORDS MODIFIED
386                                            100:PNTR,100PNTR                      BY THIS SUBR
387  05 001CB   C9      A            RET
388                                 *NAR
389                                  *
390                                  *       MV:WORD/MV:WORDS SUBROUTINES
391                                  *
392                                  *       SUBR TO TRANSFER WORDS (2BYTES) FROM MEMORY POINTED TO BY <H&L>
393                                  *        TO MEMORY POINTED TO BY <D&E>. CALL MV:WORD FOR 1 TRANSFER,
394                                  *        AND CALL MV:WORDS (WITH B-REG # WORDS TO TRANSFER) FOR
395                                  *        MULTIPLE TRANSFERS. USES ALL BUT C-REG.
396                                  *
397  05 001CC   0601    A   MV:WORD  MVI       B,1                                 B= # WORDS TO BE MOVED
398                                 MV:WORDS REPEAT
399  05 001CE   7E      A                MOV       A,M                             A= 1ST 'FROM' BYTE
400  05 001CF   12      A                STAX      D                               STORE IN 1ST 'TO' LOCATION
401  05 001D0   23      A                INX       H                               ADVANCE 'FROM'
402  05 001D1   13      A                INX       D                                            AND 'TO' PNTRS
403  05 001D2   7E      A                MOV       A,M                             A= 2ND 'FROM' BYTE
404  05 001D3   12      A                STAX      D                               STORE IN 2ND 'TO' LOCATION
405  05 001D4   23      A                INX       H                               ADVANCE 'FROM'
406  05 001D5   13      A                INX       D                                            AND 'TO' PNTRS
407  05 001D6   05      A                DCR       B                               DECRM # OF WORDS CNTR
408  05 001D7   C2CE01  N            UNTIL:    CC,Z,S                              LOOP UNTIL ALL WORDS TRANSFERRD
409  05 001DA   C9      A            RET
410                                  *
411                                  *       TABLE OF SB CALL POINTERS
412                                  *       FOR EACH STATE
413                                  *
414  05 001DB   0906    N   SB:TABLE DW        COMP10
415  05 001DD   0A06    N            DW        COMP20
416  05 001DF   1206    N            DW        COMP100
417  05 001E1   B105    N            DW        TREP10
418  05 001E3   B505    N            DW        TREP20
419  05 001E5   C305    N            DW        TREP100
```

```
05 001E7   4202    N            DW        NRDY10
05 001E9   4602    N            DW        NRDY20
05 001EB   5202    N            DW        NRDY100
05 001ED   AF02    N            DW        RDY10
05 001EF   B302    N            DW        RDY20
05 001F1   BF02    N            DW        RDY100
05 001F3   A803    N            DW        PRNT10
05 001F5   B203    N            DW        PRNT20
05 001F7   C803    N            DW        PRNT100
05 001F9   1905    N            DW        RUNN10
05 001FB   1D05    N            DW        RUNN20
05 001FD   2F05    N            DW        RUNN100

                         *
                         *      SUBR TO DO EPILOGS & PROLOGS LAST CALL IN EVERY 100MS TABLE
                         *
05 001FF   2153FD  A     STAT:CHG LXI      H,ADR(DATA,STATE:)          A= PRESENT STATE # IF UNCHANGED
05 00202   7E      A              MOV      A,M                          OR NEXT STATE IF CHANGED
05 00203   23      A              INX      H                           H&L= ADDR 'FORMER STATE' GLOBAL
05 00204   BE      A              IF:      XBYT,A,NE,M                 HAS THERE BEEN A STATE CHANGE
05 00205   CA3602  N
                                      ID:READ   STATE:,:STATE:
05 00208   46      A                  MOV       B,M                    YES, B= FORMER STATE
05 00209   77      A                  MOV       M,A                    UPDATE 'FORMER' TO 'PRESENT'
                                      ID:ALTR   :STATE:
05 0020A   78      A                  CASE:     VBYT,B                 DO EPILOG FOR FORMER STATE
05 0020B   111F02  N
05 0020E   FE06    A
05 00210   CD0000  N
05 00213   1806    N                     C,0       COMP:EPL            COMPONENT CONTROL STATE
05 00215   DB05    N                     C,1       TREP:EPL            TECH REP STATE
05 00217   7A02    N                     C,2       NRDY:EPL            NOT-READY STATE
05 00219   E302    N                     C,3       RDY:EPL             READY STATE
05 0021B   E603    N                     C,4       PRNT:EPL            PRINT STATE
05 0021D   4105    N                     C,5       RUNN:EPL            SYSTEM RUNNING, NOT PRINT STATE
                                      ENDCASE
05 0021F   3A53FD  N                  CASE:     VBYT,STATE:            DO PROLOG FOR PRESENT STATE
05 00222   113602  N
05 00225   FE06    A
05 00227   CD0000  N
05 0022A   FF05    N                     C,0       COMP:PRL            COMPONENT CONTROL STATE
05 0022C   A505    N                     C,1       TREP:PRL            TECH REP STATE
05 0022E   3702    N                     C,2       NRDY:PRL            NOT-READY STATE
05 00230   A602    N                     C,3       RDY:PRL             READY STATE
05 00232   1603    N                     C,4       PRNT:PRL            PRINT STATE
05 00234   0B05    N                     C,5       RUNN:PRL            SYSTEM RUNNING, NOT PRINT STATE
                                      ENDCASE
                                 ENDIF
05 00236   C9      A              RET                                  RETURN TO 100 MSEC SYNC BKGND

                         *NAR
                         *
                         *      N O T   R E A D Y   S T A T E
                         *
                         *      NOT READY STATE- EXECUTES AFTER INITIALIZE UNTIL ALL READY CONDITIONS
                         *      ARE MET.  THIS STATE CAN ALSO BE ENTERED FROM 'RUN NOT PRINT','READY'
                         *      AND 'TECH REP'.  CONTROL EXITS TO EITHER 'READY' OR 'TECH REP' STATES.

                         *      PROLOG

05 00237   CDA901  N     NRDY:PRL CALL      SB:PNTRS                    SYNC BKG PNTRS TO NEW STATE
05 0023A   CD0000  N              STIMR     INSTOTMR,1000,NEXTOFLT      UPDATES INST FLT CODE IN STBY
05 0023D   49      A
05 0023E   64      A
05 0023F   0000    N
05 00241   C9      A              RET

                         *      CALLS FOR NOT READY 10 MS SYN BACKGROUND

05 00242   CD0000  N     NRDY10   CALL      ADHOCTRL
05 00245   C9      A              RET

                         *      CALLS FOR NOT READY 20 MS SYN BACKGROUND

05 00246   0000    N     NRDY20   DW        NRDYOSWS
05 00248   0000    N              DW        MNOELVRS
05 0024A   0000    N              DW        OSPLOCTL
05 0024C   0000    N              DW        LMPOCTRL
05 0024E   0000    N              DW        INSTRU
05 00250   FFFF    A              DW        X'FFFF'                     END OF TABLE

                         *      CALLS FOR NOT READY 100 MS SYN BACKGROUND

05 00252   0000    N     NRDY100  DW        NRILKOCK
05 00254   0000    N              DW        REDOBGND
05 00256   0000    N              DW        OVLADUMP
05 00258   0000    N              DW        RECAPER
05 0025A   0000    N              DW        BINOCHK                     1
05 0025C   0000    N              DW        MINIPHS1                    2
05 0025E   0000    N              DW        BILOJMPO
05 00260   0000    N              DW        FUSOROUT
05 00262   0000    N              DW        FLT0100                     1
05 00264   0000    N              DW        FLTOCTRL                    2
05 00266   0000    N              DW        FLTOCLRN                    3
05 00268   0000    N              DW        PROG2SJM
05 0026A   0000    N              DW        PSDOSTPY
05 0026C   0000    N              DW        XHMOSTPY
05 0026E   0000    N              DW        JAMORST
05 00270   0000    N              DW        KEYOCNTR
05 00272   0000    N              DW        TSTOLPK
05 00274   8402    N              DW        NRDY:CHG                    TEST IF OK TO
05 00276   FF01    N              DW        STAT:CHG                                  LEAVE NOT READY
05 00278   FFFF    A              DW        X'FFFF'                     END OF TABLE

                         *      EPILOG
```

```
516  05 0027A  CD0000  N  NRDY:EPL C0BIT,S  WAIT0                    INSURE WAIT OFF AT NRDY EXIT
     05 0027D  E9FE    A
517  05 0027F  AF      A           CFLG     STRT:PRT                 DIS-ABLE TRANSFER TO 'PRINT'
     05 00280  325BF4  A
518  05 00283  C9      A           RET

520                              *
521                              *        SUBR FOR 'NOT-READY' 100MS SYNC BKGND
522                              *         TESTS FOR CHANGE TO 'READY' OR 'TREP REP'
523                              *
524  05 00284  CDDF05  N  NRDY:CHG CALL     TREP:CHG                 TEST FOR STATE CHANGE TO :TREP
525  05 00287  7E      A           IF:      XBYT,M,NE,:TREP          DID IT CHANGE TO :TREP STATE
     05 00288  FE01    A
     05 0028A  CA9302  N
526                                   ID:READ   STATE:
527  05 0028D  CD9402  N                CALL     RDYTEST:             TEST ALL 'READY' FLAGS
528  05 00290  CD0B03  N                CALL     NRDY:RDY             MOVE TO EITHER :NRDY OR :RDY
529                              ENDIF
530  05 00293  C9      A           RET

532                              *
533                              *        SUBR TO TEST ALL 'READY' FLAGS IN A LOOP
534                              *
535  05 00294  2184F7  A  RDYTEST: LXI      H,RDYFLGS:               H&L= START ADDR OF READY FLAGS
536  05 00297  0609    A           MVI      B,RDYFNUM:               B= # OF READY FLAGS TO CHK
537                              REPEAT
538  05 00299  7E      A                MOV      A,M                  A= <PRESENT READY FLAG>
539  05 0029A  07      A                RLC                           SET C IF FLAG SET (READY)
540  05 0029B  DAA002  N                IF:      CC,C,C               IS PRESENT FLAG INDICATING RDY
541  05 0029E  0601    A                    MV:      B,1              NO, DON'T TEST ANY FURTHER
542                                   ENDIF
543  05 002A0  23      A                INX      H                    MOVE TO NEXT FLAG LOCATION
544  05 002A1  05      A                DCR      B                    DECRM LOOP CNTR (# READY FLAGS)
545  05 002A2  C29902  N          UNTIL:   CC,Z,S                    LOOP UNTIL ALL FLAGS CHKED
546                              ID:READ  LENSORDY,ELVORDY,FUSORDY,:  FLAGS READ
547                                       PROGORDY,ILCKORDY,XMMORDY,:
548                                       FLTORDY,ADHONMOV,SRTORDY
549  05 002A5  C9      A           RET                                RETURN

551                              *NAR
552                              *
553                              *        R E A D Y   S T A T E
554                              *
555                              *        READY STATE- EXECUTES WHEN MACHINE IS READY TO GO INTO PRINT STATE.
556                              *        CONTROL CAN GO BACK TO 'NOT READY' OR GO TO 'TECH REP' IF REQUIRED.

558                              *        PROLOG

560  05 002A6  CD0000  N  RDY:PRL  S0BIT,S   READY$
     05 002A9  E701    A
561  05 002AB  CDA901  N          CALL     SB:PNTRS                 SYNC BKG PNTRS TO NEW STATE
562  05 002AE  C9      A           RET

564                              *        CALLS FOR READY 10MS SYN BACKGROUND

566  05 002AF  CD0000  N  RDY10    CALL     ADHOCTRL
567  05 002B2  C9      A           RET

569                              *        CALLS FOR READY 20MS SYN BACKGROUND

571  05 002B3  0000    N  RDY20    DW       RDYOSWS
572  05 002B5  0000    N           DW       MNOELVOS
573  05 002B7  0000    N           DW       DSPLOCTL
574  05 002B9  0000    N           DW       LMPOCTRL
575  05 002BB  0000    N           DW       INSTRU
576  05 002BD  FFFF    A           DW       X'FFFF'                  END OF TABLE

578                              *        CALLS FOR READY 100MS SYN BACKGROUND

580  05 002BF  0000    N  RDY100   DW       BINOCHK                  1
581  05 002C1  0000    N           DW       MINIPHS1                 2
582  05 002C3  0000    N           DW       BILOJMPO
583  05 002C5  0000    N           DW       DVLODUMP
584  05 002C7  0000    N           DW       RECAPER
585  05 002C9  0000    N           DW       FUSOROUT
586  05 002CB  0000    N           DW       FLTO100                  1
587  05 002CD  0000    N           DW       FLTOCTRL                 2
588  05 002CF  0000    N           DW       NRILKOCK
589  05 002D1  0000    N           DW       REDOBGND
590  05 002D3  0000    N           DW       2SOOSTRY
591  05 002D5  0000    N           DW       XMMOSTRY
592  05 002D7  0000    N           DW       JAMORST
593  05 002D9  0000    N           DW       KEYOCNTR
594  05 002DB  0000    N           DW       TSTOLP4
595  05 002DD  E9C2    N           DW       RDY:CHG                  TEST IF OK TO
596  05 002DF  FFC1    N           DW       STAT:CHG                                LEAVE READY
597  05 002E1  FFFF    A           DW       X'FFFF'                  END OF TABLE

599                              *        EPILOG

601  05 002E3  CD0000  N  RDY:EPL  C0BIT,S   READY$
     05 002E6  E7FE    A
602  05 002E8  C9      A           RET

604                              *        CHANGE OF STATE ROUTINES

606                              *
607                              *        SUBR FOR 'READY' 100MS SYNC BKGND
608                              *         TESTS FOR CHANGE TO 'NOT-READY' OR 'TECH REP'
609                              *
610  05 002E9  CDDF05  N  RDY:CHG  CALL     TREP:CHG                 TEST FOR STATE CHANGE TO :TREP
611  05 002EC  7E      A           IF:      XBYT,M,NE,:TREP          DID IT CHANGE TO :TREP STATE
     05 002ED  FE01    A
     05 002EF  CA0A03  N
612                                   ID:READ   STATE:
```

```
613  05 002F2   CD9402   N              CALL     RDYTEST!                  TEST ALL 'READY' FLAGS
614  05 002F5   CD0B03   N              CALL     NRDY!RDY                  MOVE TO EITHER !NRDY OR !RDY
615  05 002F8   3A5BF4   A              IF!      FLG,STRT!PRT,T            IS START PRINT REQUESTED
     05 002FB   07       A
     05 002FC   D20A03   N
616  05 002FF   2153FD   A                  LXI      H,ADR(DATA,STATE!)    SET MEM PNTR
617  05 00302   7E       A                  IF!      XBYT,M,EQ,!RDY        OK TO GO TO PRINT
     05 00303   FE03     A
     05 00305   C20A03   N
618                                            !D!READ   STATE!
619  05 00308   3604     A                     MVI      M,!PRNT           CHG TO PRT STATE
620                                            !D!ALTR   STATE!
621                                         ENDIF
622                                      ENDIF
623                                   ENDIF
624  05 0030A   C9       A           RET

626                           *
627                           *     SUBR TO USE INFO FROM 'RDYTEST' AND EXECUTE THE PROPER CHANGE OF STATE
628                           *
629  05 0030B   2153FD   A   NRDY!RDY LXI      H,ADR(DATA,STATE!)          SET MEM PNTR
630  05 0030E   3603     A           MVI      M,!RDY                      ASSUME GOING TO 'READY' STATE
631                                  !D!ALTR  STATE!
632  05 00310   DA1503   N           IF!      CC,C,C                      ARE ALL 'READY' FLAGS SET
633  05 00313   3602     A               MVI      M,!NRDY                 NO, MOVE TO 'NOT-READY' STATE
634                                      !D!ALTR  STATE!
635                                  ENDIF
636  05 00315   C9       A           RET
638                           *NAR
639                           *
640                           *     P R I N T    S T A T E
641                           *
642                           *     PRINT STATE- EXECUTES WHILE MACHINE IS PRODUCING COPIES.
643                           *     ENTERED FROM 'READY' AND EXITS TO 'RUN NOT PRINT'.

645                           *     PROLOG

647  05 00316   2160FE   N   PRNT!PRL CLR!MEM  16,SHIFTREG                 CLEAR SHIFT REGISTER
     05 00319   0610     A
     05 0031B   CD0000   N
648  05 0031E   3E60     A           MVI      A,LADR(DATA,SHIFTREG)       FORCE SHIFT REG TO START AT
649  05 00320   3263FD   A           STA      ADR(DATA,SR@PTR!)            BEGINNING OF SHIFTREG TABLE
650                                  CLR!MEM  SD1@DLY-TIME@DN!+1,)        CLEAR THE FOLLOWING FLAGS
651  05 00323   21A7F4   A                    ADR(FLG,TIME@DN!)
     05 00326   0609     A
     05 00328   CD0000   N
652                                  !D!CLR   TIME@DN!,IMED@DN!,)
653                                           CYCL@DN!,NORM@DN!,QWIK!OUT,)
654                                           IMGMADF!,SD1@TIMO,SD1@DLY
655  05 0032B   3E80     A           SFLG     910@D@NE                    ALLOW FIRST PITCH RESET
     05 0032D   326FF4   A
656  05 00330   AF       A           XRA      A
657  05 00331   3266FD   N           STA      CYCUPCT!                    INIT CYCLE-UP CNTR TO 0
658  05 00334   3269FD   N           STA      SR@VALU!                    INIT 'NEW SR VALUE' TO 0
659  05 00337   325DFA   N           STA      PLL@INFO                    INIT PLL SHUTDOWN CONTROL TO 0
660  05 0033A   3268FD   N           STA      SMPL@CT!                    INIT SAMPLE COPY CNTR TO 0
661  05 0033D   3E03     A           MVI      A,3
662  05 0033F   3267FD   N           STA      NO!MGCT!                    INIT 'NO IMAGE CNTR' TO 3
663  05 00342   CD0000   N           CALL     SRSK                        SHIFT REG SCHEDULER (INIT SR#0)
664  05 00345   CD0000   N           CALL     TIM@M@D                     CALC SHIFTED IMAGE VALUES    (1)
665  05 00348   CD0000   N           STIMR    935!TMR,810,RETURN!         SET 'OVER-RUN EVENT' TIMER   (2)
     05 0034B   22       A
     05 0034C   51       A
     05 0034D   0000     N
666  05 0034F   CD0000   N           CALL     TBLD@PRT                    BUILD NEW PITCH TABLE        (3)
667  05 00352   CD0000   N           S@BIT,S  PRNT*RLY,PR*C@OL            PRINT RELAY & COOLING FAN ON
     05 00355   02       A
     05 00356   EA08     A
     05 00358   F608     A
668  05 0035A   AF       A           CTIMR    PR@C@OL                     CLEAR COOLING FAN TIMER
     05 0035B   3232FA   N
669  05 0035E   CD0000   N           C@BIT,S  NPF@*ON                     TURN OFF PFO (INVERTED DRIVER)
     05 00361   E47F     A
670  05 00363   3A80F4   A           IF!      FLG,ADH@SELC,T
     05 00366   07       A
     05 00367   D27003   N
671  05 0036A   CD0000   N               CALL     ADH@M@TN
672  05 0036D   C37503   N           ELSE!
673  05 00370   3E80     A               SFLG     ADH@WTEN
     05 00372   32CCF4   A
674                                  ENDIF
675  05 00375   CD0000   N           CALL     TRN@B@D
676  05 00378   CD0000   N           CALL     PAP@SIZE                    CHK PAPER WIDTH FOR FUSER    (1)
677  05 0037B   CD0000   N           CALL     EDGE@FA                     CHK WHICH EDGE FADE OUT      (2)
678  05 0037E   CD0000   N           CALL     PAP@PPL3
679  05 00381   CD0000   N           CALL     PROG@UP                     PROG INITIALIZATION SUBR
680  05 00384   CD0000   N           CALL     PRO@EUP!
681  05 00387   CD0000   N           CALL     FDR@PRT                     CHECK FEEDER SELECTION
682  05 0038A   CD0000   N           CALL     BLG@BKPT                    READ BILLING BREAK-POINTS
683  05 0038D   CD0000   N           CALL     D@@ELV                      CAUSE ELV TO EXECUTE
684  05 00390   3A54F4   A           IF!      FLG,SRT*SEL,T               IS SORTER BEING USED
     05 00393   07       A
     05 00394   D29F03   N
685  05 00397   CD0000   N               CALL     SRT@INIT                INITIALIZE SORTER JAM DETECT
686                                     MVI      A,MSK(NVBIT,NV@FJAM,)   SETS ALL 4 JAM CONDITIONS
687  05 0039A   3E0F     A                        NV@IMED,NV@L@W@J,NV@UP@J)
688  05 0039C   C3A403   N           ELSE!
689  05 0039F   3AC9E2   A               RNVNIB   NV@JAM@N                READ SAVED PREVIOUS SRT JAMS
690                                     M@DBYT   A,OR,MSK(NVBIT,)        & SET IMED DN & FDR JAM
691  05 003A2   F603     A                        NV@FJAM,NV@IMED)
692                                  ENDIF
693  05 003A4   32C9E2   A           WNVNIB   NV@JAM@N                    STORE IN CASE OF PWR DN
694                                  !D!ALTR  NV@FJAM,NV@IMED,NV@L@W@J,)  SEE ABOVE IF!/ELSE!
695                                           NV@UP@J
696  05 003A7   CDA901   N           CALL     SB!PNTRS                    SYNC BKG PNTRS TO NEW STATE
```

```
05 003AA   C9       A            RET

                        *       CALLS FOR PRINT 10 MS SYN BACKGROUND

05 003AB   CD0000   N   PRNT10   CALL     ADH@CTRL
05 003AE   CDC004   N            CALL     PRT!IMD
05 003B1   C9       A            RET

                        *       CALLS FOR PRINT 20 MS SYN BACKGROUND

05 003B2   0000     N   PRNT20   DW       PRT@SWS
05 003B4   0000     N            DW       TONODIS
05 003B6   0000     N            DW       PAP@TGL3
05 003B8   0000     N            DW       LMP@CTRL
05 003BA   0000     N            DW       FDR@BKFD
05 003BC   0000     N            DW       SORTER@
05 003BE   0000     N            DW       FLV@PRNT
05 003C0   0000     N            DW       SOS@JMDT
05 003C2   0000     N            DW       DSPL@CTL
05 003C4   0000     N            DW       INSTRU
05 003C6   FFFF     A            DW       X'FFFF'                    END OF TABLE

                        *       CALLS FOR PRINT 100 MS SYN BACKGROUND

05 003C8   0000     N   PRNT100  DW       RILK@CK
05 003CA   0000     N            DW       2SD@RUN
05 003CC   0000     N            DW       LITE@OFF
05 003CE   0000     N            DW       XMM@PRNT
05 003D0   0000     N            DW       FUS@RDUT
05 003D2   0000     N            DW       READY@CK
05 003D4   0000     N            DW       JAM@RST
05 003D6   0000     N            DW       MINIPHS8
05 003D8   4F06     N            DW       SMPL@CPY
05 003DA   0000     N            DW       RXCYCLDN                   STUB IN US IMG
05 003DC   0000     N            DW       KEY$CNTR
05 003DE   0000     N            DW       TST@LP4
05 003E0   2C04     N            DW       PRT!CHG                    TEST IF OK TO
05 003E2   FF01     N            DW       STAT!CHG                                LEAVE PRINT
05 003E4   FFFF     A            DW       X'FFFF'                    END OF TABLE

                        *       EPILOG

05 003E6   CD0000   N   PRNT!EPL CALL     AX@EPTY                    (1)
05 003E9   CD0000   N            CALL     FDH@EPL3                   (2)
05 003EC   CD0000   N            CALL     FDA@EPL3                   (3)
05 003EF   CD0000   N            CALL     TPN@EPL3
05 003F2   CD0000   N            CALL     DVL@NRDY
                                 C@BIT,S  FUS$CAPL,FUS$LOAD,ILLM$SPL,;
05 003F5   CD0000   N                     FF0$11,EF0$12$5,SMPL$CPY,READY$
   05 003F8   07       A
   05 003F9   E6F7     A
   05 003FB   EDFD     A
   05 003FD   F2F7     A
   05 003FF   ECF7     A
   05 00401   EBF7     A
   05 00403   E2FE     A
   05 00405   E7FE     A
05 00407   CD0000   N            S@BIT,S  NPF0$ON                    TURN OFF PF0 (INVERTED DRIVER)
   05 0040A   E480     A
05 0040C   AF       A            CFLG     ELV@AUTO                   DISABLE AUTO-TRAY SWITCHING
   05 0040D   3222F4   A
05 00410   CD0000   N            CALL     PAP@EPL3
05 00413   CD1704   N            CALL     ABORT
05 00416   C9       A            RET

                        *
                        *       SUBROUTINE
                        *

05 00417   F3       A   ABORT    DI                                  TURN OFF INTERRUPT SYSTEM
05 00418   AF       A            CFLG     TBLD@FIN                   SIGNAL NEW PITCH TABLE REQ'D
   05 00419   325DF4   A
05 0041C   211907   N            LXI      H,EV@STBY!                 ADDR OF STBY EVENT TABLE
05 0041F   2264FD   N            SHLD     EV@PTR!                    SAVE FOR MACH CLK ROUTINE
05 00422   CD0000   N            C@BIT,S  BTR$LOAD,PRNT$RLY          UN-LOAD BTR & DROP PRINT RELAY
   05 00425   02       A
   05 00426   E17F     A
   05 00428   EAF7     A
05 0042A   FB       A            EI
05 0042B   C9       A            RET
05 0042C   3A66FD   N   PRT!CHG  IF!      XBYT,CYCUPCT!,EQ,2         CHECK FOR PROLOG 2 OR CYCLE OUT
   05 0042F   FEC2     A
   05 00431   C23C04   N
05 00434   3E80     A                SFLG     PRT$PR02               YES, SET 'PRINT PROLOG 2' FLAG
   05 00436   3271F4   A
05 00439   C37004   N            OR!F!    XBYT,A,EQ,3                NO, IS CYCLE UP CNTR=3
   05 0043C   FEC3     A
   05 0043E   C27004   N
05 00441   3A71F4   A            AND!F!   FLG,PRT$PR02,T             YES, AND IS PROLOG 2 FLAG SET
   05 00444   07       A
   05 00445   D27004   N
05 00448   AF       A                CFLG     PRT@PR02               YES, DO PROLOG 2 AND CLR FLAG
   05 00449   3271F4   A
                        *
                        *       PRINT STATE BACKGROUND- PROLOG 2
                        *
05 0044C   CD0000   N                CALL     PAP@PRL2               RETN XPORT OFF IF NOT SIDE 1
05 0044F   CD0000   N                CALL     PROG@UP2
05 00452   3AADF4   A                IF!      FLG,IMGMADE1,T         HAS 1ST IMAGE BEEN MADE
   05 00455   07       A
   05 00456   D25C04   N
05 00459   CD0000   N                    CALL     PROG@UP            YES, CALL PROG INITIALIZATION
                                     ENDIF
05 0045C   3A57FA   N                IF!      VBYT,MINIBYTE,NZ       IS MINI-PHYSICAL ACTIVE
   05 0045F   A7       A
   05 00460   CA7004   N
```

```
778   05 00463   AF       A                CFLG      DSPL0IST          YES, ENABLE DISPLAY UPDATE
      05 00464   329AF4   A
779   05 00467   3C       A                INR       A                 DISPLAY QUANTITY
780   05 00468   3250FA   N                STA       DSPL0ST1          COMPLETE
781   05 00468   3E06     A                MVI       A,6               SET DOCUMENT TOTAL TO
782   05 0046D   326FFA   N                STA       DOC0TOTL          6 FOR ADH DOCUMENT CHECK
783                                      ENDIF
784                                  ENDIF

786                            *     END PROLOG2

788                            *
789                            *     BUILD FLAG BYTE
790                            *
791   05 00470   0608     A            MVI       B,8                   NUMBER OF FLAGS REQ'D
792   05 00472   AF       A            XRA       A                     CLEAR A-REG
793   05 00473   57       A            MOV       D,A                   CLEAR D-REG
794   05 00474   21A9F4   A            LXI       H,ADR(FLG,IMED&DN1)   STARTING ADDR OF PRTICHG FLAGS
795                                  REPEAT
796   05 00477   7E       A                MOV       A,M               LOAD A W/CONTENTS OF FLAG ADDR
797   05 00478   07       A                RLC                         ROTATE FLAG(D7) INTO CARRY
798   05 00479   7A       A                MOV       A,D               LOAD A W/FLAGS BILT INTO BYTE
799   05 0047A   17       A                RAL                         PUT FLAG IN DO & SHIFT LEFT
800   05 0047B   57       A                MOV       D,A               SAVE RESULT IN D-REG
801   05 0047C   23       A                INX       H                 STEP TO NEXT FLAG
802   05 0047D   05       A                DCR       B                 DECR NUMBER OF FLAGS REQ'D
803   05 0047E   C27704   N            UNTIL:    CC,Z,S                LOOP UNTIL ALL FLAGS IN BYTE
804                                  ID:READ   IMED&DN1,CYCL&DN1,NORM&DN1,;  FLAGS READ
805                                            QWIK:OUT,IMGMADE1,SD1&TIMO,;
806                                            SD1&DLY,ADH&SELC
807                            *
808                            *     TEST FOR STATE CHANGE TO IRUNN
809                            *
810   05 00481   3A67FD   N            LDA       NO1MGCT1              MOV CURRENT NO IMAGE COUNTER
811   05 00484   5F       A            MOV       E,A                   TO THE E-REG
812   05 00485   060E     A            MVI       B,14                  LOOP CNTR FOR STATE CHG TESTS
813   05 00487   21E104   N            LXI       H,CYC:OUT             TABLE ADDR OF PRTICHG TESTS
814                                  REPEAT
815   05 0048A   7A       A                MOV       A,D               MOV FLAG BYTE TO THE A-REG
816   05 0048B   A6       A                MODBYT    A,AND,M           MASK FOR DESIRED FLAGS
817   05 0048C   23       A                INX       H                 STEP TO STATUS TEST
818   05 0048D   AE       A                MODBYT    A,XOR,M           TEST FLAG STATUS
819   05 0048E   C29F04   N                IF1       CC,Z,S            DID TEST PASS
820   05 00491   23       A                    INX       H             YES, STEP TO NO1MGCT1 TEST
821   05 00492   7B       A                    IF1       XBYT,E,GE,M   IS NO1MGCT1 AT CORRECT VALUE
      05 00493   BE       A
      05 00494   DA9E04   N
822   05 00497   3E05     A                        MVI       A,1RUNN   YES, CHANGE STATE
823   05 00499   3253FD   N                        STA       STATE1    TO RUN NOT PRINT
824   05 0049C   0601     A                        MVI       B,1       FORCE END OF TESTS (EARLY OUT)
825                                          ENDIF
826   05 0049E   2B       A                    DCX       H             ADJ PNTR BACK TO NO IMG TEST
827                                      ENDIF
828   05 0049F   23       A                INX       H                 STEP OVER NO IMG TEST
829   05 004A0   23       A                INX       H                 STEP TO MASK FOR NEXT TEST
830   05 004A1   05       A                DCR       B                 DECR LOOP COUNTER
831   05 004A2   C28A04   N            UNTIL:    CC,Z,S                ALL TESTS COMPLETE OR STATE CHG
832                            *
833   05 004A5   7A       A            MOV       A,D                   MOV FLAG BYTE TO A-REG
834   05 004A6   E662     A            MODBYT    A,AND,D6ID5ID1        MASK AND TEST FOR FLAGS TRUE
835                                  ID:READ   NORM&DN1,CYCL&DN1,SD1&DLY  FROM ABOVE BYTE BUILD
836   05 004A8   CABF04   N            IF:       CC,Z,C                ARE ANY FLAGS TRUE
837   05 004AB   2166FD   A                LXI       H,ADR(DATA,CYCUPCT1)  PREPARE TO TEST OR MODIFY
838   05 004AE   7E       A                IF1       XBYT,M,GF,3       HAS PROG PUSHED IT TO 0
      05 004AF   FE03     A
      05 004B1   DAB604   N
839                                          ID:READ   CYCUPCT1
840   05 004B4   3602     A                  MVI       M,2               NO, FORCE CYCLE-UP MODE AGAIN
841                                          ID:ALTR   CYCUPCT1
842                                      ENDIF
843   05 004B6   CD0000   N                COBIT,S   ILLM&SPL          ILLM SPL OFF DURING DEAD CYCLE
      05 004B9   F2F7     A
844   05 004BB   AF       A                CFLG      SMPL0FLG          CANCEL SAMPLE COPY SEQUENCE
      05 004BC   324CF4   A
845                                  ENDIF
846   05 004BF   C9       A            RET


848                            PRT1IMD  IF1       FLGS,IMED&DN1,AND,;   IS IMEDIATE DOWN REQUESTED
849   05 004C0   3AA9F4   A                        TBLO&FIN,T            AND HAS PROB BEEN DETECTED
      05 004C3   215DF4   A
      05 004C6   A6       A
      05 004C7   F20004   N
850   05 004CA   CD1704   N                CALL      ABORT
851   05 004CD   C3E004   N            ORIF1     FLG,TIMED&DN1,T       IF TIMED DWN REQ'D DROP OUT
      05 004D0   3AA7F4   A
      05 004D3   07       A
      05 004D4   D2F004   N
852   05 004D7   21E1FF   A                COBIT     BTP&LOAD            BIAS TRANS ROLL (ASAP)
      05 004DA   3E7F     A
      05 004DC   F3       A
      05 004DD   A6       A
      05 004DE   77       A
      05 004DF   FB       A
853                                  ENDIF
854   05 004E0   C9       A            RET

856                            *
857                            *                                       D7 6 5 4 3 2 1 0 (X=DONIT CARE)
858                            *
859                            *                TABLE OF FLAG STATUS TESTS   I C N O I S S A   N C
860                            *                 AND NO IMAGE COUNTER VALUES  M Y O W M D D D   O O
861                            *                 USED TO DETERMINE IF STATE   E C R I G 1 1 H     U   T N
862                            *                 SHOULD CHANGE FROM PRINT TO  D L M K M O O O   I N   E U
```

```
863                                 *                RUN NOT PRINT                  O O O I A T D S   M T   S M
864                                 *                                               D D D O D I L E   A E   T B
865                                 *                                               N N N U E M Y L   O R     E
866                                 *                                               : : : T I O   C   E       R
867                                 *
868   05 004E1    48        A   CYC:OUT  DB      D6|D3                            X 1 X X 0 X X X   00      1
869   05 004E2    40        A           DB      D6
870   05 004E3    00        A           DB      0
871   05 004E4    5C        A           DB      D6|D4|D3|D2                      X 1 X 0 1 1 X X   16      2
872   05 004E5    4C        A           DB      D6|D3|D2
873   05 004E6    10        A           DB      16
874   05 004E7    5C        A           DB      D6|D4|D3|D2                      X 1 X 0 1 0 X X   11      3
875   05 004E8    48        A           DB      D6|D3
876   05 004E9    0B        A           DB      11
877   05 004EA    68        A           DB      D6|D5|D3                         X 0 1 X 0 X X X   00      4
878   05 004EB    20        A           DB      D5
879   05 004EC    00        A           DB      0
880   05 004ED    75        A           DB      D6|D5|D4|D2|D0                   X 0 0 0 X 1 X 0   36      5
881   05 004EE    04        A           DB      D2
882   05 004EF    24        A           DB      36
883   05 004F0    75        A           DB      D6|D5|D4|D2|D0                   X 0 0 0 X 1 X 1   20      6
884   05 004F1    05        A           DB      D2|D0
885   05 004F2    14        A           DB      20
886   05 004F3    7D        A           DB      D6|D5|D4|D3|D2|D0                X 0 1 0 1 1 X 0   36      7
887   05 004F4    2C        A           DB      D5|D3|D2
888   05 004F5    24        A           DB      36
889   05 004F6    7D        A           DB      D6|D5|D4|D3|D2|D0                X 0 1 0 1 1 X 1   20      8
890   05 004F7    2D        A           DB      D5|D3|D2|D0
891   05 004F8    14        A           DB      20
892   05 004F9    75        A           DB      D6|D5|D4|D2|D0                   X 0 0 0 X 0 X 0   21      9
893   05 004FA    00        A           DB      0
894   05 004FB    15        A           DB      21
895   05 004FC    7D        A           DB      D6|D5|D4|D3|D2|D0                X 0 1 0 1 0 X 0   21     10
896   05 004FD    28        A           DB      D5|D3
897   05 004FE    15        A           DB      21
898   05 004FF    75        A           DB      D6|D5|D4|D2|D0                   X 0 0 0 X 0 X 1   13     11
899   05 00500    01        A           DB      D0
900   05 00501    0D        A           DB      13
901   05 00502    7D        A           DB      D6|D5|D4|D3|D2|D0                X 0 1 0 1 0 X 1   13     12
902   05 00503    29        A           DB      D5|D3|D0
903   05 00504    0D        A           DB      13
904   05 00505    10        A           DB      D4                               X X X 1 X X X X   11     13
905   05 00506    10        A           DB      D4
906   05 00507    0B        A           DB      11
907   05 00508    80        A           DB      D7                               1 X X X X X X X   00     14
908   05 00509    80        A           DB      D7
909   05 0050A    00        A           DB      0

912                                 *NAR
913                                 *
914                                 *        R U N    N O T    P R I N T    S T A T E
915                                 *
916                                 *        RUN NOT PRINT* EXECUTES WHILE MACHINE IS COMPLETING A COPY RUN.
917                                 *        ENTERED FROM 'PRINT' AND EXITS TO 'NOT READY'.

919                                 *        PROLOG

921   05 0050B    CD0000    N   RUNN:PRL CALL     DO&ELV                          CAUSE ELV TO EXECUTE
922   05 0050E    CD0000    N           STIMR    RUNN:TMR,2500,RUNN&CHG          STAY IN RUNN 2.5 SEC
      05 00511    2F        A
      05 00512    FA        A
      05 00513    7505      N
923   05 00515    CDA901    N           CALL     SB:PNTRS                        SYNC BKG PNTRS TO NEW STATE
924   05 00518    C9        A           RET

926                                 *        CALLS FOR RUN NOT PRINT 10 MS SYN BACKGROUND

928   05 00519    CD0000    N   RUNN10  CALL     ADH&CTRL
929   05 0051C    C9        A           RET

931                                 *        CALLS FOR RUN NOT PRINT 20 MS SYN BACKGROUND

933   05 0051D    0000      N   RUNN20  DW       RUNN&SWS
934   05 0051F    0000      N           DW       SORTER&
935   05 00521    0000      N           DW       SOS&JMOT
936   05 00523    0000      N           DW       FLV&PRNT
937   05 00525    0000      N           DW       LMP&CTRL
938   05 00527    0000      N           DW       PAP&TGL4
939   05 00529    0000      N           DW       DSPL&CTL
940   05 0052B    0000      N           DW       INSTRU
941   05 0052D    FFFF      A           DW       X'FFFF'                         END OF TABLE

943                                 *        CALLS FOR RUN NOT PRINT 100 MS SYN BACKGROUND

945   05 0052F    0000      N   RUNN100 DW       JAM&RST
946   05 00531    0000      N           DW       RILK&CK
947   05 00533    0000      N           DW       FUS&RDUT
948   05 00535    0000      N           DW       PSO&RUN
949   05 00537    0000      N           DW       XMM&PRNT
950   05 00539    0000      N           DW       LITE&OFF
951   05 0053B    0000      N           DW       TST&LP4
952   05 0053D    FF01      N           DW       STAT:CHG                        TEST IF OK TO LEAVE RUN NOT PRT
953   05 0053F    FFFF      A           DW       X'FFFF'                         END OF TABLE

955   05 00541    CD0000    N   RUNN:EPL CALL     DEL&CK                          CALC COPIES DELIVERED
956   05 00544    CD0000    N           CALL     PAP&EPL4                        'RUNNPRT' PAPER PATH MOP UP SUB
957   05 00547    CD0000    N           CALL     MOT&OFF                         TURN OFF SORTER MOTORS
958   05 0054A    CD0000    N           CALL     DO&ELV                          CAUSE ELV TO EXECUTE
959   05 0054D    AF        A           CFLG     AXFD&FLT                        RESET FOR USE DURING NEXT RUN
      05 0054E    323FF4    A
960   05 00551    2123FC    A           CFBIT,P  TF&XMMO                         STOP BLINKING OF XMM 'OTHER'
      05 00554    3EFE      A
      05 00556    A6        A
      05 00557    77        A
961   05 00558    CD0000    N           CBBIT,S  SOS*SMPL
      05 00558    ECFD      A
```

```
05 0055D   CD7805   N            CALL     NV@JAM
05 00560   CD0000   N            CALL     RCP@STRE                    STORE RECAP DATA IN RAM
05 00563   CD0000   N            CALL     ADH@MOTF
05 00566   3E08     A            MVI      A,8
05 00568   3285FA   N            STA      COOLCNT                     SET COUNTER FOR 7 TIMEOUTS
05 0056B   CD0000   N            CALL     PR@FAN
05 0056E   CD0000   N            CALL     FLT@EPL5                    (1)
05 00571   CD0000   N            CALL     HIST@FLE                    (2) LOG HISTORY DATA FOR RUN
05 00574   C9       A            RET                                  (3)

05 00575   2153FD   N   RUNN@CHG LXI      H,STATE!                    SET H&L TO ADDR OF STATE!
05 00578   3602     A            MVI      M,!NRDY                     CHANGE STATE! TO NOT READY
                                !DIALTR  STATE!
05 0057A   C9       A            RET

05 0057B   3A66F4   A   NV@JAM   RFLG     UP@JAM                      LOAD A WITH SRT UPPER JAM FLAG
05 0057E   07       A
                        *                                            & SAVE IT IN THE CARRY BIT
05 0057F   3A36F4   A            LDAFLG   LOW@JAM                     LOAD A WITH SRT LOWER JAM FLAG
05 00582   17       A            RAL                                  & MOVE CARRY &
05 00583   17       A            RAL                                  LOW@JAM INTO THEIR POSITIONS
05 00584   07       A            RLC
05 00585   07       A            RLC
                                 MODBYT   A,AND,MSK(NVBIT,)           MASK FOR DESIRED BITS
05 00586   E60C     A                      NV@LOWEJ,NV@UP@J)
05 00588   47       A            MOV      B,A                         & SAVE IT IN THE B-REG
05 00589   3AA9F4   A            IF!      FLG,IMED@DN!,T              WAS THERE AN IMED ON CONDITION
05 0058C   07       A
05 0058D   D29605   N
05 00590   78       A                MOV       A,B                    YES,RESTORE A-REG
                                    MODBYT    A,OR,MSK(NVBIT,NV@FJAM,) & SET NV JAM BITS
05 00591   F603     A                          NV@IMED)
05 00593   C3A105   N            ELSE!
05 00596   3A3CFD   A                IF!       FBITS,FDR@AJAM,OR,FDR@MJAM,T IS EITHER JAM CONDITION TRUE
05 00599   E60C     A
05 0059B   CA9F05   N
05 0059E   37       A                     STC                        YES,SET CARRY
                                    ENDIF
05 0059F   17       A                RAL                             ROTATE INTO DO
05 005A0   B0       A                MODBYT    A,OR,B                'OR' IN SRT JAM BITS
                                 ENDIF
05 005A1   32C9E2   A            WNVNIB   NV@JAM@N
                                 !DIALTR  NV@FJAM,NV@IMED,NV@LOW@J,NV@UP@J
05 005A4   C9       A            RET                                  RETURN TO STATE CHECKER

                        *NAR
                        *
                        *        T E C H   R E P   S T A T E
                        *
                        *        THE TECH REP STATE IS ENTERED WHEN THE SERVICE KEY IS ON IN
                        *        'NOT READY' & 'READY' STATES. THIS ALLOWS THE TECH REP TO PERFORM SUCH
                        *        TASKS AS ACCESS NON-VOLATILE MEMORY & COMPONENT CONTROL.

                        *
                        *        PROLOG
                        *
05 005A5   CD0000   N   TREP!PRL COBIT,S  WAIT$                       INSURE WAIT OFF AT TREP ENTRANC
05 005A8   E9FE     A
05 005AA   CD0000   N            CALL     DGN@PRL                     DIAGNOSTIC PROLOG
05 005AD   CDA901   N            CALL     SB!PNTRS                    SYNC BKG PNTRS TO NEW STATE
05 005B0   C9       A            RET

                        *        CALLS FOR TECH REP 10MS SYN BACKGROUND

05 005B1   CD0000   N   TREP10   CALL     ADH@CTRL
05 005B4   C9       A            RET

                        *        CALLS FOR TECH REP 20MS SYN BACKGROUND

05 005B5   0000     N   TREP20   DW       TREP@SWS
05 005B7   0000     N            DW       MN@ELVRS
05 005B9   0000     N            DW       LMP@CTRL
05 005BB   0000     N            DW       DSPL@CTL
05 005BD   0000     N            DW       DGN@BKG
05 005BF   0000     N            DW       INSTRU
05 005C1   FFFF     A            DW       X'FFFF'                     END OF TABLE

                        *        CALLS FOR TECH REP 100MS SYN BACKGROUND

05 005C3   0000     N   TREP100  DW       NRILK@CK
05 005C5   0000     N            DW       PSD@STPY
05 005C7   0000     N            DW       XMM@STPY
05 005C9   0000     N            DW       RED@BGND
05 005CB   0000     N            DW       BIN@CHK
05 005CD   0000     N            DW       JAM@RST
05 005CF   0000     N            DW       DVL@DUMP
05 005D1   0000     N            DW       FUS@RDUT
05 005D3   0000     N            DW       TST@LP4
05 005D5   DF05     N            DW       TREP!CHG                    TEST IF OK TO
05 005D7   FF01     N            DW       STATICHG                                LEAVE TREP REP
05 005D9   FFFF     A            DW       X'FFFF'                     END OF TABLE

                        *
                        *        EPILOG  (TECH REP STATE)
                        *
05 005DB   CD0000   N   TREP!EPL CALL     DGN@EPL                     DIAGNOSTIC EPILOG
05 005DE   C9       A            RET

                        *        CHANGE OF STATE CHECK

05 005DF   2153FD   A   TREP!CHG LXI      H,ADR(DATA,STATE!)          PREPARE FOR POSSIBLE STATE CHG
05 005E2   7E       A            IF!      XBYT,M,NE,!COMP             DO NOT CHG STATE IF IN COMP
05 005E3   FE00     A
05 005E5   CAFE05   N
05 005E8   3A49F4   A                IF!       FLG,SER@ACT,T          IF SERVICE KEY IS ON AND IF
05 005EB   07       A
05 005EC   D2FC05   N
```

```
1060   05 005EF   3A20FC   A        ANDIF:   FBIT,DGNOPRTO,F        IN DIAG PRINT PROGRAM
       05 005F2   E6C2     A
       05 005F4   C2FC05   N
1061   05 005F7   3601     A            MVI      M,:TREP            CHG TO TREP STATE
1062   05 005F9   C3FE05   N        ELSE:                           IF KEY IS TURNED OFF
1063   05 005FC   3602     A            MVI      M,:NRDY            CHG TO NOT READY STATE
1064                               ENDIF
1065                               :DIALTR  STATE:
1066                           ENDIF
1067   05 005FE   C9       A       RET
```

TABLE II

```
 96                                *   FIXED PITCH EVENT TABLE
 97                                *
 98                                *   EVENTS MUST BE IN SEQUENTIAL ORDER STARTING
 99                                *   WITH THE EVENT CLOSES TO PITCH RESET FIRST
100                                *
101                                *   THERE CAN BE NO MORE THAN 256 COUNTS BETWEEN EVENTS
102                                *
103                                *   FORMAT OF EVENTS FOR EVENT TABLE
104                                *
105                                *   EVENT     X,Y,Z
106                                *   WHERE:
107                                *   X = ABSOLUTE COUNTS FROM RESET
108                                *   Y = SHIFT REGISTER NEEDED IN EVENT
109                                *   Z = EVENT NAME
110                                *
111                                *
112                                *   PITCH EVENTS
113                                *
114                                    TABLE
115   05 0001E   0200     A           EVENT     2,3,TRN2CURR
      05 00020   03       A
      05 00021   0000     N
116   05 00023   0300     A           EVENT     3,2,ADC0ACT
      05 00025   02       A
      05 00026   0000     N
117   05 00028   0400     A           EVENT     4,3,FDR5AFLT
      05 0002A   03       A
      05 0002B   0000     N
118   05 00020   0700     A           EVENT     7,0,SPLYS00N
      05 0002F   00       A
      05 00030   0000     N
119   05 00032   0800     A           EVENT     8,2,FDR1AXFD
      05 00034   02       A
      05 00035   0000     N
120   05 00037   0A00     A           EVENT     10,3,FUS0LOAD
      05 00039   03       A
      05 0003A   0000     N
121   05 0003C   3000     A           EVENT     48,8,DECG0INV       DECISION GATE FOR INVTD COPIES
      05 0003E   08       A
      05 0003F   0000     N
122   05 00041   3600     A           EVENT     54,5,FUS0NTLD       FUSER LOADED TEST
      05 00043   05       A
      05 00044   0000     N
123   05 00046   5500     A           EVENT     85,3,FDR6MFLT
      05 00048   03       A
      05 00049   0000     N
124   05 0004B   5900     A           EVENT     89,2,FDR2MNFD
      05 0004D   02       A
      05 0004E   0000     N
125   05 00050   5D00     A           EVENT     93,8,JAM6ONON       PAPER PATH JAM SW PITCH EVENT
      05 00052   08       A
      05 00053   0000     N
126   05 00055   7600     A           EVENT     118,9,JAM5OINV      PAPER PATH JAM SW PITCH EVENT
      05 00057   09       A
      05 00058   0000     N
127   05 0005A   7800     A           EVENT     120,0,FSH0OFF
      05 0005C   00       A
      05 0005D   0000     N
128   05 0005F   8700     A           EVENT     135,0,PROGOHST      PROG HISTORY FILE UPDATE
      05 00061   00       A
      05 00062   0000     N
129   05 00064   8F00     A           EVENT     143,6,JAM4OCHK      PAPER PATH JAM SW PITCH EVENT
      05 00066   06       A
      05 00067   0000     N
130   05 00069   AA00     A           EVENT     170,10,RET2OCHK     PAPER PATH JAM SW PITCH EVENT
      05 0006B   0A       A
      05 0006C   0000     N
131   05 0006E   CF00     A           EVENT     207,3,S0S0CLN
      05 00070   03       A
      05 00071   0000     N
132   05 00073   D100     A           EVENT     209,2,TRN5CURR
      05 00075   02       A
      05 00076   0000     N
133   05 00078   E300     A           EVENT     227,5,JAM3OCHK      PAPER PATH JAM SW PITCH EVENT
      05 0007A   05       A
      05 0007B   0000     N
134   05 0007D   0901     A           EVENT     265,2,FDR3AEDG      ENABLE AUX FDR WT SENSOR
      05 0007F   02       A
      05 00080   0000     N
135   05 00082   0B01     A           EVENT     267,4,JAM2OCHK      PAPER PATH JAM SW PITCH EVENT
      05 00084   04       A
      05 00085   0000     N
136   05 00087   0E01     A           EVENT     270,8,RET1OCHK      PAPER PATH JAM SW PITCH EVENT
      05 00089   08       A
      05 0008A   0000     N
137   05 0008C   6901     A           EVENT     361,3,TRN3DTCK
      05 0008E   03       A
      05 0008F   0000     N
```

```
138  05 00091  6C01  A        EVENT    364,2,FDR4MEDG        ENABLE MAIN WT SENSOR
     05 00093  02    A
     05 00094  0000  N
139  05 00096  B901  A        EVENT    441,9,JAM6@INV        PAPER PATH JAM SW PITCH EVENT
     05 00098  09    A
     05 00099  0000  N
140  05 0009B  C201  A        EVENT    450,4,FUS@UNLD
     05 0009D  04    A
     05 0009E  0000  N
141  05 000A0  C301  A        EVENT    451,2,TRN1ROLL
     05 000A2  02    A
     05 000A3  0000  N
142  05 000A5  F401  A        EVENT    500,0,DPM@SMPL
     05 000A7  00    A
     05 000A8  0000  N
143  05 000AA  0E02  A        EVENT    526,3,TRN4DTCK
     05 000AC  03    A
     05 000AD  0000  N
144  05 000AF  1B02  A        EVENT    539,0,DVLV@OFF        TURN OFF VAR DENS DEVELOPERS
     05 000B1  00    A
     05 000B2  0000  N
145  05 000B4  5B02  A        EVENT    600,0,PIL@PLOP        TEST FOR PLATEN OPEN     (BLG)
     05 000B6  00    A
     05 000B7  0000  N
146  05 000B9  7602  A        EVENT    630,5,INVTRCTL        INVTR GATE & RETURN CONTROL
     05 000BB  05    A
     05 000BC  0000  N
147  05 000BE  8A02  A        EVENT    650,6,DECG@NON        DECISION GATE FOR NON-INVTD
     05 000C0  06    A
     05 000C1  0000  N
148  05 000C3  9A02  A        EVENT    666,0,JAM@DLY
     05 000C5  00    A
     05 000C6  0000  N
149  05 000C8  BC02  A        EVENT    700,7,JAM5@NON        PAPER PATH JAM SW PITCH EVENT
     05 000CA  07    A
     05 000CB  0000  N
150  05 000CD  2003  A        EVENT    800,0,PROGMODE
     05 000CF  00    A
     05 000D0  0000  N
151  05 000D2  2203  A        EVENT    802,0,FSH@ENB
     05 000D4  00    A
     05 000D5  0000  N
152  05 00007  5003  A        EVENT    848,0,DVB@VAR         TURN ON VARIABLE-BIAS DEVELOPER
     05 00009  00    A
     05 000DA  0000  N
153  05 000DC  5203  A        EVENT    850,4,SRSK@EV         INIT SRSK & SRT MOTOR
     05 000DE  04    A
     05 000DF  0000  N
154  05 000E1  5403  A        EVENT    852,0,PECOFFEV        TURN OFF POST EXP. COROTRON
     05 000E3  00    A
     05 000E4  0000  N
155  05 000E6  8C03  A        EVENT    908,0,PECONEV         TURN ON POST EXP COROTRON
     05 000E8  00    A
     05 000E9  0000  N
156  05 000EB  8EC3  A        EVENT    910,0,910@EV
     05 000ED  00    A
     05 000EE  0000  N
157  05 000F0  9003  A        EVENT    912,0,DGN@HCNT
     05 000F2  00    A
     05 000F3  0000  N
158  05 000F5  A703  A        EVENT    935,0,OVER@RUN
     05 000F7  00    A
     05 000F8  0000  N
159                           ENDTABLE
```

TABLE III

```
71                            *
72                            *        VARIABLE PITCH EVENT TABLE
73                            *
74        00000001            FLSH@BSE EQU      1
75        00000019            F0@@NBSE EQU      25
76        00000064            F0@@FFBS EQU      100
77   05 00000  0100  A        ROM@FSH  DW       FLSH@BSE
78   05 00002  00    A                 DB       0
79   05 00003  0000  N                 DW       FSH@ON
80   05 00005  6400  A        ROM@OFF  DW       F0@@FFBS
81   05 00007  00    A                 DB       0
82   05 00008  0000  N                 DW       F0@@FF
83   05 0000A  1900  A        ROM@ON   DW       F0@@NBSE
84   05 0000C  00    A                 DB       0
85   05 0000D  0000  N                 DW       F0@@N
86   05 0000F  0100  A        ROM@FSHS DW       FLSH@BSE
87   05 00011  00    A                 DB       0
88   05 00012  0000  N                 DW       FSH@ON@S
89   05 00014  6400  A        ROM@OFFS DW       F0@@FFBS
90   05 00016  00    A                 DB       0
91   05 00017  0000  N                 DW       F0@@FF@S
92   05 00019  1900  A        ROM@ONS  DW       F0@@NBSE
93   05 0001B  00    A                 DB       0
94   05 0001C  0000  N                 DW       F0@@N@S
95                            *
```

TABLE IV

```
161       00000396            BASE@CNT SET      918                    #CLK CNTS/PITCH
162       0000038E            SAFE@CNT SET      910                    MIN # CLK CNTS/PITCH
163                           *
164                           *        PITCH TABLE BUILDER
165                           *
166                           *        BUILD VARIABLE PITCH EVENT TABLE INTO RAM
167                           *        FROM ROM DATA + REDUCTION ADJUST & F0 TRIM
168                           *
169  05 000FA  2A0000  N      TBLD@PRT LHLD     ROM@FSH                H&L= BASE CNT OF FLASH
170  05 000FD  EB      A               XCHG                            D&E= BASE CNT OF FLASH
```

```
171   05 000FE   2A9AFC   N          LHLD    1FLSH@ON          H&L= RED ADJ
172   05 00101   19       A          DAD     D                 H&L= BASE + ADJ
173   05 00102   2244FC   N          SHLD    RAM@FSH           RAM@FSH = BASE + ADJ
174                                 *
175   05 00105   2A0500   N          LHLD    R@M@0FF           H&L= BASE CNT OF F0 0FF
176   05 00108   EB       A          XCHG                      D&E= BASE CNT OF F0 0FF
177   05 00109   2A9CFC   N          LHLD    1F0@0FF           H&L= RED ADJ + TRIM ADJ
178   05 0010C   19       A          DAD     D                 H&L= BASE + ADJ
179   05 0010D   2249FC   N          SHLD    RAM@0FF           RAM@0FF = BASE + ADJ
180                                 *
181   05 00110   2A0A00   N          LHLD    R@M@0N            H&L= BASE CNT OF F0 ON
182   05 00113   EB       A          XCHG                      D&E= BASE CNT OF F0 ON
183   05 00114   2A9EFC   N          LHLD    1F0@0N            H&L= RED ADJ + TRIM ADJ
184   05 00117   19       A          DAD     D                 H&L= BASE + ADJ
185   05 00118   CDEA02   N          CALL    ON@MOD            CALL MOD ROUTINE TO MOD IF<0
186   05 0011B   224EFC   N          SHLD    RAM@ON            RAM@ON = RESULTS OF ABOVE
187                                 *
188   05 0011E   3A31F4   A          IF:     FLG,IMG@SFT,T     IS THERE IMAGE SHIFT
      05 00121   07       A
      05 00122   D25601   N
189   05 00125   3E06     A              MVI     A,6           YES,# OF VAR EVENTS TO USE = 6
190   05 00127   47       A              MOV     B,A           SET UP B-REG FOR LOOP CONTROL
191   05 00128   3262FA   N              STA     TBLD@NUM      STORE # OF VAR EVENTS
192   05 0012B   3D       A              DCR     A             SET UP # OF TIMES TO GO
193   05 0012C   3263FA   N              STA     TBLD@TMP      THRU SORT
194                                 *
195   05 0012F   2A0F00   N              LHLD    R@M@FSHS      UPDATE R@M@FSHS TO
196   05 00132   EB       A              XCHG                  INCLUDE RED MODE ADJ + SHIFT
197   05 00133   2AA0FC   N              LHLD    2FLSH@ON      ADJ AND SAVE FOR THE
198   05 00136   19       A              DAD     D             IMAGE SHIFT
199   05 00137   2253FC   N              SHLD    RAM@FSHS      FLASH EVENT
200                                 *
201   05 0013A   2A1400   N              LHLD    R@M@0FFS      UPDATE R@M@OFFS TO INCLUDE
202   05 0013D   EB       A              XCHG                  RED MODE ADJ + TRIM ADJ +
203   05 0013E   2AA2FC   N              LHLD    2F0@0FF       SHIFT ADJ AND SAVE
204   05 00141   19       A              DAD     D             FOR THE IMAGE SHIFT
205   05 00142   2258FC   N              SHLD    RAM@0FFS      FADE OUT EVENT
206                                 *
207   05 00145   2A1900   N              LHLD    R@M@ONS       UPDATE R@M@ONS TO INCLUDE
208   05 00148   EB       A              XCHG                  RED MODE ADJ + TRIM ADJ +
209   05 00149   2AA4FC   N              LHLD    2F0@ON        SHIFT ADJ
210   05 0014C   19       A              DAD     D
211   05 0014D   CDEA02   N              CALL    ON@MOD        CALL MOD ROUTINE TO MOD IF <0
212   05 00150   225DFC   N              SHLD    RAM@ONS       SAVE THE RESULTS
213                                 *
214   05 00153   C36001   N          ELSE:
215   05 00156   3E03     A              MVI     A,3           IF IMAGE SHIFT NOT SET
216   05 00158   47       A              MOV     B,A           #OF VAR EVENTS TO USE = 3
217   05 00159   3262FA   N              STA     TBLD@NUM      SET UP B-REG FOR LOOP CONTROL
218   05 0015C   3D       A              DCR     A             STORE # OF VAR EVENTS & SETUP
219   05 0015D   3263FA   N              STA     TBLD@TMP      #OF TIMES TO GO THRU SORT
220                                 *   ENDIF
221                                 *
440                                 *
441                                 *   SUBROUTINE TO DETERMINE IF MODIFIED F0 ON EVENT
442                                 *   CLK COUNT IF CLK COUNT RESULTS ARE NEGATIVE OR 0
443                                 *
444   05 002EA   7C       A  ON@MOD   MOV     A,H               A= MS PART OF ABS CLK COUNT
445   05 002EB   07       A          RLC                       CARRY= SIGN OF ABS CLK COUNT
446   05 002EC   D20203   N          IF:     CC,C,S            IS THE ABS CLK CNT NEG
447   05 002EF   119603   A              LXI     D,BASE@CNT    YES,ADD # CLK COUNTS PER PITCH
448   05 002F2   19       A              DAD     D             TO NEG #
449   05 002F3   118E03   A              IF:     XWRD,H,GE,SAFE@CNT  IS RESULTS GE SAFE # CLK/PITCH
      05 002F6   C00000   N
      05 002F9   DAFF02   N
450   05 002FC   210100   A                  LXI     H,1       YES,MOVE TO TURN ON LATER
451                                         ENDIF
452   05 002FF   C30E03   N          ORIF:   XWRD,H,EQ,0       IF RESULTS = 0, MOVE LATER IN
      05 00302   110000   A
      05 00305   CD0000   N
      05 00308   C20E03   N
453   05 00308   210100   A              LXI     H,1           PITCH BECUASE FVENT MUST BE > 0
454                                 *   ENDIF
455   05 0030E   C9       A          RET
456                                 *   END

CONTROL SECTION SUMMARY: 01 00000   PT 0   02 00000   PT 0   03 00000   PT 0   04 0FFD8   PT 2
                         05 0030F   PT 1
* NO UNDEFINED SYMBOLS
*    ERROR SEVERITY LEVEL: 0
* NO ERROR LINES
```

TABLE V

```
252                                 *
253                                 *   SORTS VARIABLE RAM EVENT TABLE BY
254                                 *   ABS CLK COUNT & LOWEST ENDS IN EVORAM
255                                 *
256                                 *   SORTS ONLY 1ST 3 IF NO IMAGE SHIFT, OTHERWISE SORTS ALL 6
257                                 *
258   05 0017E   2144FC   N          LXI     H,EVORAM          H&L= ADDR OF TOP OF VAR RAM TBL
259   05 00181   3A63FA   N          WHILE:  XBYT,TBLD@TMP,NE,0  TIMES TO GO THPU OUTER LOOP
      05 00184   FE00     A
      05 00186   CAFD01   N
260   05 00189   3253FA   N              STA     IN@LP@CT      INTER LOOP CNT=OUTER LOOP CNT
261   05 0018C   3E80     A              SFLG    TBLD@1ST      SET 1ST FLAG FOR THIS POSITION
      05 0018E   325EF4   A
262   05 00191   2252FB   N              SHLD    FIX@ADDR      ADDR OF POSITION TO FULL
263   05 00194   B7       A              ORA     A             CLEAR Z CONDITION BIT
264   05 00195   CAEF01   N              WHILE:  CC,Z,C
265   05 00198   5E       A                  MOV     E,M       E= LS PART OF ABS CLK COUNT
266   05 00199   23       A                  INX     H
267   05 0019A   56       A                  MOV     D,M       D= MS PART OF ABS CLK COUNT
268   05 0019B   D5       A                  PUSH    D         STORE ABS CLK CNT OF FILL POS
269   05 0019C   3A5EF4   A                  IF:     FLG,TBLD@1ST,T  IS IT 1ST TIME FOR THIS POS
```

```
     05 0019F   07       A
     05 001A0   D2AE01   N
270  05 001A3   AF       A              CFLG      TBLD@1ST        YES, CLEAR ITS FLAG
     05 001A4   325EF4   A
271  05 001A7   23       A              INX       H               AND INCREMENT
272  05 001A8   23       A              INX       H               POINTER TO LS PART OF
273  05 001A9   23       A              INX       H               ABS CLK COUNT OF NEXT
274  05 001AA   23       A              INX       H               EVENT
275  05 001AB   C3B601   N          ELSE:
276  05 001AE   2A5CFB   N              LHLD      VAR@ADDR        H&L= ADDR
277  05 001B1   23       A              INX       H               OF LS PART OF
278  05 001B2   23       A              INX       H               ABS CLK COUNT TO
279  05 001B3   23       A              INX       H               COMPARE TO FILL
280  05 001B4   23       A              INX       H               POSITION
281  05 001B5   23       A              INX       H
282                             ENDIF
283  05 001B6   225CFB   N      SHLD      VAR@ADDR                STORE POINTER TO COMPARE EVENT
284  05 001B9   5E       A      MOV       E,M                     E= LS PART OF COMPARE ABS CLK
285  05 001BA   23       A      INX       H
286  05 001BB   56       A      MOV       D,M                     D= MS PART OF COMPARE ABS CLK
287  05 001BC   E1       A      POP       H                       H&L= ABS CLK COUNT OF FILL POS
288  05 001BD   EB       A      IF:       XWRD,D,LT,H             IS CLK OF COMPARE < FILL
     05 001BE   CD0000   N
     05 001C1   D2E501   N
289  05 001C4   2A5CFB   N              LHLD      VAR@ADDR        YES, SWITCH THE 2 EVENTS
290  05 001C7   EB       A              XCHG                      D&E= ADDR LOWER CLK VALUE
291  05 001C8   2A52FB   N              LHLD      FIX@ADDR        H&L= ADDR LARGER CLK VALUE
292  05 001CB   3EFB     A              MVI       A,-5            INITIALIZE LOOP COUNTER TO 5
293  05 001CD   3265FA   N              STA       TSW@NUM         WHICH = # OF ITEMS TO MOVE
294  05 001D0   B7       A              ORA       A               CLEAR Z CONDITION BIT
295  05 001D1   CAE501   N          WHILE:    CC,Z,C
296  05 001D4   1A       A                  LDAX      D           A= CONTAINS OF COMPARE EVENT
297  05 001D5   46       A                  MOV       B,M         B= CONTAINS OF FILL EVENT
298  05 001D6   77       A                  MOV       M,A         UPDATE FILL POS
299  05 001D7   78       A                  MOV       A,B         UPDATE COMPARE POS
300  05 001D8   12       A                  STAX      D           WITH NEW VALUE
301  05 001D9   13       A                  INX       D           MOVE POINTERS TO
302  05 001DA   23       A                  INX       H           NEXT ITEM
303  05 001DB   3A65FA   N                  LDA       TSW@NUM     INC MOVE
304  05 001DE   3C       A                  INR       A           LOOP CONTROL
305  05 001DF   3265FA   N                  STA       TSW@NUM     COUNTER
306  05 001E2   C3D101   N              ENDWHILE
307                             ENDIF
308  05 001E5   2153FA   N      DECBYT    IN@LP@CT                DECRM INNER LOOP CNTR
     05 001E8   35       A
309  05 001E9   2A52FB   N      LHLD      FIX@ADDR                H&L= ADDR OF FILL POSITION
310  05 001EC   C39501   N  ENDWHILE
311  05 001EF   110500   A  LXI       D,5                       MOVE H&L TO LOOK AT NEXT EVENT
312  05 001F2   19       A  DAD       D                         POSITION TO FILL
313  05 001F3   3A63FA   N  LDA       TBLD@TMP                  DECREMENT # OF EVENTS
314  05 001F6   3D       A  DCR       A                         TO SORT
315  05 001F7   3263FA   N  STA       TBLD@TMP
316  05 001FA   C38101   N ENDWHILE
```

TABLE VI

```
223                                 *
224                                 *   MOVE THE SR# & EVENT ADDR FROM ROM TABLE
225                                 *   TO RAM TABLE.  MOVES ONLY THE FIRST 3 IF
226                                 *   NO IMAGE SHIFT, OTHERWISE MOVES ALL 6
227                                 *
228  05 00160   1144FC   N   LXI       D,RAM@FSH                 D&E = ADDR OF RAM TABLE
229  05 00163   210000   N   LXI       H,ROM@FSH                 H&L = ADDR OF ROM TABLE
230  05 00166   B0       A   ORA       B                         CLEAR Z CONDITION BIT
231  05 00167   CA7E01   N   WHILE:    CC,Z,C
232  05 0016A   23       A       INX       H                     INCREMENT H&L AND D&E
233  05 0016B   23       A       INX       H                     POINTERS OVER THE
234  05 0016C   13       A       INX       D                     ABS CLK COUNT
235  05 0016D   13       A       INX       D
236  05 0016E   7E       A       MOV       A,M                   LOAD A WITH SR#
237  05 0016F   12       A       STAX      D                     STORE SR# IN RAM TABLE
238  05 00170   23       A       INX       H                     MOVE POINTERS TO LS
239  05 00171   13       A       INX       D                     ADDR OF EVENT
240  05 00172   7E       A       MOV       A,M                   LOAD A WITH LS ADDR OF EVENT
241  05 00173   12       A       STAX      D                     & STORE IT IN RAM TABLE
242  05 00174   23       A       INX       H                     MOVE POINTERS TO MS
243  05 00175   13       A       INX       D                     ADDR OF EVENT
244  05 00176   7E       A       MOV       A,M                   MOVE MS ADDR OF EVENT
245  05 00177   12       A       STAX      D                     TO RAM
246  05 00178   23       A       INX       H                     MOVES POINTERS TO
247  05 00179   13       A       INX       D                     LS PART OF ABS CLK COUNT
248  05 0017A   05       A       DCR       B                     DECREMENT LOOP COUNTER
249  05 0017B   C36701   N   ENDWHILE
250                                 *
```

TABLE VII

```
318                                 *
319                                 *   MERGE VARIABLE PITCH EVENT TABLE & FIXED EVENT
320                                 *   TABLE CALCULATING THE REL DIFFERENCE WITH THE
321                                 *   RESULTS GOING INTO THE RUN EVENT TABLE
322                                 *
323  05 001FD   2A44FC   N   LHLD      EV@RAM                    INITIALIZE VAR@CLK TO ABS CLK
324  05 00200   225EFB   N   SHLD      VAR@CLK                   COUNT OF 1ST VAR PITCH EVENT
325  05 00203   2144FC   N   LXI       H,EV@RAM                  INITIALIZE VAR@ADDR TO ADDR OF
326  05 00206   225CFB   N   SHLD      VAR@ADDR                  1ST VAR PITCH EVENT
327  05 00209   211E00   N   LXI       H,EV@ROM                  INITIALIZE FIX@ADDR TO ADDR OF
328  05 0020C   2252FB   N   SHLD      FIX@ADDR                  1ST FIXED PITCH EVENT
329  05 0020F   3E80     A   SFLG      TBLD@1ST                  NOTES 1ST EVENT TO RUN TABLE
     05 00211   325EF4   A
330  05 00214   3E2C     A   MVI       A,TABLENUM                INITIALIZE TSW@NUM TO # OF
331  05 00216   3265FA   N   STA       TSW@NUM                   EVENTS IN FIXED PITCH TABLE
332  05 00219   2A1E00   N   LHLD      FV@ROM                    INITIALIZE D&E WITH ABS CLOCK
333  05 0021C   EB       A   XCHG                                COUNT OF 1ST FIXED EVENT
334  05 0021D   AF       A   CFLG      VAR@DONE                  FLAG DENOTES VAR EVENTS
```

```
     05 0021E   3259F4  A
335  05 00221   3A59F4  A          WHILE:   FLG,VAR@DONE,F          WHILE THERE ARE MORE VAR EVENTS
     05 00224   07      A
     05 00225   DA6F02  N
336  05 00228   2A5EFB  N              IF:      XWRD,VAR@CLK,LE,D    IS VAR CLK CNT <= FIXED CLK CNT
     05 0022B   CD0000  N
     05 0022E   DA3402  N
     05 00231   C25902  N
337  05 00234   2A5CFB  N                  LHLD     VAR@ADDR         YES, H&L= VAR EVENT ADDR
338  05 00237   CD9302  N                  CALL     TBLD@UPD         PLACE VAR EVENT AT END RUN TBL
339  05 0023A   3A62FA  N                  LDA      TBLD@NUM         DECREMENT # OF
340  05 0023D   3D      A                  DCR      A                VARIABLE EVENTS LEFT
341  05 0023E   3262FA  N                  STA      TBLD@NUM         TO MERGE
342  05 00241   C24C02  N                  IF:      CC,Z,S           DID TBLD@NUM GO TO 0
343  05 00244   3E80    A                      SFLG     VAR@DONE     YES,DENOTE NO MORE VAR EVENTS
     05 00246   3259F4  A
344  05 00249   C35602  N                  ELSE:
345  05 0024C   225CFB  N                      SHLD     VAR@ADDR     STORE ADDR OF NEXT VAR EVENT
346  05 0024F   5E      A                      MOV      E,M          UPDATE VAR@CLK TO
347  05 00250   23      A                      INX      H            VALUE OF ABS CLK COUNT
348  05 00251   56      A                      MOV      D,M          OF PRESENT VARIABLE
349  05 00252   EB      A                      XCHG                  EVENT
350  05 00253   225EFB  N                      SHLD     VAR@CLK
351                                       ENDIF
352  05 00256   C36602  N              ELSE:
353  05 00259   2A52FB  N                  LHLD     FIX@ADDR         IF FIXED TABLE CLK COUNT IS
354  05 0025C   CD9302  N                  CALL     TBLD@UPD         LESS THEN VAR TABLE UPDATE THE
355  05 0025F   2252FB  N                  SHLD     FIX@ADDR         RUN TABLE WITH THAT EVENT
356  05 00262   2165FA  N                  LXI      H,TSW@NUM        UPDATE TO NEXT FIXED EVENT
357  05 00265   35      A                  DCR      M                DECREMENT # OF FIXED EVENTS
358                                       ENDIF                     LEFT
359  05 00266   2A52FB  N              LHLD     FIX@ADDR
360  05 00269   5E      A              MOV      E,M                  UPDATE D&L TO =
361  05 0026A   23      A              INX      H                    ABS CLK CNT VALUE
362  05 0026B   56      A              MOV      D,M                  OF PRESENT FIXED TABLE
363  05 0026C   C32102  N          ENDWHILE
364  05 0026F   3EFF    A          MVI      A,X'FF'                  CLEAR Z CONDITION
365  05 00271   B7      A          ORA      A                        BIT FOR LOOP
366  05 00272   2A52FB  N          LHLD     FIX@ADDR                 NO MORE VAR EVENTS, USE FIXED
367  05 00275   CA8402  N          WHILE:   CC,Z,C                   DONE WITH FIXED TABLE
368  05 00278   CD9302  N              CALL     TBLD@UPD             NO,UPDATE RUN TABLE
369  05 0027B   EB      A              XCHG                          SAVE H&L IN D&E
370  05 0027C   2165FA  N              LXI      H,TSW@NUM            DECREMENT # OF FIXED
371  05 0027F   35      A              DCR      M                    EVENTS LEFT
372  05 00280   EB      A              XCHG                          RESTORE H&L
373  05 00281   C37502  N          ENDWHILE
374  05 00284   2A58FB  N          LHLD     P@TBL@A                  H&L=ADDR OF LAST MS ADDR IN RUN
375  05 00287   2B      A          DCX      H                        MOVE H&L POINTER BACK TO POINT
376  05 00288   2B      A          DCX      H                        AT THE BEGINNING OF THE LAST
377  05 00289   2B      A          DCX      H                        EVENT (OVER@RUN) & STORE IT
378  05 0028A   2264FD  N          SHLD     EV@PTR:                  FOR MACH CLK INTERRUPT HANDLER
379  05 0028D   3E80    A          SFLG     TBLD@FIN                 DENOTES PITCH TABLE IS COMPLETE
     05 0028F   325DF4  A
380  05 00292   C9      A          RET
382                                 *
383                                 *        SUBROUTINE TO CALCULATE REL DIFFERENCE BETWEEN
384                                 *        2 EVENTS & MOVE REST OF TABLE TO RUN TABLE
385                                 *
386  05 00293   3A5EF4  A  TBLD@UPD IF:      FLG,TBLD@1ST,T           THIS IS THE FIRST EVENT
     05 00296   07      A
     05 00297   D2AF02  N
387  05 0029A   AF      A              CFLG     TBLD@1ST             YES, CLR FLAG TO KEEP OUT
     05 0029B   325EF4  A
388  05 0029E   7E      A              MOV      A,M                  A= LS OF 1ST EVENT ABS CLK CNT
389  05 0029F   3251FA  N              STA      EV@1@TIM             USED AT PITCH RESET
390  05 002A2   5F      A              MOV      E,A                  E=LS OF 1ST EVENT ABS CLK CNT
391  05 002A3   23      A              INX      H                    H&L=ADDR OF MS ABS CLK CNT
392  05 002A4   56      A              MOV      D,M                  D=MS OF 1ST EVENT ABS CLK CNT
393  05 002A5   EB      A              XCHG                          D&E= ADDR OF MS ABS CLK CNT
394  05 002A6   2256FB  N              SHLD     LCLK@CNT             STORE ABS CLK OF 1ST EVENT
395  05 002A9   21E8FE  N              LXI      H,EV@BASE:           H&L = ADDR OF RUN TABLE
396  05 002AC   C3D802  N          ELSE:
397  05 002AF   5E      A              MOV      E,M                  E=LS CLK CNT OF NEW EVENT
398  05 002B0   23      A              INX      H                    H&L= ADDR OF MS ABS CLK CNT
399  05 002B1   56      A              MOV      D,M                  D=MS CLK CNT OF NEW EVENT
400  05 002B2   E5      A              PUSH     H                    SAVE ADDR OF MS ABS CLK CNT
401  05 002B3   2A56FB  N              IF:      XWRD,LCLK@CNT,GE,D   IS LAST CLK CNT GE NEW CLK CNT
     05 002B6   CD0000  N
     05 002B9   DAC502  N
402  05 002BC   23      A                  INX      H                H&L= LAST CLK CNT + 1
403  05 002BD   2256FB  N                  SHLD     LCLK@CNT         STORE IT FOR NEXT TIME
404  05 002C0   3E01    A                  MVI      A,1              PUT THIS EVENT AT THE NEXT CLK
405  05 002C2   C3CC02  N              ELSE:
406  05 002C5   45      A                  MOV      B,L              B=LS CLK CNT OF LAST EVENT
407  05 002C6   EB      A                  XCHG                      H&L=ABS CLK CNT OF NEW EVENT
408  05 002C7   2256FB  N                  SHLD     LCLK@CNT         STORE IT FOR THE NEXT TIME
409  05 002CA   7D      A                  MOV      A,L              A=LS CLK CNT OF NEW EVENT
410  05 002CB   90      A                  SUB      B                FIND DIFF (ONLY NEED LS IF CLK
411                                       ENDIF                     CNTS BETWEEN EVENTS <256)
412  05 002CC   D1      A              POP      D                    D&E=ADDR OF MS OF CLK OF NEW EV
413  05 002CD   2A58FB  N              LHLD     P@TBL@A              H&L= ADDR OF END OF LAST RUN EV
414  05 002D0   2B      A              DCX      H                    MOVE H&L POINTER
415  05 002D1   2B      A              DCX      H                    TO REL DIFF OF LAST
416  05 002D2   2B      A              DCX      H                    EVENT IN RUN TABLE
417  05 002D3   77      A              MOV      M,A                  MOVE REL DIFF TO RUN TABLE
418  05 002D4   23      A              INX      H                    INCREMENT RUN TABLE
419  05 002D5   23      A              INX      H                    POINTER OVER LAST
420  05 002D6   23      A              INX      H                    EVENT
421  05 002D7   23      A              INX      H
422                                 ENDIF
423  05 002D8   23      A          INX      H                        H&L= ADDR OF SR# IN RUN TABLE
424  05 002D9   13      A          INX      D                        D&E= ADDR OF SR#
425  05 002DA   1A      A          LDAX     D                        MOVE SR# FROM TABLE TO
426  05 002DB   77      A          MOV      M,A                      RUN TABLE
427  05 002DC   23      A          INX      H                        MOVE POINTERS TO LS 8 BITS
```

```
428   05 002DD   13        A          INX     D                      OF EVENT ADDR
429   05 002DE   1A        A          LDAX    D                      MOVE LS 8 BITS OF ADDR
430   05 002DF   77        A          MOV     M,A
431   05 002E0   23        A          INX     H                      MOVES POINTER TO MS 8 BITS
432   05 002E1   13        A          INX     D                      OF EVENT ADDR
433   05 002E2   1A        A          LDAX    D                      MOVES MS 8 BITS OF ADDR
434   05 002E3   77        A          MOV     M,A
435   05 002E4   2258FB    N          SHLD    PATBLOA                STORE ADDR OF RUN TABLE
436   05 002E7   13        A          INX     D                      POINTER TO LS 8 BITS OF CLK CNT
437   05 002E8   EB        A          XCHG                           HL= ADDR OF LS 8 BITS OF CLK
438   05 002E9   C9        A          RET

440                                  *
441                                  *        SUBROUTINE TO DETERMINE IF MODIFIED FO ON EVENT
442                                  *        CLK COUNT IF CLK COUNT RESULTS ARE NEGATIVE OR 0
443                                  *
444   05 002EA   7C        A   ONOMOD MOV     A,H                    A= MS PART OF ABS CLK COUNT
445   05 002EB   07        A          RLC                            CARRY= SIGN OF ABS CLK COUNT
446   05 002EC   D20203    N          IF:     CC,C,S                 IS THE ABS CLK CNT NEG
447   05 002EF   119603    A              LXI     D,BASEOCNT         YES,ADD # CLK COUNTS PER PITCH
448   05 002F2   19        A              DAD     D                  TO NEG #
449   05 002F3   118E03    A              IF:     XWRD,H,GE,SAFEOCNT IS RESULTS GE SAFE # CLK/PITCH
      05 002F6   CD0000    N
      05 002F9   DAFF02    N
450   05 002FC   210100    A                  LXI     H,1            YES,MOVE TO TURN ON LATER
451                                     ENDIF
452   05 002FF   C30E03    N          ORIF:   XWRD,H,EQ,0            IF RESULTS = 0, MOVE LATER IN
      05 00302   110000    A
      05 00305   CD0000    N
      05 00308   C20E03    N
453   05 0030B   210100    A              LXI     H,1                PITCH BECUASE EVENT MUST BE > 0
454                                  ENDIF
455   05 0030E   C9        A          RET
456                                  END

CONTROL SECTION SUMMARY: 01 00000   PT 0   02 00000   PT 0   03 00000   PT 0   04 0FFD8   PT 2
                         05 0030F   PT 1
* NO UNDEFINED SYMBOLS
*   ERROR SEVERITY LEVEL: 0
* NO ERROR LINES
```

TABLE VIII

```
219                                  *
220                                  * PITCH RESET INTERRUPT HANDLER
221                                  *

223   06 000F9   FB        A   RSET:  EI                             RE-ENABLE INTERRUPTS
224   06 000FA   F5        A          PUSH    PSW                    SAVE A-REG & CONDITION BITS
225   06 000FB   3A5DF4    A          IF:     FLG,TBLDOFIN,T         IS PITCH TABLE BUILD FINISHED
      06 000FE   07        A
      06 000FF   D26201    N
226   06 00102   E5        A              PUSH    H                  SAVE H&L
227                                     IF:     FLGS,SROONE,;      YES, IS THERE A NEW SR VALUE
228   06 00103   3A4DF4    A                      AND,910ODONE,T     YES, DID 910 EVENT GET DONE
      06 00106   216FF4    A
      06 00109   A6        A
      06 0010A   F25501    N
229   06 0010D   AF        A                  CFLG    910ODONE       YES, RESET & MACH CLK TIMING OK
      06 0010E   326FF4    A
230   06 00111   324DF4    A                  MODFLG  SROONE         CLR FLAG UNTIL NEXT SR EVENT
231   06 00114   2163FD    A                  LXI     H,ADR(DATA,SROPTR!)  LOAD RELATIVE
232   06 00117   7E        A                  MOV     A,M                  PNTR TO SR #0
233   06 00118   C60F      A                  MODBYT  A,ADD,15       MOVE PNTR BACK
234   06 0011A   E66F      A                  MODBYT  A,AND,SROADJ!                BY 1 (CIRCULAR)
235   06 0011C   77        A                  MOV     M,A            SAVE NEW REL SR PNTR IN SROPTR!
236   06 0011D   26FE      A                  MVI     H,HADR(DATA,SHIFTREG) HL= ABS ADDR
237   06 0011F   6F        A                  MOV     L,A                  OF SR #0
238   06 00120   3A69FD    A                  LDA     ADR(DATA,SROVALU!)  A= NEW SR VALUF FROM SRSK
239   06 00123   77        A                  MOV     M,A            UPDATE CONTENTS OF SR#0
240   06 00124   3A51FA    A                  LDA     ADR(DATA,EV01OTIM)  INIT MCLK1CNT
241   06 00127   326EFD    A                  STA     ADR(DATA,MCLK:CNT)   TO 1ST EVENT TIME
242   06 0012A   21E8FE    A                  LXI     H,ADR(DATA,EVOBASE!) INIT EVOPTR!
243   06 0012D   2264FD    A                  SHLD    ADR(DATA,EVOPTR!)    TO 1ST EVENT ADDR
244                                           IF:     FLGS,NORMODN:,;    IS NORMAL SHUTDOWN REQUESTED
245                                                   AND,CYCLODN!,;     NO, IS CYCLE-DOWN REQUESTED
246   06 00130   3AABF4    A                          AND,SD1ODLY,F      NO, IS PROC DEAD CYCLING
      06 00133   21AAF4    A
      06 00136   B6        A
      06 00137   21AFF4    A
      06 0013A   B6        A
      06 0013B   FA5201    N
247   06 0013E   2166FD    A                      LXI     H,ADR(DATA,CYCUPCT!) NO, LOAD CYCLE-UP CNTR
248   06 00141   7E        A                      IF:     XBYT,M,NE,5        IS PROC IN CYCLE-UP MODE
      06 00142   FE05      A
      06 00144   CA5201    N
249   06 00147   FE04      A                          IF!     XBYT,A,EQ,4    YES, IS IT RDY TO MAKE 1ST IMG
      06 00149   C25101    N
250   06 0014C   3E80      A                              SFLG    IMGMADE!   YES, SIGNAL 1ST IMAGE MADE
      06 0014E   32ADF4    A
251                                                 ENDIF
252   06 00151   34        A                          INR     M          INCRM CYCLE-UP CNTR (UNTIL= 5)
253                                             ENDIF
254                                         ENDIF
255   06 00152   C36101    N                  ELSE:                      NEW SR VALUE NOT AVAILABLE
256   06 00155   3E80      A                      SFLG    IMEDODN!       REQUEST AN IMED SHUTDOWN
      06 00157   32A9F4    A
257   06 0015A   2132FD    A                      SFBIT,P   EOPROFLT     SIGNAL EARLY PITCH RESET FAULT
      06 0015D   3E40      A
      06 0015F   B6        A
      06 00160   77        A
258                                         ENDIF
259   06 00161   E1        A                  POP     H                  RESTORE H&L
260                                     ENDIF
261   06 00162   3EFE      A          MVI     A,RSETFF!                  RESET PITCH RESET
262   06 00164   3200E6    A          STA     ADR(EQU,RSINTFF!)                  INT FLIP-FLOP
```

```
263   06 00167   F1      A          POP     PSW                 RESTORE A-REG & CONDITION BITS
264   06 00168   C9      A          RET                         RETURN TO INTERRUPTED ROUTINE
```

TABLE IX

```
57                                  *
58                                  * MACHINE CLOCK INTERRUPT HANDLER
59                                  *

61          06 0002B                ORIGIN  X'38'               INTERRUPT TRAP CELL LOCATION

64   06 00038   F5      A   MCLK:   PUSH    PSW                 SAVE A-REG & CONDITION CODES
65   06 00039   3A6EFD  A          LDA     ADR(DATA,MCLK:CNT)  IS THERE
66   06 0003C   3D      A          DCR     A                          A PITCH
67   06 0003D   C26600  N          IF:     CC,Z,S                          EVENT TO DO
68   06 00040   E5      A              PUSH    H               YES, SAVE
69   06 00041   D5      A              PUSH    D                        ALL REMAINING
70   06 00042   C5      A              PUSH    B                                REGS
71   06 00043   2A64FD  A              LHLD    ADR(DATA,EVOPTR1)   H&L= 1ST LOC OF NEXT PE TO DO
72   06 00046   7E      A              MOV     A,M                 SAVE RELATIVE DIFFERENTIAL TO
73   06 00047   326EFD  A              STA     ADR(DATA,MCLK:CNT)   NEXT EVENT (# CLOCK COUNTS)
74   06 0004A   23      A              INX     H                   MOVE PNTR TO REL SR IN TABLE
75   06 0004B   3A63FD  A              LDA     ADR(DATA,SROPTR1)   LOAD REL POSITION OF SR #0
76   06 0004E   86      A              MODBYT  A,ADD,M             C= LS PORTION OF ADDR OF THE
77   06 0004F   E66F    A              MODBYT  A,AND,SROADJ1        REQUESTED SHIFT REGISTER
78   06 00051   4F      A              MOV     C,A                  POSITION (FOR USE WITHIN PE)
79   06 00052   06FE    A              MVI     B,HADR(SHIFTREG)    B&C= ADDR REQUESTED SR POSITION
80   06 00054   0A      A              LDAX    B                   A= <REQUESTED SR POSITION>
81   06 00055   23      A              INX     H                   E= LS PORTION OF ADDR OF THE
82   06 00056   5E      A              MOV     E,M                  REQUESTED PITCH EVENT
83   06 00057   23      A              INX     H                   D= MS PORTION OF ADDR OF THE
84   06 00058   56      A              MOV     D,M                  REQUESTED PITCH EVENT
85   06 00059   23      A              INX     H                   SAVE PNTR TO
86   06 0005A   2264FD  A              SHLD    ADR(DATA,EVOPTR1)          NEXT PITCH EVENT
87   06 0005D   CD0000  N              CALL    DE:IND              VECTOR TO REQUESTED PITCH EVENT
88   06 00060   C1      A              POP     B                   RESTORE
89   06 00061   D1      A              POP     D                          SAVED
90   06 00062   E1      A              POP     H                                REGISTERS
91   06 00063   C37000  N          ELSE:
92   06 00066   326EFD  A              STA     ADR(DATA,MCLK:CNT)  NO PE; SAVE DECRMT'D 'MCLK:CNT'
93   06 00069   0F      A              RRC                         IS IT TIME FOR
94   06 0006A   D27000  N              IF:     CC,C,S                      A REFRESH
95   06 0006D   3202E6  A                  REFRESH                 YES, REFRESH REMOTES (1 MSEC)
96                                     ENDIF
97                                 ENDIF
98   06 00070   FB      A          EI                              RE-ENABLE INTERRUPT SYSTEM
99   06 00071   3EFD    A          MVI     A,MCLKFF:               RESET MCLK
100  06 00073   3200E6  A          STA     ADR(EQU,RSINTFF:)            INTERRUPT FLIP-FLOP
101  06 00076   F1      A          POP     PSW                     RESTORE A-REG & CONDITION CODES
102  06 00077   C9      A          RET                             RETURN TO INTERRUPTED ROUTINE
```

TABLE X

```
139                                 *
140                                 * REAL TIME CLOCK INTERRUPT HANDLER
141                                 *

143  06 00081   FB      A   RTC:    EI                              RE-ENABLE INTERRUPTS
144  06 00082   F5      A          PUSH    PSW                     SAVE A-REG & CONDITION BITS
145  06 00083   3EF7    A          MVI     A,RTCFF:                RESET RTC
146  06 00085   3200E6  A          STA     ADR(EQU,RSINTFF:)            INTERRUPT FLIP-FLOP
147  06 00088   D5      A          PUSH    D                       SAVE D&E REGS
148  06 00089   E5      A          PUSH    H                       SAVE H&L REGS
149  06 0008A   C5      A          PUSH    B                       SAVE 'B' REGISTER
150                                 *
151  06 0008B   2150FD  N          DECBYT  GLBITIMR                DECREMENT THE CLOCK CELL
     06 0008E   35      A
152  06 0008F   7E      A          MOV     A,M                     A = <GLBITIMR>  ( 0 TO 255 )
153  06 00090   23      A          INX     H                       MEM. PTR. TO SR:ROST BYTE
154  06 00091   E601    A          IF:     XBYT,A,AND,X'01',NZ     IS IT 20 MSEC TIME YET
     06 00093   CA9D00  N
155  06 00096   7E      A              MODBYT  M,OR,10:ROST:20:ROST YES - BOTH 10 AND 20 BKGD
     06 00097   F6C0    A
     06 00099   77      A
156  06 0009A   C3A100  N          ELSE:
157  06 0009D   7E      A              MODBYT  M,OR,10:ROST        NO - 10 BKGD ONLY
     06 0009E   F680    A
     06 000A0   77      A
158                                 ENDIF
159  06 000A1   23      A          INX     H                       MEM. PTR. TO DIVD:10 CNTR
160  06 000A2   35      A          DCR     M                       DECREMENT 10 TO 0 COUNTER
161  06 000A3   C2AD00  N          IF:     CC,Z,S                  HAS 100 MSEC PASSED
162  06 000A6   360A    A              MVI     M,10                YES - RESET THE 10 TO 0 COUNTER
163  06 000A8   2B      A              DCX     H                   MEM. PTR. BACK TO SB:ROST
164  06 000A9   7E      A              MODBYT  M,OR,100:ROST       ADD 100 BKGD TO REQUEST BYTE
     06 000AA   F620    A
     06 000AC   77      A
165                                 ENDIF
166                                 REPEAT
167  06 000AD   2150FD  N              LXI     H,GLB:TIMR          NOW CHECK FOR TIME OUTS
168  06 000B0   46      A              MOV     B,M                 LOAD 'B' WITH QUANTITY TO LOOK
169  06 000B1   16FB    A              MVI     D,COUNT:            FOR (CLOCK CELL VALUE)
170  06 000B3   CD0000  N              CALL    FIND:LOC            SET 'D' FOR TABLE TO SEARCH
171  06 000B6   CAF000  N              IF:     CC,Z,C              GO LOOK IN ACTIVE LIST
172  06 000B9   E5      A                  PUSH    H               HAS A MATCH BEEN FOUND
173  06 000BA   26FC    A                  MVI     H,ID:           YES - SAVE LOCATION ON STACK
174  06 000BC   5E      A                  MOV     E,M             SEGWAY MEM PTR TO ID: TABLE
175  06 000BD   1600    A                  MVI     D,0             NOW ASSEMBLE
176  06 000BF   21C8F4  A                  LXI     H,TMR:FLGS      ADDRESS OF TIMER
177  06 000C2   19      A                  DAD     D               FLAG INTO THE
178  06 000C3   0600    A                  MVI     B,0             MEMORY POINTER
179  06 000C5   F3      A                  DI                      GET SET TO CLEAR THE FLAG
180  06 000C6   7E      A                  MOV     A,M             NO INTERRUPTIONS NOW, PLEASE
                                                                   GET FLAG
```

```
06 000C7   07       A          RLC                          INTO THE CARRY BIT
06 000C8   D2EC00   N          IF:      CC,C,S              IS FLAG SET
06 000CB   70       A              MOV      M,B             YES - RESET AND NOW
06 000CC   FB       A              EI                       EVERYBODY CAN INTERRUPT AGAIN
06 000CD   E1       A              POP      H               LOCATION FROM STACK TO MEM PTR
06 000CE   26FD     A              MVI      H,LS:ADDR       SEGWAY MEM PTR TO LS: TABLE
06 000D0   5E       A              MOV      E,M             GET LS TIME-OUT ADDRESS
06 000D1   24       A              INR      H               SEGWAY MEM PTR TO MS: TABLE
06 000D2   56       A              MOV      D,M             GET MS TIME-OUT ADDRESS
06 000D3   45       A              MOV      B,L             LOCATION TO 'B' TEMPORARILY
06 000D4   2A5FFD   N              LHLD     INPTR:          STUFF TIME-OUT ADDRESS INTO
06 000D7   73       A              MOV      M,E             INTO TABLE OF TIME-OUT
06 000D8   23       A              INX      H               ADDRESSES THAT IS CHECKED
06 000D9   72       A              MOV      M,D             FOR ENTRIES EVERY 10 MSECONDS
06 000DA   23       A              INX      H               BY THE STATE CHECKER
06 000DB   7D       A              MODBYT   L,AND,TIME:MSK  FORCE A CIRCULAR TABLE
06 000DC   E62F     A
06 000DE   6F       A
06 000DF   225FFD   N              SHLD     INPTR:          SAVE NEW ADDRESS LOCATION
06 000E2   58       A              MOV      E,B             LOCATION BACK TO 'E'
06 000E3   CD0000   N              CALL     DEACTIV:        TAKE OUT OF ACTIVE TIMER LIST
06 000E6   CD0000   N              CALL     PUT:            AND MAKE LOCATION AVAILABLE
06 000E9   C3EE00   N          ELSE:                        * * * FLAG IS NOT SET SO
06 000EC   FB       A              EI                          LET INTERRUPTIONS OCCUR
06 000ED   E1       A              POP      H                  MAKE THE STACK RIGHT AND
                               ENDIF                          FORCE NON-ZERO CONDITION TO
06 000EE   F601     A          MODBYT   A,OR,1                STAY IN UNTIL LOOP
                           ENDIF                            * * * NO MATCH - RTC COMPLETE
06 000F0   C2AD00   N      UNTIL:   CC,Z,S                  WILL FALL THROUGH THIS CRACK
                       *
06 000F3   E1       A      POP      H                       RESTORE THE
06 000F4   44       A      MOV      B,H                     'B' REGISTER
06 000F5   E1       A      POP      H                       RESTORE H&L REGS
06 000F6   D1       A      POP      D                       RESTORE D&E REGS
06 000F7   F1       A      POP      PSW                     RESTORE A-REG & CONDITION CODES
06 000F8   C9       A      RET                              RETURN TO 'FLOAT' BACKGROUND
                       *
```

TABLE XI

```
                       ************************************************************
                       * STAND-BY FRONT PANEL SWITCH SCAN (NOT READY & READY STATES) *
                       ************************************************************

05 00000   3A57FA   N      IF:      XBYT,MINIBYTE,EQ,0
05 00003   FE00     A
05 00005   C22600   N
05 00008   1E05     A          MVI      E,5                  E= # INPUTS TO READ (6 BYTES)
05 0000A   2168FC   N          LXI      H,PREVOIN+6          H&L= 'PRIOR READ' TABLE (+1)
05 0000D   E5       A          PUSH     H                    SAVE ADDR ON STACK
                               REPEAT                        LOOP 'UNTIL' 6 BYTES TESTED
05 0000E   7B       A              MOV      A,E              A= 5, 4, 3, 2, 1, OR 0
05 0000F   07       A              RLC                       MULTIPLE
05 00010   07       A              RLC                                A-REG
05 00011   07       A              RLC                                     BY 8
05 00012   C607     A              MODBYT   A,ADD,X'07'      A= X'2F TO 07' (LOW INPUT ADDR)
05 00014   6F       A              RIBYT    A                READ PROPER FRONT PANEL IN BYTE
05 00015   CD0000   N
05 00018   E1       A              POP      H                H&L= ADDR OF 'PRIOR READ' BYTE
05 00019   2B       A              DCX      H                MOVE TO NEXT BYTE IN TABLE
05 0001A   E5       A              PUSH     H                SAVE FOR NEXT TIME AROUND LOOP
05 0001B   CD7D00   N              CALL     SWSOSCAN
05 0001E   1D       A              DCR      E                DECRM LOOP CNTR(5 TO-1)
05 0001F   F2CE00   N          UNTIL:   CC,S,S
05 00022   E1       A          POP      H


                       ************************************
                       * PRINT STATE FRONT PANEL SWITCH SCAN *
                       ************************************

05 00156               PRTOSWS  EQU      $
05 00156               RUNNOSWS EQU      $
05 00156   3A57FA   N      IF:      XBYT,MINIBYTE,EQ,0
05 00159   FEC0     A
05 0015B   C28301   N
05 0015E   2ECC     A          RIBYT    KYBD#BY2-3           READ CLEAR(D7),,STOP PRT,
05 00160   CDC000   N
05 00163   E6A3     A          MODBYT   A,AND,X'A3'          START PRT, AS A BYTE
05 00165   07       A          RLC
05 00166   5F       A          MOV      E,A                  SAVE TEMPORARILY IN E-REG
05 00167   2E27     A          RIBYT    KYBD#BYT4            READ 'ADH#SNGL' & 'ADH#MULT'
05 00169   CD0000   N
05 0016C   0F       A          RRC                           MERGE WITH
05 0016D   E630     A          MODBYT   A,AND,X'30'                 1ST BYTE
05 0016F   B3       A          MODBYT   E,OR,A                            READ
05 00170   5F       A
05 00171   2E16     A          RIBIT    AX#TRAY              READ 'AX#TRAY' BIT
05 00173   CDC000   N
05 00176   7B       A          MOV      A,E                   AND MERGE WITH 2
05 00177   17       A          RAL                            PREVIOUS BYTE READS
05 00178   1EE6     A          SWSPOINT  48
05 0017A   2162FC   N          LXI      H,PREVOIN            H&L= ADDR 'PRIOR READ' BYTE
05 0017D   CD7D00   N          CALL     SWSOSCAN             &INPUT SW BYTE DECODE SUBR

                       ************************************************************************
                       * COMMON SWITCH SCAN SUBR-  ENTER WITH SWITCH BYTE IN A-REG (FROM BIT OR BYTE  *
                       *   FILTERING SUBROUTINES), ADDR OF PRIOR SWITCH CONDITION BYTE IN MEMORY (H&L *
                       *   REGS), AND E-REG SET TO SWITCH BYTE (AND 'CASE:' GROUP) NUMBER (5 TO 0).   *
                       ************************************************************************
```

```
157  05 0007D  47      A  SWS@SCAN M0V      R,A                          R= LATEST 'READ' DATA
158  05 0007E  7E      A          M0V      A,M                          A= PRIOR 'READ' DATA
159  05 0007F  70      A          M0V      M,B                          UPDATE 'PRIOR' TO 'LATEST'
160  05 00080  A8      A          M0DBYT   A,X0R,B                      A= 1 WHERE SWS JUST CHANGED
161  05 00081  A0      A          IF:      XBYT,A,AND,B,NZ              WERE ANY SWS JUST PUSHED
     05 00082  CA5501  N
162  05 00085  26FF    A              MVI      H,X'FF'                  YES, INIT BIT POSITION CNTR
163                                   REPEAT                            LOOP 'UNTIL' NO BITS= 1 IN BYTE
164  05 00087  24      A                  INR      H                    H= POSITION OF SW (D0 TO D7)
165  05 00088  17      A                  RAL                           PUT SW INFO INTO 'C' BIT

166  05 00089  D25101  N                  IF:      CC,C,S               HAS THIS SW JUST BEEN PUSHED
167  05 0008C  F5      A                      PUSH     PSW              YES, SAVE
168  05 0008D  D5      A                      PUSH     D                     REGS OVER
169  05 0008E  E5      A                      PUSH     H                                 'CASE!'
170  05 0008F  7B      A                      M0V      A,E              RELOAD 'BYTE #' CNTR
171  05 00090  E61F    A                      ANI      X'1F'            ELLIM.POSS.OF POSITIVE #
172  05 00092  07      A                      RLC                       MULTIPLE
173  05 00093  07      A                      RLC                            A=REG
174  05 00094  07      A                      RLC                                 BY 8
175  05 00095  84      A                      CASE:    XBYT,A,ADD,H     USE BYTE # & BIT # AS A PNTR
     05 00096  114E01  N
     05 00099  FE58    A
     05 0009B  C00000  N

177                          ************************************************************
178                          * ACTIVE SWITCHES FOR STAND-BY (NOT READY & READY STATES)  *
179                          ************************************************************
180  05 0009E  0000    N                          C,00     DIGIT@IN     DIGIT 1
181  05 000A0  0000    N                          C,01     DIGIT@IN     DIGIT 2
182  05 000A2  0000    N                          C,02     DIGIT@IN     DIGIT 3
183  05 000A4  0000    N                          C,03     DIGIT@IN     DIGIT 4
184  05 000A6  0000    N                          C,04     DIGIT@IN     DIGIT 5
185  05 000A8  0000    N                          C,05     DIGIT@IN     DIGIT 6
186  05 000AA  0000    N                          C,06     DIGIT@IN     DIGIT 7
187  05 000AC  0000    N                          C,07     DIGIT@IN     DIGIT 8
188                          *
189  05 000AE  0000    N                          C,08     DIGIT@IN     DIGIT 9
190  05 000B0  0000    N                          C,09     KYBD@0       DIGIT 0
191  05 000B2  0000    N                          C,10     RECALL@
192  05 00094  0000    N                          C,11     @CLEAR       CLEAR
193  05 000B6  0000    N                          C,12     IMAG@SFT     IMAGE SHIFT
194  05 000B8  9301    N                          C,13     SPARE
195  05 000BA  0000    N                          C,14     STRT@PRT     START PRINT
196  05 000BC  0000    N                          C,15     STOP@PRT     STOP PRINT
197                          *
198  05 000BE  0000    N                          C,16     VAR@DENS     VARIABLE DENSITY
199  05 000C0  0000    N                          C,17     AX@TRAY      AUX TRAY
200  05 000C2  9301    N                          C,18     SPARE
201  05 000C4  9301    N                          C,19     SPARE
202  05 000C6  9301    N                          C,20     SPARE
203  05 000C8  0000    N                          C,21     PEC@ON       PASTE UP SUPPRESSION
204  05 000CA  0000    N                          C,22     2SD@CPY      2 SIDED COPY
205  05 000CC  9301    N                          C,23     SPARE
206                          *
207  05 000CE  9401    N                          C,24     RX
208  05 000D0  9401    N                          C,25     RX
209  05 000D2  9401    N                          C,26     RX
210  05 000D4  9401    N                          C,27     RX
211  05 000D6  0000    N                          C,28     98@REDN      98% REDUCTION
212  05 000D8  0000    N                          C,29     74@REDN      74% REDUCTION
213  05 000DA  0000    N                          C,30     65@REDN      65% REDUCTION
214  05 000DC  0000    N                          C,31     RX@ZOOM      RANK ZOOM LENS
215                          *
216  05 000DE  0000    N                          C,32     ADH@JREC     ADH JOB RECOVERY
217  05 000E0  0000    N                          C,33     ADH@MULT     ADH MULTIPLE FEED
218  05 000E2  0000    N                          C,34     ADH@SGNL     ADH SINGLE FEED
219  05 000E4  9401    N                          C,35     RX
220  05 000E6  0000    N                          C,36     SRT@JOBS     SORTER JOB SUPPLEMENT
221  05 000E8  0000    N                          C,37     SRT@SETS     SORTER SETS
222  05 000EA  0000    N                          C,38     SRT@STKS     SORTER STACKS
223  05 000EC  9301    N                          C,39     SPARE
224                          *
225  05 000EE  9301    N                          C,40     SPARE
226  05 000F0  9301    N                          C,41     SPARE
227  05 000F2  9301    N                          C,42     SPARE
228  05 000F4  9301    N                          C,43     SPARE
229  05 000F6  0000    N                          C,44     SERVICE      TECH REP KEY SWITCH
230  05 000F8  0000    N                          C,45     FAULT@CD     DISPLAY FAULT CODE
231  05 000FA  0000    N                          C,46     LVDGNPRG     LEAVE DIAGNOSTIC PROGRAM
232  05 000FC  9301    N                          C,47     SPARE

234                          ********************************
235                          * ACTIVE SWITCHES FOR PRINT STATE *
236                          ********************************
237  05 000FE  0000    N                          C,48     RECALL@      RECALL QUANTITY
238  05 00100  0000    N                          C,49     ADH@PMUL     ADH MULTIPLE FEED
239  05 00102  0000    N                          C,50     ADH@PSIN'    ADH SINGLE FEED
240  05 00104  9301    N                          C,51     SPARE
241  05 00106  0000    N                          C,52     SMPL@CPY     SAMPLE COPY (START PRINT)
242  05 00108  0000    N                          C,53     PRT@STOP     STOP PRINT
243  05 0010A  0000    N                          C,54     CNTR@RST     DIAGNOSTIC COUNTER RESET
244  05 0010C  0000    N                          C,55     AX@PRNT      AUX TRAY

292  05 00151  B7      A              UNTIL:   XBYT,A,OR,A,Z            END WHEN NO BITS IN THIS BYTE
     05 00152  C28700  N
293                          ENDIF
294  05 00155  C9      A       RET                                      RETURN TO STDBY OR PRINT BKGND
```

TABLE XII

```
183                                 ***********************************************************************
184                                 *        TURN VARIABLE DENSITY CONTROL ON                             *
185                                 *                                                                     *
186                                 *                                                                     *
187                                 *                                                                     *
188                                 *                                                                     *
189                                 ***********************************************************************
190   05 00141   E610     A   DVBOVAR  IF:      XBYT,A,AND,SRLOAD:,NZ          IF SR LOAD BIT SET
      05 00143   CA8701   N
191   05 00146   3AE0FF   A            IF:       OBIT,VAR$DENS,T               IF VARIABLE DENSITY
      05 00149   E601     A
      05 00148   CA5801   N
192   05 00148   21EBFF   A                 SOBIT,P   DVL$BV$D                TURN ON VARIABLE BIAS CONTROL
      05 00151   3E40     A
      05 00153   B6       A
      05 00154   77       A
193   05 00155   C38701   N            ORIF:     OBIT,PEC$ON,T                 IF PEC SELECTED
      05 00158   3AE6FF   A
      05 00158   E601     A
      05 00150   CA7101   N
194   05 00160   21E5FF   A                 SOBIT,P   DVL$BV$D                TURN ON VARIABLE BIAS CONTROL
      05 00163   3E40     A
      05 00165   B6       A
      05 00166   77       A
195   05 00167   21ECFF   A                 SOBIT,P   DV$BV$CX                TURN ON EXTENDED RANGE
      05 0016A   3E40     A
      05 0016C   B6       A
      05 0016D   77       A
196   05 0016E   C38701   N            ORIF:     OBIT,PASTE$UP,T               IF PUS IS SELECTED
      05 00171   3AF6FF   A
      05 00174   E601     A
      05 00176   CA8701   N
197   05 00179   21E8FF   A                 SOBIT,P   DVL$BV$D                TURN ON DEVELOPER BIAS D
      05 0017F   77       A
198   05 00180   21F6FF   A                 SOBIT,P   DVL$BV$E                TURN ON DEVELOPER BIAS E
      05 00183   3E02     A
      05 00185   B6       A
      05 00186   77       A
199                                 ENDIF
200                                 ENDIF
201   05 00187   C9       A         RET
```

TABLE XIII

```
170                                 ***********************************************************************
171                                 *                                                                     *
172                                 *        TURN VARIABLE DENISTY CONTROL OFF                            *
173                                 *                                                                     *
174                                 *        SHIFT REGISTER  0                                            *
175                                 *        PITCH EVENT CLOCK COUNT 539                                  *
176                                 ***********************************************************************
177   05 00126   E610     A   DVLVOOFF IF:     XBYT,A,AND,SRLOAD:,Z           IS SR LOAD BIT SET
      05 00128   C24001   N
178   05 00128   21ECFF   A            COBIT,P   DV$BV$CX                    TURN OFF EXTENDED RANGE
      05 0012E   3EBF     A
      05 00130   A6       A
      05 00131   77       A
179   05 00132   21EBFF   A            COBIT,P   DVL$BV$D                    TURN OFF THE VARIABLE BIAS
      05 00135   3EBF     A
      05 00137   A6       A
      05 00138   77       A
180   05 00139   21F6FF   A            COBIT,P   DVL$BV$E                    TURN OFF DEVELOPER BIAS E
      05 0013C   3EFD     A
      05 0013E   A6       A
      05 0013F   77       A
181                                 ENDIF
182   05 00140   C9       A         RET
```

Figure 40A:
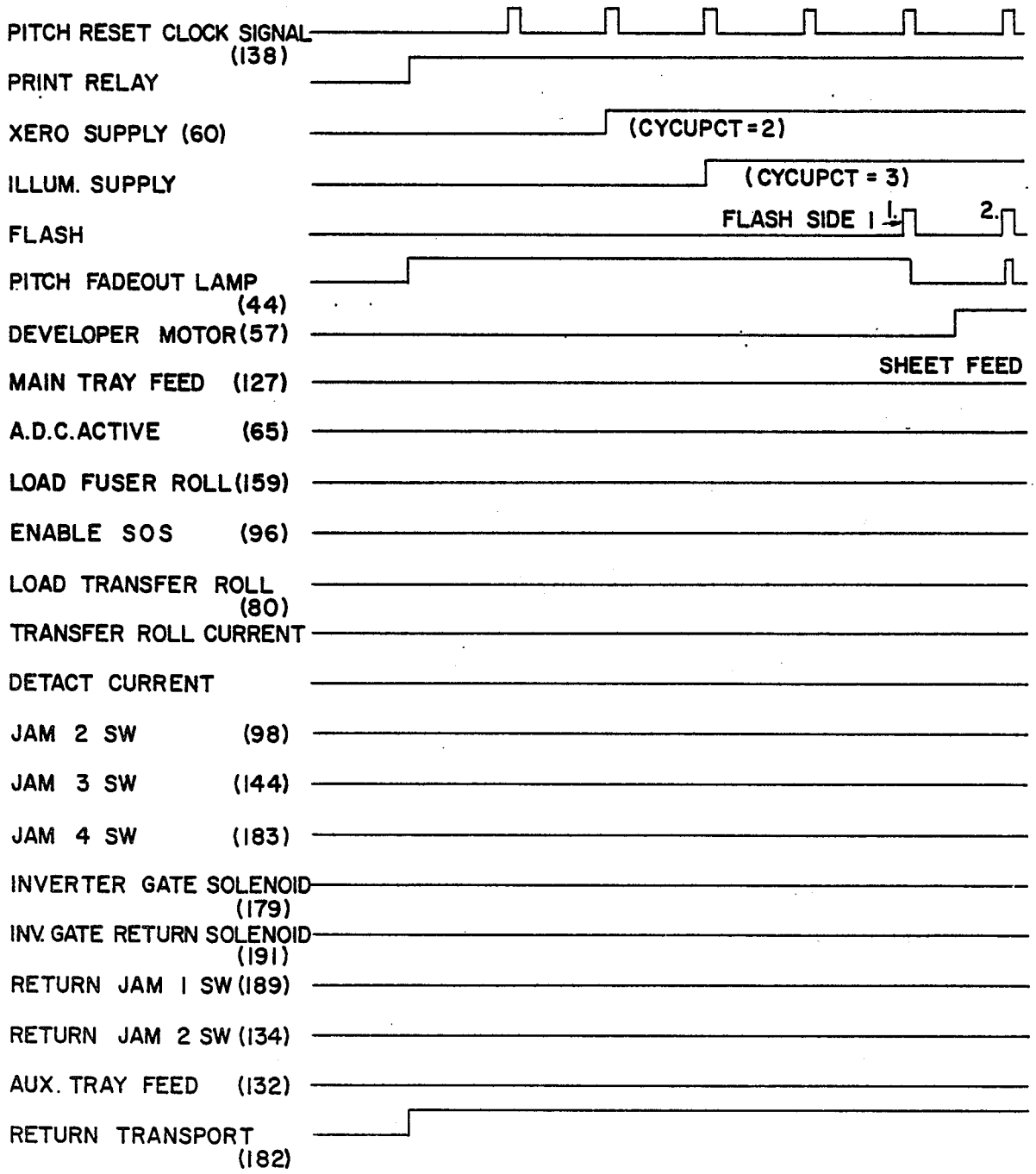
FIG. 40*a*, 40*b*, 40*c* are a timing chart of the principal operating components of the host machine in an exemplary copy run.
Figure 40B:
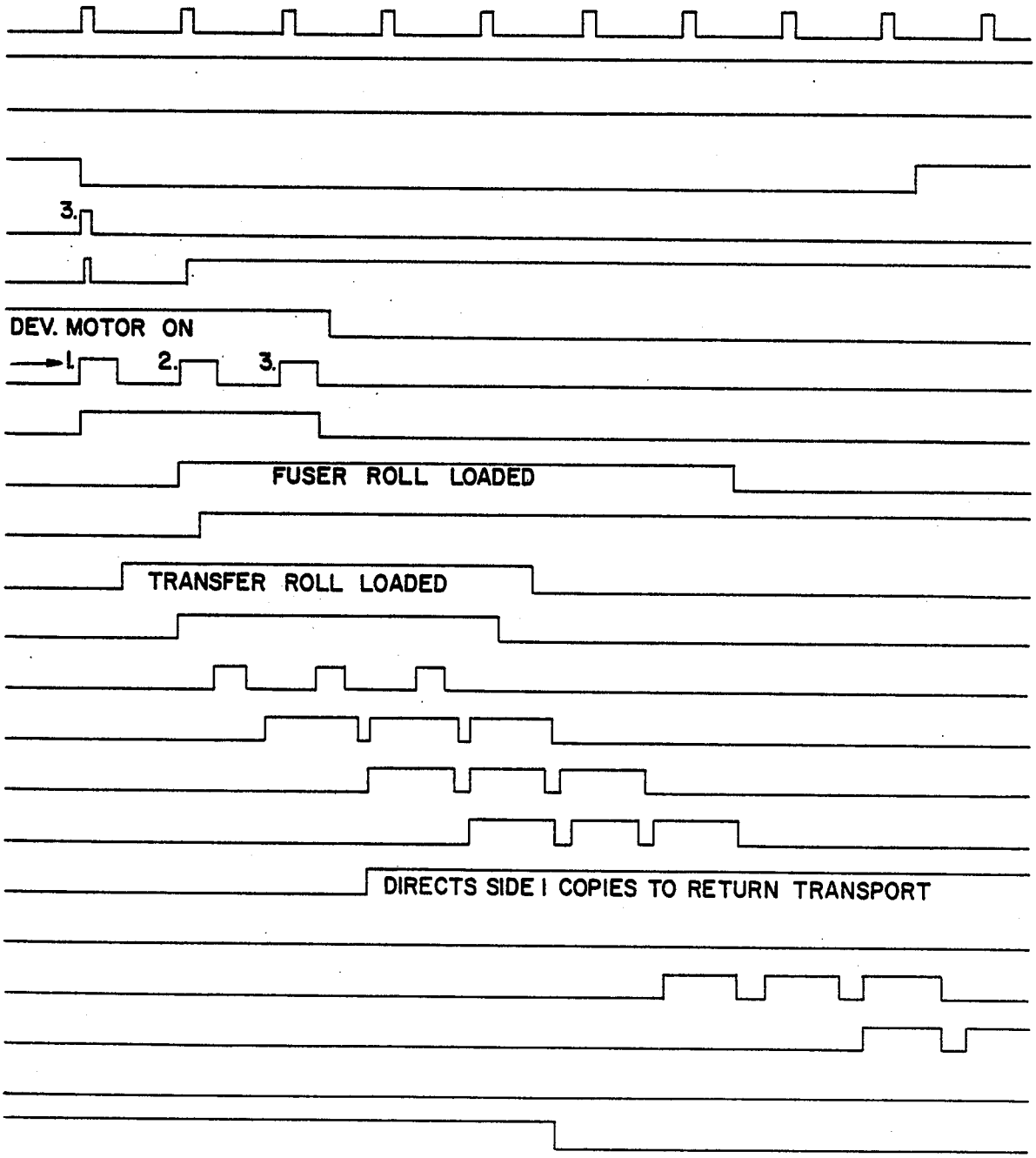
Figure 40C:
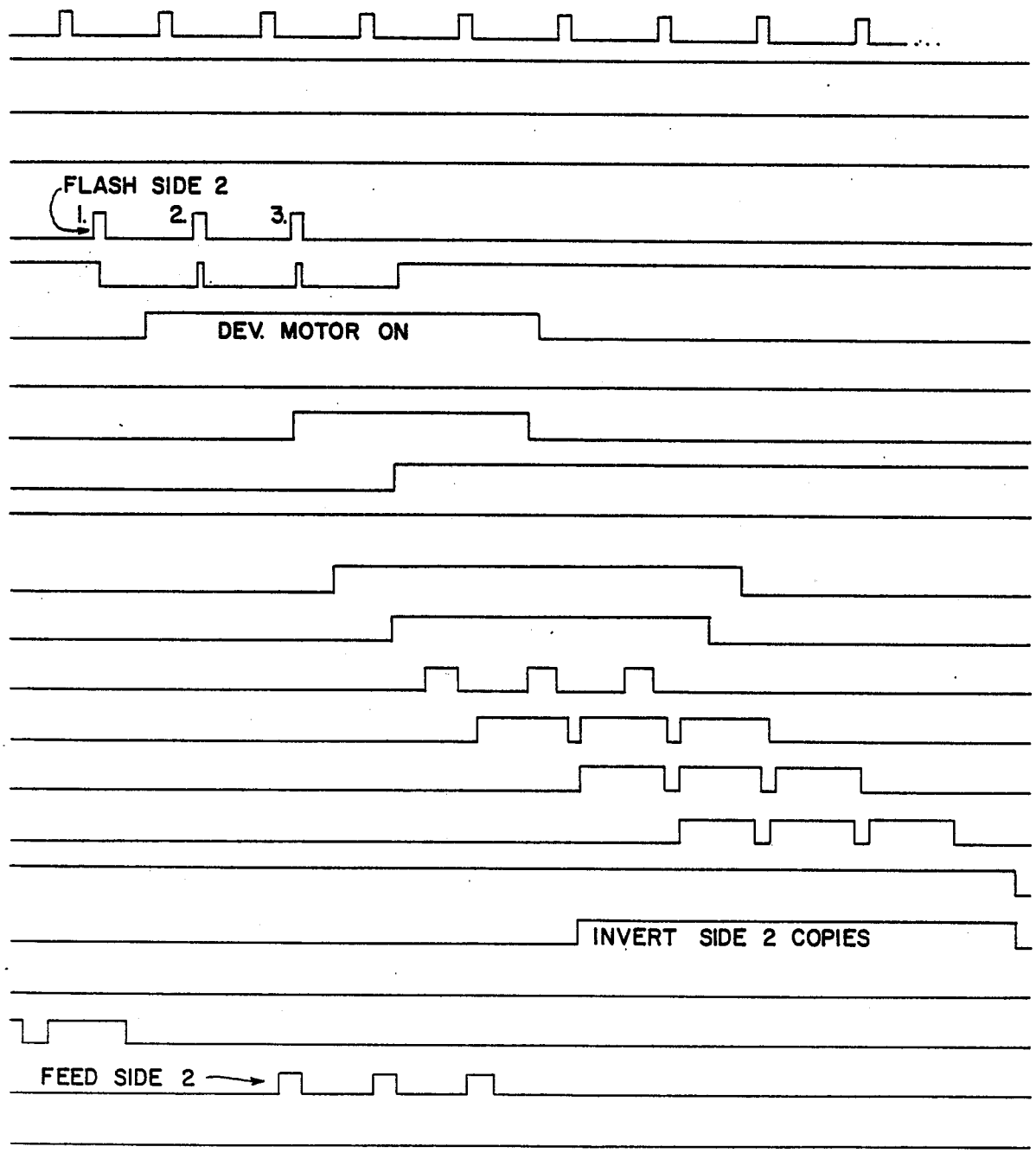

Referring particularly to the timing chart shown in FIG. 40, an exemplary copy run wherein three copies of each of two simplex or one-sided originals in duplex mode is made. Referring to FIG. 32, the appropriate button of copy selector 808 is set for the number of copies desired, i.e. 3 and document handler button 822, sorter select button 825 and two sided (duplex) button 811 depressed. The originals, in this case, two simplex or one-sided originals are loaded into tray 233 of document handler 16 (FIG. 14) and the Print button 805 depressed. On depression of button 805, the host machine 10 enters the PRINT state and the Run Event Table for the exemplary copy run programmed is built by controller 18 and stored in RAM section 546. As described, the Run Event Table together with Background routines serve, via the multiple interrupt system and output refresh (through D.M.A.) to operate the various components of host machine 10 in integrated timed relationship to produce the copies programmed.

Figure 41:
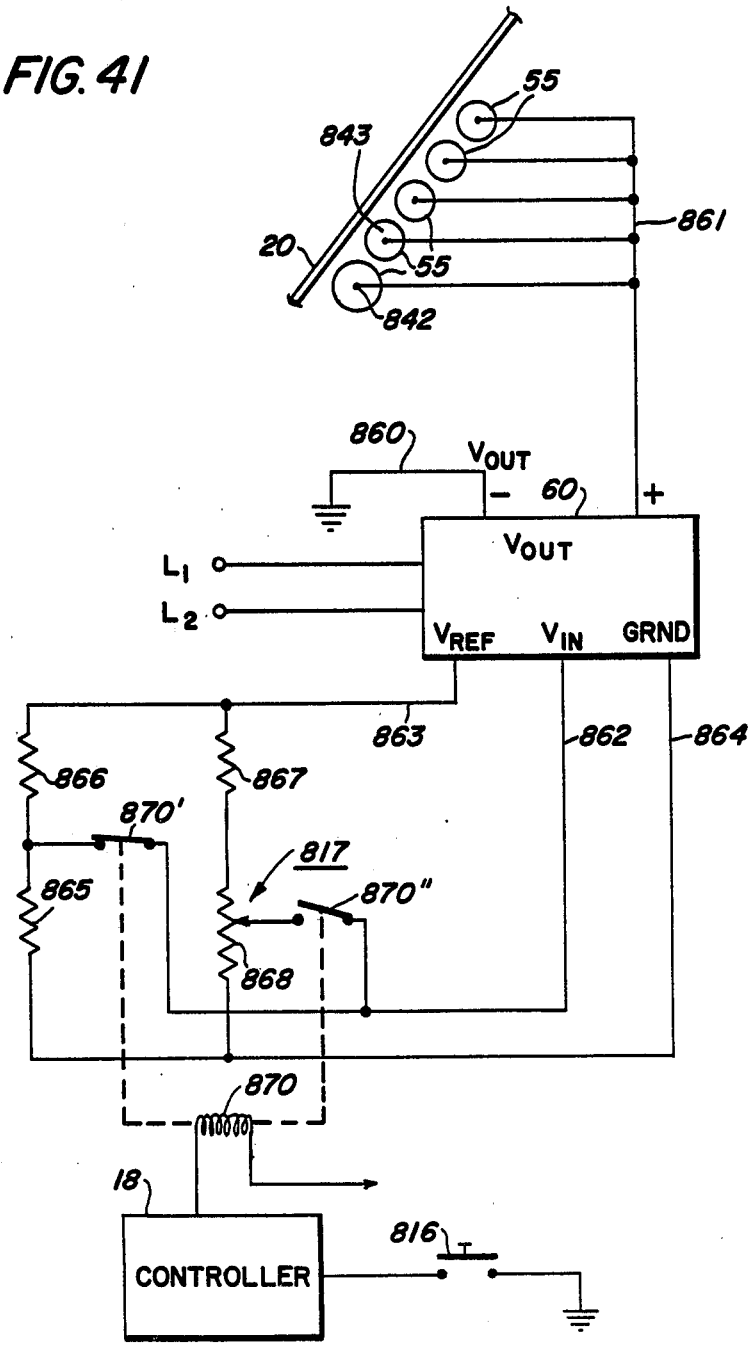
FIG. 41 is an electrical schematic of the bias control of the present invention.

During the run, the first original is advanced onto platen 35 by document handler 16 where, as seen in FIG. 41, three exposures (1st FLASH SIDE 1) are made producing three latent electrostatic images on belt 20 in succession. As described earlier, the images are developed at developing station 28 and transferred to individual copy sheets fed forward (1ST FEED SIDE 1) from main paper tray 100. The sheets bearing the images are carried from the transfer roll/belt nip by vacuum transport 155 to fuser 150 where the images are fixed. Following fusing, the copy sheets are routed by deflector 184 (referred to as an inverter gate in the tables) to return transport 182 and carried to auxiliary tray 102. The image bearing sheets entering tray 102 are aligned by edge pattern 187 in preparation for refeeding thereof.

Following delivery of the last copy sheet to auxiliary tray 102, the document handler 16 is activated to remove the first original from platen 35 and bring the second original into registered position on platen 35. The second original is exposed three times (FLASH SIDE 2), the resulting images being developed on belt 20 at developing station 28 and transferred to the opposite or second side of the previously processed copy sheets which are now advanced (FEED SIDE 2) in timed relationship from auxiliary tray 102. Following transfer, the side two images are fused by fuser 150 and routed, by gate 184 toward stop 190, the latter being raised for this purpose. Abutment of the leading edge of the copy sheet with stop 190 causes the sheet trailing edge to be guided into discharge chute 186, effectively inverting the sheet, now bearing images on both sides. The inverted sheet is fed onto transport 181 and into an output receptacle such as sorter 14 where, in this example, the sheets are placed in successive ones of the first three trays 212 of either the upper of lower arrays 210, 211 respectively depending on the disposition of deflector 220.

In the reproduction machine 10, a relatively high positive charge (i.e. 900 volts) is placed on photoreceptor belt 20 by corona charging device 42 in preparation for imaging. On exposure at imaging station 27 to the original on platen 35, a positive latent electrostatic likeness or image of the original 2 is produced which is thereafter developed at developing station 28 by negatively charged toner of the developing material. Magnetic brush developing rolls 50 function to bring the developing material in developer sump 51 into developing relationship with belt 20 and any latent electrostatic images thereon as will be understood.

To enhance development of the latent electrostatic images formed on belt 20, sleeves 55 of developing rolls 50 are electrically biased. For example, a positive bias of 300 volts may be used. Inasmuch as the bias potential on brush sleeves 55 regulates to some degree the amount of toner transferred to the latent electrostatic image being developed, i.e. the degree of development, varying the bias applied can be used to make the image lighter (i.e. less toner) or darker (i.e. more toner).

Referring particularly to drawing FIG. 32, console 800 includes variable copy density control 817 to permit the bias on developing rolls 50 to be varied over a predetermined range which in turn varies the copy shading from light to dark and vice versa. Pushbutton type selector switch 816 on console 800 renders variable density control 817 operable as will appear.

Referring now to drawing FIGS. 1 and 6 and FIG. 41 in particular, a suitable source of d.c. bias potential, d.c. power source 60, is provided. The negative output terminal of power source 60 is coupled to the machine chassis (not shown) by lead 860 while distributing lead 861 applies the bias voltage from the positive output terminal of power source 60 to sleeves 55 of developing rolls 50 through slip ring type couplings 842, roll support shaft 843 and the sleeve bearings (not shown). To prevent loss or dissipation of the bias through shorting or grounding of sleeves 55 with adjoining parts of the machine structure, sleeves 55 are, except for the electrical coupling described, electrically isolated. One type of bias applying and sleeve isolating system is disclosed in U.S. Pat. No. 3,968,773 issued on July 13, 1976 and incorporated by reference herein.

Power source 60 includes control (V in), reference (V ref.) and ground (grnd) taps on the control side thereof. Control, reference and ground lead 862, 863, 864 are coupled thereto. To permit the voltage output (V out) of power source 60 to distributing lead 861 to be varied through a preset voltage range, variable resistor 868 (VARIABLE) of variable copy density control 817 is provided together with normal (NORMAL) voltage control resistor 865. Resistors 865, 868 are coupled across leads 862, 864 through normally closed and open contacts 870', 870'' respectively of control relay 870. Lead 863 (V ref.) is coupled through line resistors 866, 867 and resistors 865, 868 to lead 864, and to lead 862 via relay contacts 870', 870''.

As will be understood, resistor 865 (NORMAL) is fixed in value to provide a predetermined voltage level control signal to power source 60. Power source 60 in response thereto provides a preselected voltage bias on sleeves 55 of magnetic brush rolls 50.

Variable copy density control 817 comprises variable resistor or reheostat 868. As will be understood, the setting of density control 817 determines, within the maximum and minimum values of resistor 868, the voltage level control signal to power source 60 and in accordance therewith the voltage bias applied to magnetic brush sleeves 55 by power source 60.

Control relay 870 is controlled by pushbutton selector switch 816 (VARIABLE DENSITY) on console 800 through machine controller 18. Referring particularly to the switch scan routine of TABLE XI, the various selector switches on console 800 are scanned during certain machine states to determine the switch settings. Included in the active switches scanned during the Not Ready (NRDY) and Ready (RDY) states is the variable copy density selector switch 816 (VARIABLE DENSITY). Where switch 816 has been actuated, a flag (VAR DENS) is set.

Referring particularly to the fixed Pitch Event Table (TABLE II) and the Variable Density Control routines (DVB VAR and DVLV OFF) of Tables XII and XIII at machine clock count 848, the variable bias or density control routine (DVB VAR) is called to activate the variable bias control 817 if the variable density flag (VAR DENS) has been set. Clock count 848 corresponds to the time when the latent electrostatic image created on photoconductive belt 20 is entering the developing zone 28 for development thereof by magnetic brushes 50. See FIGS. 1 and 6. It is understood that the machine clock count referred to comprises the machine clock signal 202 seen in FIG. 36 (i.e. clock count 848) and that pitch cycle referred to comprises the clock signal 138 also seen in FIG. 38.

The signal from controller 18 energizes relay 870 to open contacts 870' thereof and close contacts 870'' thereof. Opening of contacts 870' of relay 870 takes normal resistor 865 out of the voltage control circuit to power supply 60 while closure of contacts 870'' places variable resistor 868 in the power supply control circuit. The voltage output of power supply 60 to distributing lead 861 and magnetic brush sleeves 55 corresponds with the value of resistor 868 in the voltage input (V in) lead 862. The value of resistor 868 in turn depends upon the setting of bias selector 817 on control console 800 as determined by the machine operator.

At machine clock count 539 in the succeeding pitch cycle, the developer off routine (DVLV OFF) of Table XIII is called to turn off the variable bias of control 817 and revert back to the normal bias of resistor 865. Relay 870 is de-energized opening contacts 870'' thereof to interrupt the circuit to variable resistor 868. At the same time, relay contacts 870' are closed to restore normal voltage bias levels to sleeves 55 of magnetic brush developing rolls 50.

Variable density control 817 provides enhanced control over development by permitting the operator to make incremental changes in developer bias and thus tailor the density of the copies produced more closely to the operator's desires. Using this control, the operator can choose a setting, and run a sample copy to determine if the setting is correct. If unsatisfactory, the bias setting can be changed to a greater or less degree and a sample copy run, and the process repeated until an exact bias potential is obtained.

Typically, the voltage potential range of variable density control 817 includes the normal bias potential provided on closure of relay switch 833. As will be appreciated, the potential range of control 817 may be of substantial extent, ranging from very low biasing potential to a very high biasing potential.

The aforedescribed arrangement enables bias on the magnetic brush developing rolls to be varied within a predetermined voltage range as determined by resistor 868 to give different copy shadings and so provide control over copy image and background areas, permitting selective enhancement or suppression of copy development by the operator.

While the invention has been described with reference to the structure disclosed, it is not confined to the details set forth, but is intended to cover such modifications or changes as may come within the scope of the following claims.

What is claimed is:

1. An electrostatic printing machine having a photoconductive member movable relative to a developing zone, a magnetic brush developing device for developing electrostatic latent images on the member and means for establishing an electrical potential between the magnetic brush device and the latent image during development comprising:

a first circuit including a voltage source of preset fixed potential connected to said magnetic brush device to impress said preset fixed potential on said magnetic brush device;

a second circuit including an infinitely variable voltage source of potential;

means for adjusting said second circuit to provide a preset voltage potential; and control means associated with said circuits to disconnect said first circuit from said magnetic brush device and connect said second circuit to said magnetic brush device to impress said selected preset voltage potential from said second circuit between the magnetic brush device and said image during development of said image, said control means disconnecting said second circuit and reconnecting said first circuit following development of said image.

2. In an electrostatic reproduction machine having a photoreceptor moving through charging, exposure, developing, transfer and cleaning stations within the machine to produce copies, with said developing station including a magnetic brush device for developing latent images on the photoreceptor, wherein the improvement comprises:

first means for providing a fixed electrical potential;

second means for providing an infinitely variable electrical potential;

a controller for selectively regulating the output potential of said second means to provide a selected electric potential;

control means responsive to movement of the latent image on the photoreceptor through the developing station for connecting said second means to said magnetic brush device to apply said selected electric potential from said second means to said magnetic brush device, said control means reconnecting said first means to the magnetic brush device following movement of said latent image through said developing station.

3. The improvement of claim 2 which further comprises:

a second controller for disabling said second means whereby said first means provides said fixed electrical potential to said magnetic brush device at all times.

* * * * *